US006696234B2

(12) United States Patent
Inaba et al.

(10) Patent No.: US 6,696,234 B2
(45) Date of Patent: Feb. 24, 2004

(54) SILVER HALIDE PHOTOSENSITIVE MATERIAL AND ISOTHIAZOLIDINE-3-ONE DERIVATIVE

(75) Inventors: Tadashi Inaba, Minami-Ashigara (JP); Masaru Takasaki, Minami-Ashigara (JP); Atsushi Matsunaga, Minami-Ashigara (JP); Mamoru Sakurazawa, Minami-Ashigara (JP); Shinichi Ichikawa, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/252,441

(22) Filed: Sep. 24, 2002

(65) Prior Publication Data

US 2003/0190566 A1 Oct. 9, 2003

(30) Foreign Application Priority Data

Sep. 27, 2001 (JP) ..... 2001-296577
Jun. 13, 2002 (JP) ..... 2002-173079

(51) Int. Cl.[7] ..... G03C 1/34; G03C 7/392

(52) U.S. Cl. ..... 430/551; 430/600; 430/614; 430/567; 546/213

(58) Field of Search ..... 430/614, 600, 430/551, 567

(56) References Cited

U.S. PATENT DOCUMENTS 4,490,462 A * 12/1984 Kawaguchi et al. ..... 430/546
5,468,602 A * 11/1995 Takahashi ..... 430/614
5,968,724 A 10/1999 Eikenberry et al.
6,214,529 B1 * 4/2001 Eikenberry et al. ..... 430/614
6,350,567 B1 * 2/2002 Chen et al. ..... 430/614

FOREIGN PATENT DOCUMENTS

JP 2000-131789 A 5/2000
JP 2000-131790 A 5/2000

* cited by examiner

*Primary Examiner*—Richard L. Schilling
(74) *Attorney, Agent, or Firm*—Sughrue Mion, PLLC

(57) ABSTRACT

A silver halide photosensitive material contains a compound of the following general formula (I):

(I)

wherein $A_{1a}$ represents a group selected from among $CR_{1a}R_{2a}$, $NR_{1a}$, an oxygen atom and sulfur atom, $A_{1b}$ represents a group selected from among $CR_{1b}R_{2b}$, $NR_{1b}$, an oxygen atom and sulfur atom, and each of $R_{1a}$, $R_{2a}$, $R_{1b}$, $R_{2b}$ and $R_3$ represents a hydrogen atom or a substituent, provided that, in the groups of $CR_{1a}R_{2a}$ and $CR_{1b}R_{2b}$, $R_{1a}R_{2a}$ and $R_{1b}R_{2b}$ may represent a single divalent substituent, n represents an integer of 1 to 4, provided that, when n is 2 or more, a plurality of $A_{1b}$s may be the same or different.

11 Claims, No Drawings

SILVER HALIDE PHOTOSENSITIVE MATERIAL AND ISOTHIAZOLIDINE-3-ONE DERIVATIVE

CROSS-REFERENCE TO RELATED APPLICATIONS

This application is based upon and claims the benefit of priority from the prior Japanese Patent Applications No. 2001-296577, filed Sep. 27, 2001; and No. 2002-173079, filed Jun. 13, 2002, the entire contents of both of which are incorporated herein by reference.

BACKGROUND OF THE INVENTION

1. Field of the Invention

The present invention relates to a silver halide photosensitive material. More particularly, the present invention relates to a silver halide color photosensitive material including a photographic emulsion that exhibits high speed and restrained fogging and that is excellent in raw stock storability and exposure humidity dependence. The present invention also relates to a method of forming images with the use of the same.

The present invention also relates to a novel isothiazolidin-3-one derivative that is useful as an intermediate for a medicament, pesticide and material for photograph and as an additive for photograph, and to a novel isothiazolidin-3-one derivative that, by adding it particularly to a silver halide photosensitive material, can restrain fogging.

2. Description of the Related Art

With respect to a silver halide photographic emulsion, an enhancement of speed/fog ratio is one of the most important tasks. Silver iodochloride emulsions having a silver iodochloride layer at the surface or subsurface portions of silver halide grains are preferred from the viewpoint that a high speed can be obtained and that the emulsion is excellent in high illumination intensity exposure adaptability. Representative examples of such silver iodochloride emulsions are disclosed in, for example, U.S. Pat. Nos. 5,550,013, 5,728,516, 5,547,827, 5,605,789, 5,726,005 and 5,736,310. However, the techniques disclosed in these patents have a drawback in that an increase of photographically unfavorable fog occurs in accordance with an increase of iodide content.

On the other hand, Jpn. Pat. Appln. KOKAI Publication No. (hereinafter also referred to as JP-A-) 4-368935 discloses that a silver halide color lightsensitive material which is excellent in raw stock storability can be obtained by the use of an adsorptive reducing compound, such as a hydroquinone compound, having an adsorption group acting on silver halide grains. However, the technique disclosed therein is silent about the effect of exhibiting low fog, high speed and excellent raw stock storability with respect to, in particular, a silver iodochloride or silver iodochlorobromide emulsion system.

Further, JP-A-9-43764 discloses that a silver halide color photosensitive material having prevented such a pressure fogging as experienced at the time of storage of a wound lengthy lightsensitive material at high temperatures, or a packaging thereof can be obtained by the use of a specific hydroxamic acid compound. However, the technique disclosed therein is silent about the raw stock storability, exposure humidity dependence and restraint on speed change over a period of from exposure to processing with respect to a silver iodochloride or silver iodochlorobromide emulsion.

As known compounds which are effective in restraining fogging with respect to emulsions containing silver chloride, silver iodochloride, silver chlorobromide, silver bromide, silver iodobromide and silver iodochlorobromide, other than the above hydroxamic acid compound, there can be mentioned, for example, hydroxyureas (JP-A's-2000-275767 and 8-246911), phenidones (JP-A-2000-330247), hydroxamic acids (JP-A's-11-282117, 9-90546, 9-90546, 9-133983, 8-114884, 8-333325 and 8-314051), heterocyclic hydroxylamines (JP-A-11-102046), hydroxysemicarbazides (JP-A-10-90819), hydroxyamines (JP-A-9-197635) and hydrazines (JP-A-7-134351 and Japanese Patent 2787630). In the techniques disclosed in these publications, there is no advantage of exhibiting low fogging and high speed, and of being excellent in the raw stock storability, exposure humidity dependence, exposure temperature dependence and restraint on speed change during the passage of time.

In the present invention, it has been found that an isothiazolidinone having a saturated ring is especially effective in restraining fogging. In JP-A-9-133977, there is a description that fogging can be reduced by adding isothiazolones (isothiazol-3-one) of similar skeleton in the step up to silver halide grain nucleation and/or stage corresponding to 60% of crystal growth. Further, in JP-A-2000-131790, it is described that fogging can be reduced by adding a certain type of isothiazolone before or during precipitation of silver halide emulsion (although there is no description regarding the raw stock storability, exposure humidity dependence and exposure temperature dependence). However, for inducing the advantages of these compounds, there has been a limitation on the timing of addition thereof to silver halide emulsion. Moreover, when the addition amount thereof is increased for inducing the advantage, desensitization occurs at an amount over a certain level to thereby occasionally invite a rupture of photographic performance prior to reaching a satisfactory level of improvement. Thus, with respect to these compounds, the appropriate range of use amount is restricted. Therefore, there has been a demand for a compound capable of solving this deficiency.

On the other hand, isothiazolidin-3-one derivatives have been utilized for uses such as medicaments and pesticides. However, only a very few compounds having no substituent or having an alkyl substituent on the carbon atoms at the 4- and 5-positions, are known. Furthermore, we could not find out through our research down to those having a hydrogen atom on the nitrogen atom at the 2-position. Such compounds that could be known are only as follows: 2-methyl-isothiazolidin-3-one, 2-butyl-isothiazolidin-3-one and 2-phenyl-isothiazolidin-3-one described in Justus Liebigs Annalen der Chemie, 679, 123–135 (1964); 2-methyl-isothiazolidin-3-one described in Journal of the Chemical Society, Perkin Transactions 1,153–158 (1985); 2-(2-propynyl)isothiazolidin-3-one and the like described in Hlevetica Chimica Acta, 70, 2232–2244 (1987); isothiazolidin-3-one described in JP-A-2000-212171; 2-octyl-isothiazolidin-3-one described in JP-A-9-157112; 2-chloromethyl-isothiazolidin-3-one described in JP-A-9-509922; and 2,4,4-trimethyl-isothiazolidin-3-one described in JP-A-61-165304. However, since required performances of the compounds vary depending on aims, solely the group of compounds that have been known so far is not sufficient, and thus development of additional isothiazolidin-3-one derivatives has been desired.

BRIEF SUMMARY OF THE INVENTION

The objects of the present invention is to solve the above problems of the prior art and to attain the following objects.

The first object of the present invention is to provide a silver halide photosensitive material that exhibits high speed and restrained fogging and that is excellent in raw stock storability, with the use of an emulsion containing silver chloride, silver iodochloride, silver chlorobromide, silver bromide, silver iodobromide or silver iodochlorobromide. The second object of the present invention is to provide a silver halide photosensitive material whose exposure humidity dependence is small. The third object of the present invention is to provide a silver halide photosensitive material whose speed change over a period of from exposure to processing is small. The fourth object of the present invention is to provide novel isothiazolidin-3-one derivatives that are useful for synthetic intermediates of medicaments, pesticides and raw materials of photograph, especially those that can restrain fogging by adding them to a silver halide photosensitive material.

The inventors have made extensive and intensive studies, and has found that the objects of the present invention can be attained by the following means. Accordingly, the present invention provides (1) a silver halide photosensitive material containing a compound of the following general formula (I):

(I)

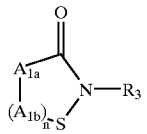

In the formula, $A_{1a}$ represents a group selected from among $CR_{1a}R_{2a}$, $NR_{1a}$, an oxygen atom and sulfur atom; $A_{1b}$ represents a group selected from among $CR_{1b}R_{2b}$, $NR_{1b}$, an oxygen atom and sulfur atom; and each of $R_{1a}$, $R_{2a}$, $R_{1b}$, $R_{2b}$ and $R_3$ represents a hydrogen atom or a substituent, provided that, with respect to $CR_{1a}R_{2a}$ and $CR_{1b}R_{2b}$, $R_{1a}R_{2a}$ and $R_{1b}R_{2b}$ may represent a single divalent substituent. n represents an integer of 1 to 4, provided that, when n is 2 or more, a plurality of $A_{1b}$s may be the same or different.

(2) The present invention also provides a isothiazolidin-3-one derivative represented by the following general formula (II):

(II)

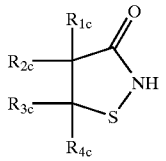

In the formula, each of $R_{1c}$, $R_{2c}$, $R_{3c}$ and $R_{4c}$ represents a hydrogen atom, an alkyl group, amino group, nitro group, carboxy group, acylamino group, carbamoyl group or a halogen atom, provided that each of $R_{1c}$, $R_{2c}$, $R_{3c}$ and $R_{4c}$ does not simultaneously represent a hydrogen atom.

Preferable embodiments of the above (1) are as follows:

(3) n in the general formula (I) is 1.

(4) $A_{1a}$ in the general formula (I) is $CR_{1a}R_{2a}$.

(5) $A_{1b}$ in the general formula (I) is $CR_{1b}R_{2b}$.

(6) $A_{1a}$ in the general formula (I) is $CH_2$.

(7) $A_{1b}$ in the general formula (I) is $CH_2$.

(8) $R_3$ in the general formula (I) is a hydrogen atom.

(9) The silver halide photosensitive material contains an emulsion comprising tabular silver halide grains each having an aspect ratio of 2 or more in an amount of 50% or more of the total projected area.

(10) The silver halide photosensitive material contains silver halide grains having a silver chloride content of 95 mol % or more.

(11) The silver halide photosensitive material is a color paper.

(12) The silver halide photosensitive material is a color negative.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

The present invention will be described in detail below.

One of the characteristic features of the general formula (I) of present invention is a saturated 5- to 8-membered ring skeleton having an —S—N—CO— bond therein (for example, isothiazolidin-3-one skeleton or thiadinan-3-one skeleton). Benzisothiazol-3-ones and isothiazolones (for example, isothiazol-3-ones (JP-A-9-133977)) having unsaturated rings are known as compounds having a skeleton similar to that of the general formula (I) of the present invention. However, such known compounds have been unable to resolve the above task to a satisfactory level. So, it was an unexpected result that the objects have been attained by a compound having a saturated 5- to 8-membered ring skeleton (isothiazolidin-3-one skeleton).

First, the compounds of the general formula (I) will be described in detail.

(I)

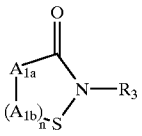

In the formula, $A_{1a}$ represents a group selected from $CR_{1a}R_{2a}$, $NR_{1a}$, an oxygen atom and sulfur atom; and $A_{1b}$ represents a group selected from $CR_{1b}R_{2b}$, $NR_{1b}$, an oxygen atom and sulfur atom. With respect to $CR_{1a}R_{2a}$ and $CR_{1b}R_{2b}$, $R_{1a}R_{2a}$ and $R_{1b}R_{2b}$ may represent a single divalent substituent. That is, the substituent represented by $>CR_{1a}R_{2a}$ may be $>C=R_{1a}$. Similarly, the substituent represented by $>CR_{1b}R_{2b}$ may be $>C=R_{1b}$.

Preferably, $A_{1a}$ and $A_{1b}$ represent $CR_{1a}R_{2a}$ or $NR_{1a}$, and $CR_{1b}R_{2b}$ or $NR_{1b}$, respectively. More preferably, $A_{1a}$ and $A_{1b}$ represent $CR_{1a}R_{2a}$ and $CR_{1b}R_{2b}$, respectively. n is an integer of 1 to 4. When n is 2 or more, there are a plurality of $A_{1b}$s, which are independent and may be the same or different. When n is 2 or more, $A_{1b}$ groups are connected to each other through a single bond.

Each of $R_{1a}$, $R_{2a}$, $R_{1b}$ and $R_{2b}$ represents a hydrogen atom or substituent. The substituents represented by $R_{1a}$, $R_{2a}$, $R_{1b}$ and $R_{2b}$ can be, for example, a halogen atom (fluorine, chlorine, bromine or iodine), alkyl group (any of linear, branched and cyclic alkyl groups including a bicycloalkyl group and an active methine group; having preferably 1 to 20 carbon atoms, more preferably 1 to 10 carbon atoms, and especially preferably 1 to 4 carbon atoms; as examples thereof, there can be mentioned methyl, ethyl, n-propyl, isopropyl, n-butyl, isobutyl and tert-butyl), alkenyl group (preferably having 2 to 20 carbon atoms), alkynyl group (preferably having 2 to 20 carbon atoms), aryl group (preferably having 6 to 20 carbon atoms), heterocyclic group (substitution position not questioned, preferably having 1 to 6 carbon atoms), acyl group, alkoxycarbonyl group, aryloxycarbonyl group, heterocyclic oxycarbonyl group, carbamoyl group, N-hydroxycarbamoyl group, N-acylcarbamoyl group, N-sulfonylcarbamoyl group, N-carbamoylcarbamoyl group, thiocarbamoyl group, N-sulfamoylcarbamoyl group, carbazoyl group, carboxyl group or a salt thereof, oxalyl group, oxamoyl group, cyano group, carbonimidoyl group, formyl group, hydroxyl group, alkoxy group (including a group containing ethyleneoxy or propyleneoxy units as repeating units), aryloxy group, heterocyclic oxy group, acyloxy group, alkoxy- or aryloxycarbonyloxy group, carbamoyloxy group, sulfonyloxy group, amino group, alkyl-, aryl- or heterocyclic-amino group, acylamino group, sulfonamido group, ureido group, thioureido group, N-hydroxyureido group, imido group, alkoxy- or aryloxy-carbonylamino group, sulfamoylamino group, semicarbazide group, thiosemicarbazide group, hydrazino group, ammonio group, oxamoylamino group, N-alkyl- or N-aryl-sulfonylureido group, N-acylureido group, N-acylsulfamoylamino group, hydroxylamino group, nitro group, heterocyclic group containing a quaternary nitrogen atom (e.g., pyridinio, imidazolio, quinolinio or isoquinolinio), isocyano group, imino group, mercapto group, alkyl-, aryl- or heterocyclic-thio group, alkyl-, aryl- or heterocyclic-dithio group, alkyl- or aryl-sulfonyl group, alkyl- or aryl-sulfinyl group, sulfo group or a salt thereof, sulfamoyl group, N-acylsulfamoyl group, N-sulfonylsulfamoyl group or a salt thereof, phosphino group, phosphinyl group, phosphinyloxy group, phosphinylamino group and silyl group. If appropriate, the substituents can be dissociation products of these groups or salts thereof. These substituents may further be substituted.

The substituents represented by $R_{1a}$, $R_{2a}$, $R_{1b}$ and $R_{2b}$ are preferably an alkyl group, aryl group, amino group, alkoxy group, acyl group, alkoxycarbonyl group, aryloxycarbonyl group, acyloxy group, acylamino group, carbamoyl group, heterocyclic group and halogen atom; more preferably an alkyl group, aryl group, acylamino group and halogen atom; and especially preferably, an alkyl group and halogen atom.

n is an integer of 1 to 4. When n is 2 or more, there are a plurality of Ribs (and $R_{2b}$s), which are independent and may be the same or different. Any two of the $R_{1a}$, $R_{2a}$, $R_{1b}$ and $R_{2b}$ groups may be connected to each other to thereby form a ring. With respect to $CR_{1a}R_{2a}$ and $CR_{1b}R_{2b}$, $R_{1a}R_{2a}$ and $R_{1b}R_{2b}$ may represent a single divalent substituent. As such, there can be mentioned, for example, C=O, C=S or $C{=}CR_1'R_2'$ (wherein $R_1'$ and $R_2'$ represent a hydrogen atom of the above-mentioned substituents).

It is preferable that at least two of $R_{1a}$, $R_{2a}$, $R_{1b}$ and $R_{2b}$ represent hydrogen atoms. It is more preferred that at least three thereof represent hydrogen atoms, and especially preferred that all of them represent hydrogen atoms.

$R_3$ represents a hydrogen atom or a substituent. As the substituent represented by $R_3$, there can be employed those mentioned above with respect to the $R_{1a}$, etc. of the general formula (I). If appropriate, the substituent can be dissociation products of those groups or salts thereof. These substituents may further be substituted.

The substituent represented by $R_3$ is preferably an alkyl group, aryl group, acyl group, alkoxycarbonyl group, aryloxycarbonyl group, carbamoyl group, carboxyl group or heterocyclic group; more preferably an alkyl group, aryl group, acyl group, alkoxycarbonyl group, aryloxycarbonyl group or carbamoyl group; and especially preferably an alkyl group.

It is most preferred that $R_3$ represent a hydrogen atom.

n is preferably 1 or 2, more preferably 1.

Among the compounds represented by the general formula (I), those of the following general formula (III) are preferred; those of the general formula (IV) are more preferred; and those of the general formula (V) are most preferred.

(III)

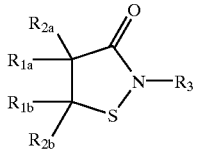

In the formula, $R_{1a}$, $R_{2a}$, $R_{1b}$ and $R_{2b}$ have the same meanings as those of the $R_{1a}$, $R_{2a}$, $R_{1b}$ and $R_{2b}$ of the general formula (I), respectively. Also, the preferred ranges thereof are the same as mentioned with respect to the $R_{1a}$, $R_{2a}$, $R_{1b}$ and $R_{2b}$ of the general formula (I). $R_3$ has the same meaning as that of the $R_3$ of the general formula (I). Also, the preferred range thereof is the same as mentioned with respect to the $R_3$ of the general formula (I).

(IV)

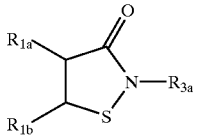

In the formula, $R_{1a}$ and $R_{1b}$ have the same meaning as that of the $R_{1a}$ of the general formula (I). Also, the preferred ranges thereof are the same as mentioned with respect to the $R_{1a}$ of the general formula (I). $R_{3a}$ represents a hydrogen atom, alkyl group, aryl group, acyl group, alkoxycarbonyl group, aryloxycarbonyl group, carbamoyl group, carboxyl group or heterocyclic group. The preferred ranges thereof are the same as those of the respective substituents represented by the $R_3$ of the general formula (I).

(V)

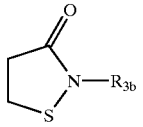

In the formula, $R_{3b}$ represents a hydrogen atom or alkyl group. The preferred range thereof is the same as that of the alkyl group represented by the $R_3$ of the general formula (I).

Among the hydrogen atom and alkyl group represented by $R_{3b}$, a hydrogen atom is preferred.

Specific examples of the compounds represented by the above general formula (I) of the present invention will be given below, which however in no way limit the scope of the present invention.

1
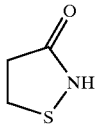
2
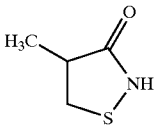
3
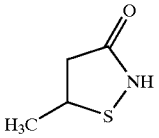
4
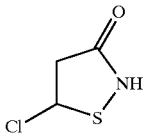
5
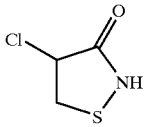
6
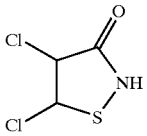
7
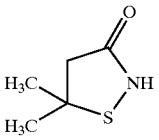
8
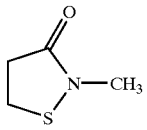
9
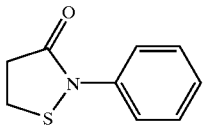
10
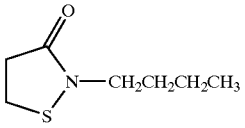
11
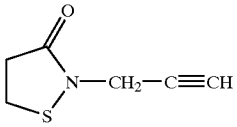
-continued
12
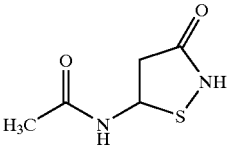
13
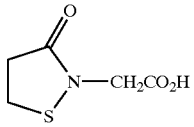
14
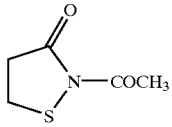
15
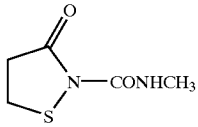
16
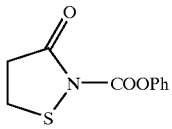
17
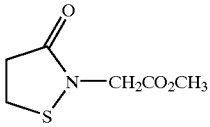
18
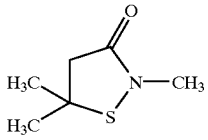
19
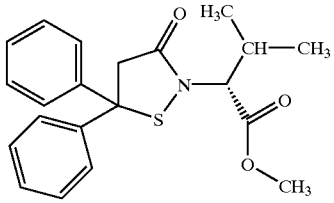
20
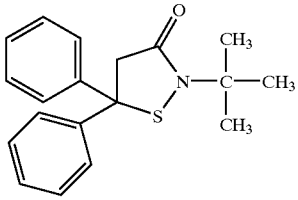
21
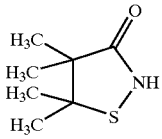

-continued
22
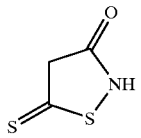
23
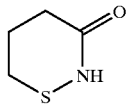
24
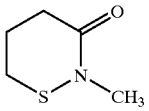
25
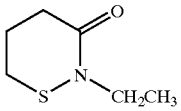
26
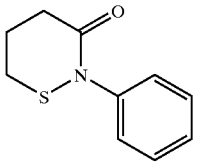
27
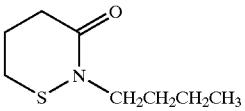
28
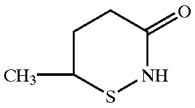
29
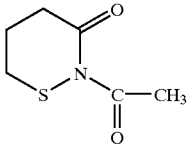
30
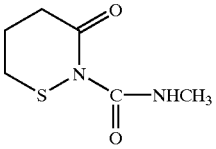
31
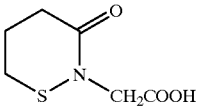
32
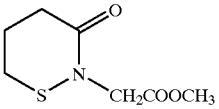
33
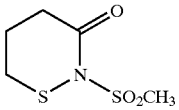
-continued
34
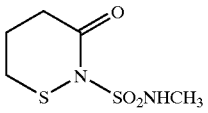
35
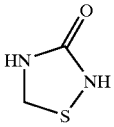
36
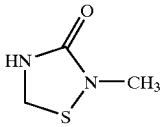
37
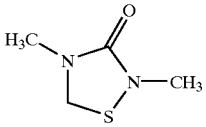
38
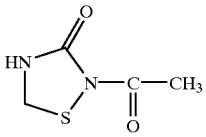
39
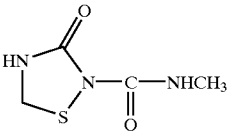
40
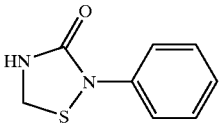
41
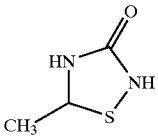
42
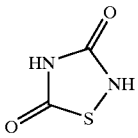
43
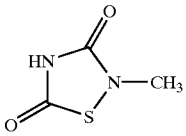
44
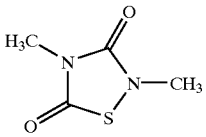

-continued
45
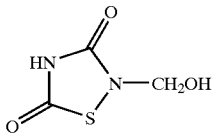
46
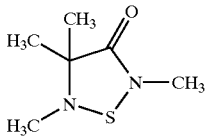
47
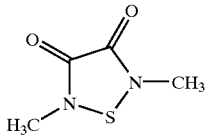
48
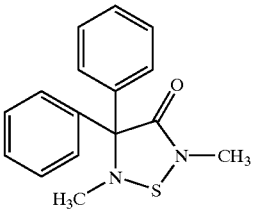
49
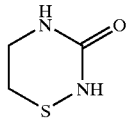
50
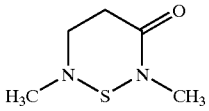
51
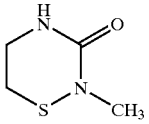
52
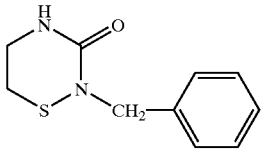
53
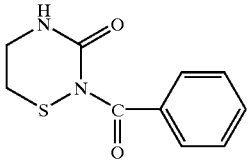
54
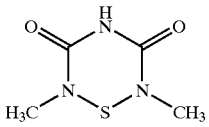
-continued
55
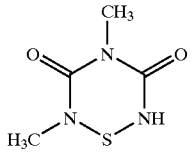
56
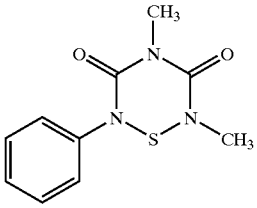
57
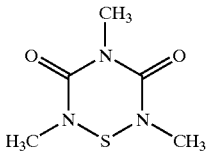
58
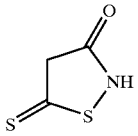
59
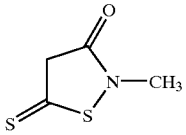
60
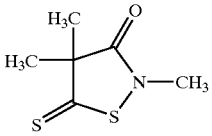
61
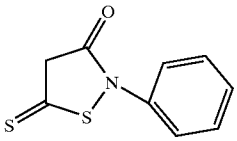
62
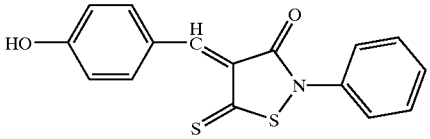
63
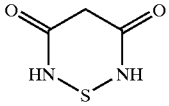
64
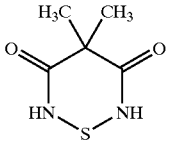

-continued
65
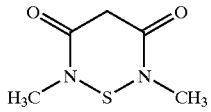
66
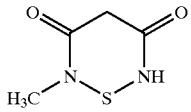
67
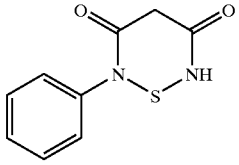
68
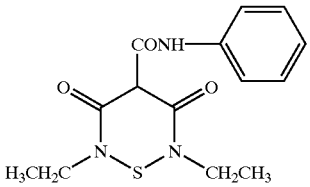
69
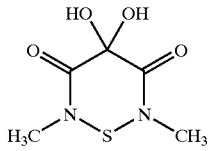
70
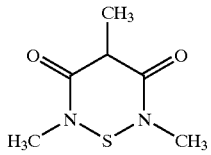
71
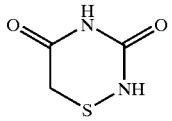
72
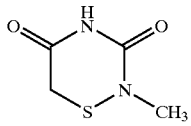
73
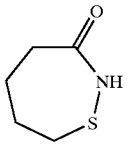
74
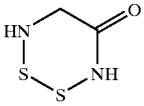
-continued
75
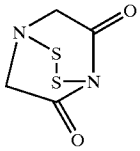
76
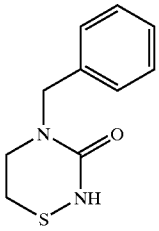
77
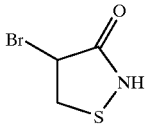
78
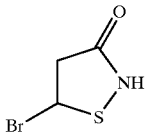
79
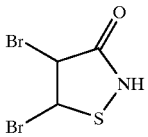
80
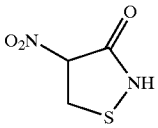
81
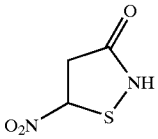
82
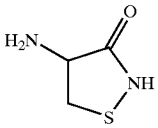
83
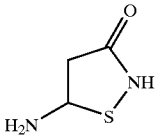
84
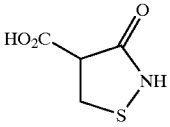

-continued
85
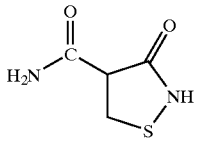
86
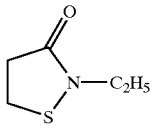
87
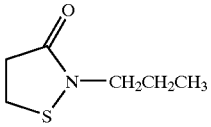
88
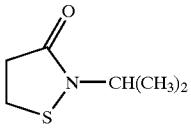
89
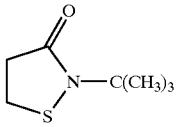
90
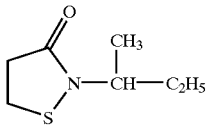
91
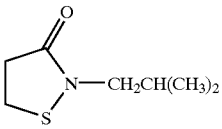
92
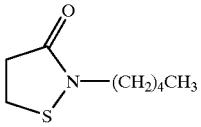
93
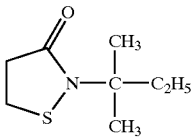
94
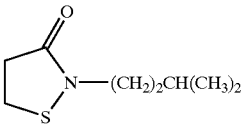
95
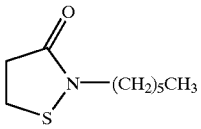
-continued
96
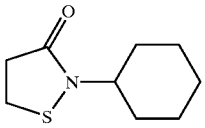
97
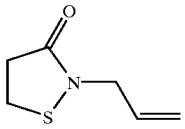
98
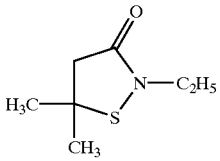
99
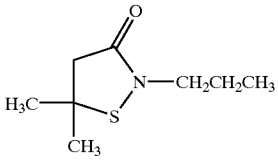
100
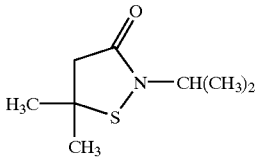
101
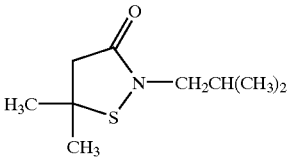
102
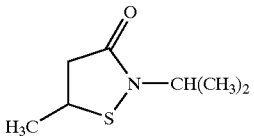
103
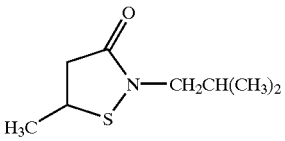
104
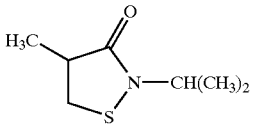
105
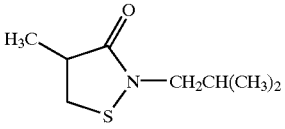

-continued

106

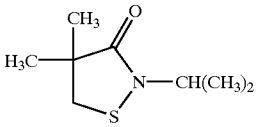

2,3,3a,6,7,7a-hexahydro-3-oxo-isothiazolo[4,5-c]pyridine-5(4H)-carboxylic acid methyl ester, 4,4,5,5-tetrachloro-2-[(4-methylphenyl)methyl]-3-isothiazolidinone, 2,3,3a,6,7,7a-hexahydro-7-methyl-3-oxo-isothiazolo[4,5-c]pyridine-5(4H)-carboxylic acid methyl ester, 4,5,5-trichloro-2-[(3,4-dichlorophenyl)methyl]-4-methyl-3-isothiazolidinone, N,2-bis(1,1-dimethylethyl)-3-oxo-4,5-diphenyl-5-isothiazolidinecarboxamide, 8-chloro-9-cyclopropyl-6-fluoro-7-[(1-methyl-3-pyrrolidinyl)oxy]-isothiazolo[5,4-b]quinoline-3,4(2H,9H)-dione monohydrochloride, 4,4,5,5-tetrachloro-2-(2-phenylethyl)-3-isothiazolidinone, 3-oxo-N,2,4,5-tetraphenyl-5-isothiazolidinecarboxamide, 2-[[bis(3,5-dioxo-2-isothiazolidinyl)phosphonyl]oxy]-6-benzothiazole sulfonic acid sodium salt, 4,5,5-trichloro-2-(4-chlorophenyl)-4-methyl-3-isothiazolidinone, α-(1-methylethylidene)-3-oxo-4-[(phenylacetyl)amino]-2-isothiazolidine acetic acid methyl ester, 5,5-dichloro-2-methyl-3-isothiazolidinone, 2'-[(4-methylphenyl)sulfonyl]-4',4'-diphenyl-spiro[9H-fluorene-9,5'-isothiazolidine]-3'-one, [S—(R*,S*)]-α-(1-methylethyl)-3-oxo-4-[[(phenylmethoxy)carbonyl]amino]-2-isothiazolidine acetic acid methyl ester, 2-(1,1-dimethylethyl)-4,4-diphenyl-3-isothiazolidinone, 4,5,5-trichloro-4-methyl-2-octyl-3-isothiazolidinone, 2-(chloromethyl)-3-isothiazolidinone, 5-bromo-2-(1,1-dimethylethyl)-4,4-diphenyl-3-isothiazolidinone, 2-butyl-4,5,5-trichloro-4-methyl-3-isothiazolidinone, 4-[(2,3-dihydroxyphenyl)methylene]-2-(2-furanylmethyl)-5-thioxo-3-isothiazolidinone, 5-chloro-2-(1,1-dimethylethyl)-4,4-diphenyl-3-isothiazolidinone, 4,5,5-trichloro-4-methyl-2-(1-methylpropyl)-3-isothiazolidinone, 4-[(2R,3S)-3-bromo-2-chloro-4-oxo-1-azetidinyl]-5,5-dimethyl-2-(phenylmethyl)-3-isothiazolidinone, 2,4,4-trimethyl-3-isothiazolidinone, 4,4,5,5-tetrachloro-2-methyl-3-isothiazolidinone, 4-[(2R)-3,3-dibromo-2-chloro-4-oxo-1-azetidinyl]-5,5-demethyl-2-(phenylmethyl)-3-isothiazolidinone, 5-chloro-2,4,4-trimethyl-3-isothiazolidinone, 4,4,5,5-tetrachloro-2-ethyl-3-isothiazolidinone, (4S)-4-[(2R)-2-chloro-4-oxo-1-azetidinyl]-5,5-dimethyl-2-(phenylmethyl)-3-isothiazolidinone, 2-octyl-3-isothiazolidinone, 2-butyl-4,4,5,5-tetrachloro-3-isothiazolidinone, 4-[(2R,3S)-2,3-dichloro-4-oxo-1-azetidinyl]-5,5-dimethyl-2-(phenylmethyl)-3-isothiazolidinone, 4,5-dichloro-5-(4-chlorobenzoyl)-2-(phenylmethyl)-3-isothiazolidinone hydro chloride, 4,4,5,5-tetrachloro-2-(phenylmethyl)-3-isothiazolidinone, (4S)-4-[(2R,3S)-3-bromo-2-chloro-4-oxo-1-azetidinyl]-2,5,5-trimethyl-,3-isothiazolidinone, 2-(2-propynyl)-3-isothiazolidinone, 4,4,5,5-tetrachloro-2-(1-phenylethyl)-3-isothiazolidinone, hexahydro-1,2-benzisothiazole-3(2H)-one, α-(1-methylethylidenyl)-5-(4-morpholinyl)-3-oxo-4-[(phenoxyacetyl)amino]-2-isothiazolidine acetic acid methyl ester, 2-(2-propenyl)-5-thioxo-3-isothiazolidinone, 4-chloro-2-cyclohexyl-3-isothiazolidinone, 4,4,5,5-tetrachloro-2-[(4-chlorophenyl)methyl]-3-isothiazolidinone, 2,3,3a,6,7,7a-hexahydro-3-oxo-isothiazolo[4,5-c]pyridine-5(4H)-carboxylic acid 1,1-dimethylethyl ester, 4-[(4,4,5,5-tetrachloro-3-oxo-2-isothiazolidinyl)methyl]-benzonitrile, 2,3,3a,6,7,7a-hexahydro-7-methyl-3-oxo-isothiazolo[4,5-c]pyridine-5(4H)-carboxylic acid 1,1-dimethylethyl ester, 4,4,5,5-tetrachloro-2-[(3,4-dimethylphenyl)methyl]-3-isothiazolidinone, N,2-dibutyl-3-oxo-4,5-diphenyl-5-isothiazolidinecarboxamide, 4-[[(1,1-dimethylethoxy)carbonyl]amino]-α-(1-methylethyl)-3-oxo-2-isothiazolidineacetic acid methyl ester, [2-(4-chlorophenyl)-5,5-dimethyl-3-oxo-4-isothiazolidinyl]-carbamic acid phenylmethyl ester, 3-oxo-4,5-diphenyl-N, 2-dipropyl-5-isothiazolidinecarboxamide, 5,5-dichloro-2-octyl-3-isothiazolidinone, [6R-(6α,7α)]-7-[[[(4-carboxy-3-oxo-5-isothiazolidinyl)thio]acetyl]amino]-7-methoxy-3-[[(1-methyl-1H-tetrazole-5-yl)thio]methyl]-8-oxo-5-thia-1-azabicyclo[4.2.0]octa-2-ene-2-carboxylic acid disodium salt, [S—(R*,S*)]-4-(1,3-dihydro-1,3-dioxo-2H-isoindole-2-yl)-α-(1-methylethyl)-3-oxo-2-isothiazolidineacetic acid methyl ester, 3-oxo-5-thioxo-4-isothiazolidinecarbonitrile ion(1-)sodium salt, 4,5,5-trichloro-2,4-dimethyl-3-isothiazolidinone, 2-(hydroxymethyl)-4-(phenylmethyl)-3-isothiazolidinone, 5-(benzoyloxy)-2-(1,1-dimethylethyl)-4,4-diphenyl-3-isothiazolidinone, 4,4,5,5-tetrachloro-2-octyl-3-isothiazolidinone, 3a,6a-dihydro-5-phenyl-6a-[5-phenyl-3-(2,4,6-trimethylphenyl)-1,4,2-dioxazole-5-yl]-3-(2,4,6-trimethylphenyl)-isothiazolo[4,5-d]isoxazole-4(5H)-one, trans-2,4,5-tris(1,1-dimethylethyl)-3-oxo-4,5-isothiazolidinecarbonitrile, 4,5,5-trichloro-4-methyl-2-(phenylmethyl)-3-isothiazolidinone, (4S)-4-[(2S)-2-chloro-4-oxo-1-azetidinyl]-5,5-dimethyl-2-(phenylmethyl)-3-isothiazolidinone, 5-chloro-2-methyl-3-isothiazolidinone, 4,5,5-trichloro-4-methyl-2-phenyl-3-isothiazolidinone, (4S)-4-[(2S,3S)-3-bromo-2-chloro-4-oxo-1-azetidinyl]-5,5-dimethyl-2-(phenylmethyl)-3-isothiazolidinone, (S)-α-(1-methylethyl)-3-oxo-4,4-diphenyl-2-isothiazolidineacetic acid methyl ester, 4,4,5,5-tetrachloro-2-hexyl-3-isothiazolidinone, (4S)-4-[(2S)-3,3-dibromo-2-chloro-4-oxo-1-azetidinyl]-5,5-dimethyl-2-(phenylmethyl)-3-isothiazolidinone, 5-chloro-α-(1-methylethyl)-3-oxo-4,4-diphenyl-2-isothiazolidineacetic acid methyl ester, 4,4,5,5-tetrachloro-2-cyclohexyl-3-isothiazolidinone, (4S)-4-[(2R,3R)-3-bromo-2-chloro-4-oxo-1-azetidinyl]-5,5-dimethyl-2-(phenylmethyl)-3-isothiazolidinone, 5-(4-chlorobenzoyl)-2-(phenylmethyl)-3-isothiazolidinone, 4,4,5,5-tetrachloro-2-decyl-3-isothiazolidinone, (4S)-4-[(2R,3S)-3-bromo-2-chloro-4-oxo-1-azetidinyl]-5,5-dimethyl-2-(1-phenyl-1H-pyrazole-5-yl)-3-isothiazolidinone, 2-[4-(1-pyrrolidinyl)-2-butynyl]-3-isothiazolidinone, 4,4,5,5-tetrachloro-2-phenyl-3-isothiazolidinone, 2-[(2R,3R)-2-chloro-1-[(4S)-5,5-dimethyl-3-oxo-2-(phenylmethyl)-4-isothiazolidinyl]-4-oxo-3-azetidinyl]-1H-isoindole-1,3(2H)-dione, 4-chloro-2-octyl-3-isothiazolidinone, 4,4,5,5-tetrachloro-2-(3-chlorophenyl)-3-isothiazolidinone, 4,5-dichloro-2-cyclohexyl-3-isothiazolidinone, 4,4,5,5-tetrachloro-2-(2-methylpropyl)-3-isothiazolidinone, 2-butyl-5,5-dimethyl-3-isothiazolidinone.

Next, the compounds of the general formula (II), which is one of the preferred embodiments of the compounds represented by the general formula (I), will be described in detail.

The compounds represented by the general formula (II) are isothiazolidin-3-one derivatives each having NH at the 2-position of the heterocyclic ring, and one of the characteristic features thereof being that at least one substituent is attached to the carbon atoms that forms the heterocyclic ring. It was found out that, for use especially as an additive to a silver halide photosensitive material, the total number of the carbon atoms of the compound is preferably 10 or less, and that when the total number of the carbon atoms is 11 or more the advantage in restraining fogging deteriorates.

In the general formula (II), the alkyl group represented by each of $R_{1c}$, $R_{2c}$, $R_{3c}$ and $R_{4c}$ is linear, branched or cyclic alkyl group, e.g., methyl, ethyl, n-propyl, isopropyl, cyclopropyl, isobutyl, tert-butyl, sec-butyl, cyclobutyl, n-amyl, isoamyl, tert-amyl, 1-ethylpropyl, 2-methylbutyl, cyclopentyl, n-hexyl, 3,3-dimethylbutyl, 1,3-dimethylbutyl, cyclohexyl, n-heptyl, 1-methylhexyl, cycloheptyl, 2-methylcyclohexyl, 3-methlcyclohexyl, 4-methylcylohexyl, endo-2-norbornyl and exo-2-norbornyl. Preferably, the alkyl group represented by each of $R_{1c}$, $R_{2c}$, $R_{3c}$ and $R_{4c}$ represents an alkyl group having 1–8 carbon atoms, more preferably methyl, ethyl, n-propyl, isopropyl, isobutyl, tert-butyl, sec-butyl, n-amyl and n-hexyl, especially preferably methyl.

Each of $R_{1c}$, $R_{2c}$, $R_{3c}$ and $R_{4c}$ represents a hydrogen atom, alkyl group, amino group, nitro group, carboxy group, acylamino group, carbamoyl group or halogen atom, and preferably a hydrogen atom or alkyl group, provided that not all of $R_{1c}$, $R_{2c}$, $R_{3c}$ and $R_{4c}$ do not become a hydrogen atom. It was found out that when at least one of $R_{1c}$, $R_{2c}$, $R_{3c}$ and $R_{4c}$ is not a hydrogen atom but substituent, yield of the compound being synthesized is enhanced.

The compounds represented by the general formulas (I) and (II) can be synthesized with the use of commercially available agents with reference to the following literature. The literature includes, for example, Justus Liebigs Ann. Chem., 679, 123–135 (1964), J. Chem. Soc. Perkin Trans. 1, 153–158 (1985), Angew. Chem., 76, 51 (1964), Pol. J. Chem., 55, 5, 1135–1141 (1981), Helv. Chim. Acta., 70, 2232–2244 (1987), Tetrahedron Lett., 5213–5216 (1973), J. Chem. Soc. Chem. Commun., 22, 1349–1350 (1983), Tetrahedron, 37, 2181–2190 (1981), J. Chem. Soc. Chem. Commun., 790–791 (1973), Chem. Ber., 98, 1965, 1005, U.S. Pat. Nos. 3,915,688, 4,007,175 and 3,817,993, Biochim. Biophys. Acta., 179, 1–6 (1969), Monatsh. Chem., GE, 100, 959–967 (1969), Agric. Biol. Chem., 51, 11, 3173–3176 (1987), Syn. Lett., EN, 3, 316–318 (1997), Indian J. Chem. Sect. B, EN, 21, 2, 150–152 (1982) and J. Indian Chem. Soc., EN, 57, 1123–1124 (1980).

Synthesis examples of the exemplified compounds of the invention will be set forth below.

Synthesis of Exemplified Compound 87

Isothiazolidine-3-one derivatives, in which 4- and 5-positions are substituted with hydrogen atoms, may be synthesized via 3,3'-dithiodipropionyl dichlorides as intermediates.

(Synthesis of 3,3'-dithiodipropionyl Dichloride)

To 315 g (1.5 mol) of 3,3'-dithiodipropionic acid and 700 g (5.87 mol) of thionyl chloride, 1 milliliter (hereinafter milliliter is also referred to as "mL") of pyridine was added and heated to reflex for 3 hr. The reaction liquid was concentrated under reduced pressure to remove excessive thionyl chloride, thereby 371 g (yield nearly 100%) of 3,3-dithiodipropylonyl dichloride was obtained.

(Synthesis of an Intermediate, N,N'-dipropyl-3,3'-dithiodipropionamide)

To 30 mL of acetonitrile, 2.47 g (0.01 mol) of 3,3'-dithiodipropyonyl dichloride was dissolved and 1.3 g (0.022 mol) of propylamine was slowly added drop wise under cooling with ice. The reaction mixture was stirred for 30 min at room temperature, and then 90 mL of water was added to filtrate the deposited crystal. The thus obtained crystal was washed with water and dried to obtain 2.10 g (yield 72%) of N,N'-dipropyl-3,3'-dithiodipropionamide. The structure thereof was confirmed with MS and elementary analysis.

(Synthesis of Exemplified Compound 87)

To 2.0 g (6.84 mmol) of N,N'-dipropyl-3,3'-dithiodipropionamide, 20 mL of dimethylacetamide was added and 2.77 g (20.5 mmol) of sulfuryl chloride was added. The reaction mixture was stirred for 4 hr at 30° C., then neutralized with an aqueous solution saturated with sodium bicarbonate, and extracted with ethyl acetate. The ethyl acetate layer was washed with brine, and dried with magnesium sulfate and concentrated the filtrate. The concentrate was purified with silica gel column chromatography to obtain 152 mg (yield 8%) of exemplified compound 87. The structure thereof was confirmed with MS and elementary analysis.

Calc.: C, 49.62; H, 7.63; N, 9.64 (%)

Found: C, 49.55; H, 7.49; N, 9.60 (%)

Synthesis of Exemplified Compound 88

(Synthesis of an Intermediate, N,N'-diisopropyl-3,3'-dithiodipropionamide)

To 30 mL of acetonitrile, 2.47 g (0.01 mol) of 3,3'-dithiodipropyonyl dichloride was dissolved and 1.48 g (0.025 mol) of isopropylamine was slowly added drop wise at room temperature. The reaction mixture was stirred for 3 hr at room temperature, then 90 mL of water was added to filtrate the deposited crystal. The thus obtained crystal was washed with water and dried to obtain 1.93 g (yield 66%) of N,N'-diisopropyl-3,3'-dithiodipropionamide. The structure thereof was confirmed with MS and elementary analysis.

(Synthesis of Exemplified Compound 88)

To 1.0 g (3.42 mmol) of N,N'-diisopropyl-3,3'-dithiodipropionamide, 10 mL of dimethylacetamide was added and 1.39 g (10.3 mmol) of sulfuryl chloride was added. The reaction mixture was stirred for 7 hr at room temperature, then, neutralized with an aqueous solution saturated with sodium bicarbonate, and extracted with ethyl acetate. The ethyl acetate layer was washed with brine, and dried with magnesium sulfate and concentrated the filtrate. The concentrate was purified with silica gel column chromatography to obtain 58 mg (yield 6%) of exemplified compound 88. The structure thereof was confirmed with MS and elementary analysis.

Calc.: C, 49.62; H, 7.63; N, 9.64 (%)

Found: C, 49.44; H, 7.55; N, 9.55 (%)

Synthesis of Exemplified Compound 91

(Synthesis of an Intermediate, N,N'-diisobutyl-3,3'-dithiodipropionamide)

To 2.47 g (0.01 mol) of 3,3'-dithiodipropyonyl dichloride, 30 mL of dimethylformamide was dissolved and 1.61 g (0.022 mol) of isobutylamine was slowly added drop wise at room temperature. The reaction mixture was stirred for 1 hr at room temperature, then, 120 mL of water was added to filtrate the deposited crystal. The thus obtained crystal was washed with water and dried to obtain 2.72 g (yield 85%) of N,N'-diisobutyl-3,3'-dithiodipropionamide. The structure thereof was confirmed with MS and elementary analysis.

(Synthesis of Exemplified Compound 91)

To 2.0 g (6.24 mmol) of N,N'-diisobutyl-3,3'-dithiodipropionamide, 20 mL of dimethylacetamide was added and 2.53 g (10.3 mmol) of sulfuryl chloride was added at room temperature. The reaction mixture was stirred for 4 hr at 35° C., then neutralized with an aqueous solution saturated with sodium bicarbonate, and extracted with ethyl acetate. The ethyl acetate layer was washed with brine, and dried with magnesium sulfate and concentrated the filtrate. The concentrate was purified with silica gel column chromatography to obtain 102 mg (yield 5%) of exemplified compound 91. The structure thereof was confirmed with MS and elementary analysis.

Calc.: C, 52.79; H, 8.23; N, 8.80 (%)

Found: C, 52.58; H, 8.15; N, 8.61 (%)

Synthesis of Exemplified Compound 99

(Synthesis of an Intermediate, N,N'-dipropyl-3,3'-dimethyl-3,3'-dithiodipropionamide)

To 30 mL of acetonitrile, 3.03 g (0.01 mol) of 3,3'-dimethyl-3,3'-dithiodipropyonyl dichloride prepared by the method described in Experimental of Justus Liebigs Ann. Chem., 679, 123–135 (1964) was dissolved and 1.77 g (0.03 mol) of propylamine was slowly added drop wise at room temperature. The reaction mixture was stirred for 5 hr at room temperature, then 120 mL of water was added to filtrate the deposited crystal. The thus obtained crystal was washed with water and dried to obtain 1.92 g (yield 55%) of N,N'-dipropyl-3,3'-dimethyl-3,3'-dithiodipropionamide. The structure thereof was confirmed with MS and elementary analysis.

(Synthesis of Exemplified Compound 99)

To 1.5 g (4.30 mmol) of N,N'-dipropyl-3,3'-dimethyl-3,3'-dithiodipropionamide, 15 mL of dimethylacetamide was added and 1.74 g (12.9 mmol) of sulfuryl chloride was added at room temperature. The reaction mixture was stirred for 10 hr at room temperature, then, neutralized with an aqueous solution saturated with sodium bicarbonate, and extracted with ethyl acetate. The ethyl acetate layer was washed with brine, and dried with magnesium sulfate and concentrated the filtrate. The concentrate was purified with silica gel column chromatography to obtain 48 mg (yield 3%) of exemplified compound 99. The structure thereof was confirmed with MS and elementary analysis.

Calc.: C, 55.45; H, 8.73; N, 8.08 (%)

Found: C, 55.22; H, 8.58; N, 8.01 (%)

Synthesis of Exemplified Compounds 1 and 4

(Synthesis of an Intermediate, 3,3'-dithiodipropionamide)

To 300 mL of acetonitrile 247 g (1.00 mol) of 3,3'-dithiodipropyonyl dichloride was dissolved and 300 g (4.4 mol) of 25% aqueous ammonia was slowly added drop wise under cooling with ice. The reaction mixture was stirred for 30 min at room temperature, then, 7,500 mL of water was added to filtrate the deposited crystal. The thus obtained crystal was washed with water and dried to obtain 140 g (yield 67%) of 3,3'-dithiodipropionamide. The structure thereof was confirmed with MS and elementary analysis.

(Synthesis 1 of Exemplified Compounds 1 and 4)

To 140 mL of water, 110 g (0.52 mol) of 3,3'-dithiodipropionamide was added and 912 g (6.76 mol) of sulfuryl chloride was added while vigorously stirring the mixture so that the reaction temperature became 35° C. or less. After stirring the mixture for 2 hr, the mixture was neutralized with an aqueous solution saturated with sodium bicarbonate, and extracted with ethyl acetate for ten times. The ethyl acetate layers were dried with magnesium sulfate and concentrated under reduced pressure. The concentrate was purified with silica gel column chromatography to obtain 3.2 mg (yield 3%) of exemplified compound 1. The structure thereof was confirmed with MNR, MS and elementary analysis.

As $C_3H_5NOS$=103.14

Calc.: C, 34.93; H, 4.89; N, 13.58; S, 31.09 (%)

Found: C, 35.07; H, 5.03; N, 13.88; S, 30.66 (%)

In addition, 0.1 g (yield <0.1%) of exemplified compound 4 was obtained simultaneously. The structure thereof was confirmed with MS.

(Synthesis 2 of Exemplified Compound 1)

To 200 mL of dichloromethane, 15.8 g (0.076 mmol) of 3,3'-dithiodipropionamide and 12 g (0.15 mol) of pyridine were added and a solution containing 12 g (0.075 mol) of bromide in 100 mL of dichloromethane was added drop wise while stirring under nitrogen atmosphere at −78° C. 15 min later, the temperature was raised to room temperature, concentrated under reduced pressure, and purified with silica gel column chromatography. 7.4 g (yield 47%) of exemplified compound 1 was obtained. The structure thereof was confirmed by HPLC using the sample of exemplified compound 1 obtained in the above synthesis 1 as a standard.

Synthesis of Exemplified Compound 2

(Synthesis of an Intermediate, 2,2'-dimethyl-3,3'-dithiodipropyonyl Dichloride)

To 357 g (1.5 mol) of 2,2'-dimethyl-3,3'-dithiodipropionic acid and 700 g (5.87 mol) of thionyl chloride, 1 mL of pyridine was added and heated to reflex for 3 hr. Excessive thionyl chloride was removed by concentration of the reaction liquid under reduced pressure to obtain 400 g (yield 97%) of 2,2'-dimethyl-3,3'-dithiodipropyonyl dichloride.

(Synthesis of an Intermediate, 2,2'-dimethyl-3,3'-dithiodipropionamide)

To 3,000 mL of acetonitrile, 275 g (1.00 mol) of 2,2'-dimethyl-3,3'-dithiodipropionyl dichloride was dissolved, and 300 g (4.40 mol) of 25% aqueous ammonia was slowly added drop wise while cooling with ice. The reaction mixture was stirred for 30 min at room temperature and filtrated the precipitated crystal by adding 7,100 mL of water. The thus obtained crystal was washed with water and dried to obtain 184 g (yield 78%) of 2,2'-dimethyl-3,3'-dithiodipropionamide. The structure thereof was confirmed with NMR.

(Synthesis 1 of Exemplified Compound 2)

To 150 mL of water, 130 g (0.55 mol) of 2,2'-dimethyl-3,3'-dithiodipropionamide was added and 965 g (7.15 mmol) of sulfuryl chloride was added while vigorously stirring so that the temperature thereof became 35° C. or less. The mixture was stirred for 2 more hr, then, neutralized with an aqueous solution saturated with sodium bicarbonate, concentrated under reduced pressure, and extracted with ethyl acetate for 7 times. The ethyl acetate layers were dried with magnesium sulfate, concentrated under reduced pressure, and purified with silica gel column chromatography to obtain 5.1 g (yield 4%) of exemplified compound 2. The structure thereof was confirmed with NMR and elementary analysis.

As $C_4H_7NOS$=117.17

Calc.: C, 41.00; H, 6.02; N, 11.95; S, 27.37 (%)

Found: C, 40.77; H, 6.31; N, 11.72; S, 27.03 (%)

(Synthesis 2 of Exemplified Compound 2)

To 200 mL of dichloromethane, 18.0 g (0.076 mol) of 2,2'-dimethyl-3,3'-dithiodipropionamide and 12 g (0.15 mol) of pyridine were added and a solution containing 12 g (0.075 mol) of bromide in 100 mL of dichloromethane was added drop wise while stirring under nitrogen atmosphere at −78° C. 15 min later, the temperature was raised to room temperature, concentrated under reduced pressure, and purified with silica gel column chromatography. 12.6 g (yield 71%) of exemplified compound 2 was obtained. The structure thereof was confirmed with HPLC using the sample of exemplified compound 2 obtained in the above synthesis 1 as a standard.

Synthesis of Exemplified Compound 3

(Synthesis of an Intermediate, 3,3'-dimethyl-3,3'-dithiodipropyonyl Dichloride)

To 357 g (1.5 mol) of 3,3'-dimethyl-3,3'-dithiopropionic acid and 700 g (5.87 mol) of thionyl chloride, 1 mL of pyridine was added and heated to reflex for 3 hr. Excessive thionyl chloride was removed by concentration of the reaction liquid under reduced pressure to obtain 405 g (yield 98%) of 3,3'-dimethyl-3,3'-dithiodipropionyl chloride.

(Synthesis of an Intermediate, 3,3'-dimethyl-3,3'-dithiodipropionamide)

To 3,000 mL of acetonitrile, 275 g (1.00 mol) of 3,3'-dimethyl-3,3'-dithiodipropyonyl dichloride was dissolved and 300 g (4.40 mol) of 25% aqueous ammonia was slowly added drop wise while cooling with ice. The reaction mixture was stirred for 30 min at room temperature, then, 7,200 mL of water was added to filtrate the deposited crystal. The thus obtained crystal was washed with water and dried to obtain 189 g (yield 81%) of 3,3'-dimethyl-3,3'-dithiodipropionamide. The structure thereof was confirmed with NMR.

(Synthesis 1 of Exemplified Compound 3)

To 150 mL of water, 130 g (0.55 mmol) of 3,3'-dimethyl-3,3'-dithiodipropionamide was added and 965 g (7.15 mmol) of sulfuryl chloride was added while vigorously stirring so that the temperature thereof became 35° C. or less. The reaction mixture was stirred for 2 more hr, then neutralized with an aqueous solution saturated with sodium bicarbonate, concentrated under reduced pressure and extracted with ethyl acetate for 7 times. The ethyl acetate layers were dried with magnesium sulfate and concentrated under reduced pressure, and purified with silica gel column chromatography to obtain 5.3 mg (yield 4%) of exemplified compound 3. The structure thereof was confirmed with NMR and elementary analysis.

As $C_4H_7NOS$=117.17

Calc.: C, 41.00; H, 6.02; N, 11.95; S, 27.37 (%)

Found: C, 41.25; H, 5.97; N, 12.01; S, 27.54 (%)

(Synthesis 2 of Exemplified Compound 3)

To 200 mL of dichloromethane, 18.0 g (0.076 mol) of 3,3'-dimethyl-3,3'-dithiodipropionamide and 12 g (0.15 mol) of pyridine were added and a solution containing 12 g (0.075 mol) of bromide in 100 mL of dichloromethane was added drop wise while stirring under nitrogen atmosphere at −78° C. 15 min later, the temperature was raised to room temperature, concentrated under reduced pressure, and purified with silica gel column chromatography. 13.4 g (yield 75%) of exemplified compound 3 was obtained. The structure thereof was confirmed by HPLC using the sample of exemplified compound 3 in the above synthesis 1 as a standard.

Synthesis of Exemplified Compound 7

(Synthesis of an Intermediate, 3,3,3',3'-tetramethyl-3,3'-dithiodipropyonyl Dichloride)

To 40 g (0.15 mol) of 3,3,3',3'-tetramethyl-3,3'-dithiodipropionic acid and 70 g (0.59 mol) of thionyl chloride, 1 mL of pyridine was added and heated to reflex for 3 hr. Excessive thionyl chloride was removed by concentration of the reaction liquid under reduced pressure to obtain 45 g (yield 99%) of 3,3,3'3'-tetramethyl-3,3'-dithiodipropionyl chloride.

(Synthesis of an Intermediate, 3,3,3',3'-tetramethyl-3,3'-dithiodipropionamide)

To 300 mL of acetonitrile, 30.3 g (0.10 mol) of 3,3,3'3'-tetramethyl-3,3'-dithiodipropyonyl dichloride was dissolved and 30 g (0.440 mol) of 25% aqueous ammonia was slowly added drop wise while cooling with ice. The reaction mixture was stirred for 30 min at room temperature, then, 7,000 mL of water was added to filtrate the deposited crystal. The thus obtained crystal was washed with water and dried to obtain 21.2 g (yield 80%) of 3,3,3'3'-tetramethyl-3,3'-dithiodipropionamide. The structure thereof was confirmed with NMR.

(Synthesis 1 of Exemplified Compound 7)

To 200 mL of dichloromethane, 20 g (0.076 mmol) of 3,3,3',3'-tetramethyl-3,3'-dithiodipropionamide and 12 g (0.15 mol) of pyridine were added and a solution containing 12 g (0.075 mol) of bromide in 100 mL of dichloromethane was added drop wise while stirring under nitrogen atmosphere at −78° C. 15 min later, the temperature was raised to room temperature, concentrated under reduced pressure, and purified with silica gel column chromatography. 13.9 g (yield 70%) of exemplified compound 7 was obtained. The structure thereof was confirmed with NMR and MS.

The compounds of the general formula (I) can be incorporated in not only silver halide emulsion layers but also other layers (nonsensitive layers such as a subbing layer, interlayer and protective layer) of the silver halide photosensitive material. When it is intended to incorporate the compounds of the general formula (I) in silver halide emulsion layers, the compounds may be directly dispersed in the emulsions of any appropriate layers. Alternatively, the compounds may be dissolved in a solvent or mixed solvent comprising water, methanol, etc. and added to the emulsions. With respect to the timing of addition to emulsions, the compounds may be added at any stage during the emulsion preparation through just prior to the emulsion coating (e.g., during emulsion grain formation, at the completion of emulsion grain formation, before or after the addition of a spectral sensitizer, before or after chemical sensitization processing, during preparation of emulsion coating liquid and etc.). It is preferred that the addition of the compounds of the general formula (I) to silver halide emulsion layers be accomplished by dissolving them in water and adding the solution at the time of emulsion preparation. The addition amount thereof is preferably in the range of $1\times10^{-5}$ to 1 mol, more preferably $1\times10^{-3}$ to $5\times10^{-1}$ mol, per mol of silver halides.

Two or more kinds of the compounds of the general formula (I) may be added in combination. In that instance, the compounds may be incorporated in the same layer or different layers.

As a silver halide emulsion use can be made of silver chloride, silver iodochloride, silver chlorobromide, silver bromide, silver iodobromide, silver chloroiodobromide and the like. From the viewpoint of rapid processability, for use in color paper, it is preferred to employ an emulsion of silver chloride, silver chlorobromide, silver chloroiodide or silver chlorobromoiodide whose silver chloride content is 95 mol % or more and whose silver iodide content is 1.0 mol % or less. It is more preferred to employ an emulsion of silver chloroiodide or silver chlorobromoiodide whose silver chloride content is 97 mol % or more and whose silver iodide content is 0.5 mol % or less. Among these silver halide emulsions, the grains each having, in shell portions thereof, a silver-iodide-containing phase wherein the silver iodide content is in the range of 0.05 to 0.75 mol %, more preferably 0.1 to 0.40 mol %, based on the total silver mole and/or a silver-bromide-containing phase wherein the silver bromide content is in the range of 0.05 to 4 mol %, more preferably 0.5 to 3 mol %, based on the total silver mole are preferred from the viewpoint that a high speed can be attained and that the obtained lightsensitive material is excellent in high illumination intensity exposure adaptability.

When it is intended to use the lightsensitive material as a color negative, it is preferred to employ silver iodobromide, silver iodobromochloride, silver bromochloride or silver iodochloride, and more preferred to employ silver iodobromide or silver iodochlorobromide. In the use of silver iodochloride, silver chloride may be contained therein, however, the silver chloride content is preferably 8 mol % or less, and more preferably 3 mol % or less, or 0 mol %. With respect to the silver iodide content, because the variation coefficient of distribution of grain size is preferably 25% or less, it is preferred that the silver iodide content be 20 mol % or less. Lowering of the silver iodide content facilitates reducing the variation coefficient of distribution of grain size of tabular grain emulsion. In particular, it is preferred that the variation coefficient of distribution of grain size of tabular grain emulsion be 20% or less, and that the silver iodide content be 10 mol % or less. Regardless of the silver iodide content, the variation coefficient of intergranular distribution of silver iodide content is preferably 20% or less, more preferably 10% or less. With respect to the silver iodide distribution of emulsion, it is preferred that there exist an intragranular structure. In that case, the silver iodide distribution can have a double structure, a treble structure, a quadruple structure or a structure of higher order.

The silver halide grains of each silver halide emulsion for use in the present invention can be those having regular crystals such as cubic, octahedral or tetradecahedral crystals, those having irregular crystals such as spherical or platy crystals, those having crystal defects such as twin planes, or composite forms thereof. It is preferred that the silver halide grains be cubic or tetradecahedral crystal grains having substantially {100} faces (these may have faces of higher order resulting from rounding of grain apexes), or octahedral crystal grains, or those wherein 50% or more of the total projected area is occupied by tabular grains having an aspect ratio of 2 or more and having {100} faces or {111} faces as main planes. With respect to the tabular grains, 50% or more of the total projected area is more preferably occupied by tabular grains having 8 or more aspect ratio, most preferably tabular grains having 12 or more aspect ratio. Although there is no particular upper limit, the aspect ratio is generally 200 or less, preferably 100 or less. The aspect ratio refers to the quotient of the diameter of a circle corresponding to projected area divided by grain thickness. In the present invention, cubic grains or tabular grains having {100} faces or {111} faces as main planes are preferably employed.

It is preferred that 75% or less of all the side faces connecting the opposite {111} main planes of the above tabular grains are constructed with {111} faces. The expression "75% or less of all the side faces are constructed with {111} faces" used herein means that, with respect to each tabular grain, crystallographic faces other than the {111} faces (e.g., {110} faces and faces of higher index) are present at a ratio higher than 25% based on all the side faces. In the present invention, the advantage thereof is remarkable when 70% or less of all the side faces are composed with {111} faces. Causing 75% or less of all the side faces of tabular grains to be composed with {111} faces can be accomplished by known methods.

As the silver halide solvent which can be used in the present invention, there can be mentioned, for example, organic thioethers (a) described in U.S. Pat. Nos. 3,271,157, 3,531,289 and 3,574,628 and JP-A's-54-1019 and 54-158917, thiourea derivatives (b) described in JP-A's-53-82408, 55-77737 and 55-2982, silver halide solvents having a thiocarbonyl group interposed between an oxygen or sulfur atom and a nitrogen atom (c) described in JP-A-53-144319, imidazoles (d) described in JP-A-54-100717, ammonia (e) and thiocyanates (f). Especially preferred solvents are thiocyanates, ammonia and tetramethylthiourea. Although the amount of added solvent depends on the type thereof, in the case of, for example, a thiocyanate, the preferred amount thereof is in the range of $1\times10^{-4}$ to $1\times10^{-2}$ mol per mol of silver halides.

With respect to the method of changing the face index for the side faces of tabular grain emulsion, reference can be made to, for example, EP 515894A1. Further, use can be made of polyalkylene oxide compounds described in, for example, U.S. Pat. No. 5,252,453. As an effective method, there can be mentioned the use of face index improvers described in, for example, U.S. Pat. Nos. 4,680,254, 4,680,255, 4,680,256 and 4,684,607. Conventional photographic spectral sensitizing dyes can also be used as similar face index improvers.

In the present invention, the emulsions can be prepared by various methods as long as the above requirements are satisfied. Generally, the preparation of tabular grain emulsions comprises three fundamental steps, namely, nucleation, ripening and growth. In the step of nucleation of tabular grain emulsions for use in the present invention, it is extremely effective to employ a gelatin of low methionine content as described in U.S. Pat. Nos. 4,713,320 and 4,942,120; to carry out nucleation at high pBr as described in U.S. Pat. No. 4,914,014; and to carry out nucleation within a short period of time as described in JP-A-2-222940. In the step of ripening the tabular grain emulsion for use in the present invention, it is occasionally effective to conduct ripening in the presence of a low-concentration base as described in U.S. Pat. No. 5,254,453, and to carry out ripening at high pH as described in U.S. Pat. No. 5,013,641. In the step of growing the tabular grain emulsion for use in the present invention, it is especially effective to carry out growth at low temperatures as described in U.S. Pat. No. 5,248,587, and to employ silver iodide fine grains as described in U.S. Pat. Nos. 4,672,027 and 4,693,964. It is also preferably employed to effect growth by conducting ripening with the addition of an emulsion of silver bromide, silver iodobromide or silver chloroiodobromide fine grains. This fine grain emulsion can also be supplied by means of the agitating device described in JP-A-10-43570.

When the emulsion of the present invention is an emulsion of high silver chloride content containing silver iodide and/or silver bromide, the introduction of iodide ions and/or bromide ions may be carried out by adding a solution of iodide and/or bromide salt alone, or by adding a solution of iodide and/or bromide salt in combination with the addition of a silver salt solution and a solution of high chloride salt. In the latter instance, a solution of iodide and/or bromide salt and a solution of high chloride salt may be added separately from each other, or the addition may be conducted in the form of a solution of a mixture of an iodide and/or bromide salt and a high chloride salt. The iodide and/or bromide salt is added in the form of a soluble salt such as an alkali or alkaline earth iodide salt. Alternatively, the introduction of iodide can be accomplished by cleaving iodide ions from organic molecules as described in U.S. Pat. No. 5,389,508. Still alternatively, fine silver iodide grains can be used as another iodide ion source. When the emulsion of the present invention contains silver iodide and silver bromide, it is preferred that, upon an analysis by the etching/TOF-SIMS method, the iodide and bromide ions have the maximum concentration at grain surfaces, with the concentration of iodide and bromide ions attenuated inward.

When the emulsion of the present invention is an emulsion having a silver bromide localized phase, it is preferred that each of the grains contained in the emulsion is provided with a silver bromide enriched phase having a silver bromide content exceeding at least 10 mol %. Herein the term "phase" includes both layered and non-layered regions. It is especially preferred that silver bromide localized phases having a silver bromide content exceeding at least 10 mol % be created on grain surfaces by epitaxial growth. The silver bromide localized phases preferably have a silver bromide content of 10 to 60 mol %, and are preferably constituted of silver amounting to 0.1 to 20 mol % based on the total quantity of silver constituting silver halide grains. The silver bromide localized phase more preferably have a silver bromide content of 20 to 50 mol %, and are more preferably constituted of silver amounting to 0.5 to 7 mol % based on the total quantity of silver constituting silver halide grains. The silver bromide localized phases most preferably have a silver bromide content of 30 to 40 mol %, and are most preferably constituted of silver amounting to 1 to 5 mol % based on the total quantity of silver constituting silver halide grains. The silver bromide content of the silver bromide enriched phase can be measured by known analytical methods. Although silver halide grains having silver iodide enriched phases are also preferable, the silver halide grains having silver bromide enriched phases are preferred thereto. With respect to the arrangement of silver bromide enriched phases, it is requisite that the silver bromide enriched phases exist in the vicinity of grain surface from the viewpoint of pressure characteristics, dependence on processing solution composition, etc. The vicinity of grain surface herein refers to the locality lying within ⅕ of grain size (equivalent sphere diameter), as measured from the outermost surface, of silver halide grains employed. It is preferred that the vicinity refer to the locality lying within 1/10 of grain size (equivalent sphere diameter), as measured from the outermost surface, of silver halide grains employed. The most preferred arrangement of silver bromide enriched phases can be realized by epitaxial growth of localized phases having a silver bromide content exceeding at least 10 mol % at corner portions of cubic or tetradecahedral silver chloride grains.

The silver bromide localized phases preferably contain complex ions of metals of Group VIII, such as iridium (III) chloride, iridium (III) bromide, iridium (IV) chloride, sodium hexachloroiridate (III), potassium hexachloroiridate (IV), a hexammineiridium (IV) salt, a trioxalatoiridium (III) salt and a trioxalatoiridium (IV) salt. The addition amount of these compounds, although widely varied depending on the intended use, is preferably in the range of 10–9 to 10–2 mol per mol of silver halides.

When the emulsion for use in the present invention is a silver iodo(chloro)bromide emulsion for use in a color negative, the silver iodide content at grain surfaces is preferably 10 mol % or less, more preferably 5 mol % or less. The tabular grain emulsion having a silver iodide content at grain surfaces of 5 mol % or less for use in the present invention refers to an emulsion whose grains exhibit a silver iodide content of 5 mol % or less when analyzed by XPS (X-ray Photoelectron Spectroscopy). In the present invention, it is preferred that the silver iodide content of inner phases be higher than that at the surface. The silver iodide content of inner phases is preferably higher than that at the surface by 5 mol % or more, more preferably by 7 mol % or more.

With respect to the structure of the emulsion of the present invention, for example, grains of triple structure consisting of silver bromide/silver iodobromide/silver bromide and grains of higher-order structures are preferred. The interstructural boundary of silver iodide content may be definite, or may be one which is changed continuously and gently. Generally, in the measurement of silver iodide content using the powder X-ray diffractometry, there would be no exhibition of two clear peaks having different silver iodide contents, and an exhibited X-ray diffraction profile would be such that there occurs a down slope toward high silver iodide contents.

In the present invention, metal ions can be incorporated in the interior and/or surface of silver halide grains by adding transition metal ions in the step of forming and/or growing silver halide grains. Transition metal ions are preferably used as the metal ions. Among them, ions of iron, ruthenium, iridium, osmium, lead, cadmium and zinc are preferred. Further, these metal ions are more preferably used in the form of a six-coordinate octahedral complex together with ligands. When an inorganic compound is used as a ligand, it is preferred to employ any of cyanide ion, halide ion, thiocyan, hydroxide ion, peroxide ion, azide ion, nitrite ion, water, ammonia, nitrosyl ion and thionitrosyl ion. These are preferably used in the form of being coordinated with any of the above metal ions such as iron, ruthenium, iridium, osmium, lead, cadmium and zinc ions. It is also preferred to use different types of ligands in a single complex molecule. Moreover, an organic compound can be used as a ligand. As a preferred organic compound, there can be mentioned a chain compound whose main chain has 5 or less carbon atoms and/or a 5- or 6-membered heterocyclic compound. As a more preferred organic compound, there can be mentioned a compound having in its molecule a nitrogen atom, a phosphorus atom, an oxygen atom or a sulfur atom as an atom capable of coordination with a metal. Most preferred organic compounds include furan, thiophene, oxazole, isoxazole, thiazole, isothiazole, imidazole, pyrazole, triazole, furazane, pyran, pyridine, pyridazine, pyrimidine and pyrazine. Furthermore, compounds comprising these compounds as fundamental skeletons wherein substituents have been introduced are also preferably used.

As a preferred combination of a metal ion and a ligand, there can be mentioned a combination of an iron ion or ruthenium ion and a cyanide ion. With respect to compounds of such a combination, it is preferred that cyanide ions occupy over half of the coordination number of iron or ruthenium as a central metal. The rest of coordination sites are preferably occupied by thiocyan, ammonia, water, nitrosyl ion, dimethyl sulfoxide, pyridine, pyrazine or 4,4'-bipyridine. It is most preferred that all the six coordination sites of central metal be occupied by cyanide ions, thereby forming a hexacyanoiron complex or a hexacyanoruthenium complex. These complexes containing cyanide ions as ligands are preferably added in an amount of $1\times10^{-8}$ to $1\times10^{-2}$ mol, most preferably $1\times10^{-6}$ to $5\times10^{-4}$ mol, per mol of silver during the grain formation. When iridium is used as a central metal, fluoride ions, chloride ions, bromide ions and iodide ions are preferably used as the ligands. Among these, using chloride ions or bromide ions is more preferred. Preferred examples of iridium complexes include $[IrCl_6]^{3-}$, $[IrCl_6]^{2-}$, $[IrCl_5(H_2O)]2-$, $[IrCl_5(H_2O)]^-$, $[IrCl_4(H_2O)_2]^-$, $[IrCl_4(H_2O)_2]^0$, $[IrCl_3(H_2O)_3]^0$, $[IrCl_3(H_2O)_3]^+$, $[IrBr_6]^{3-}$, $[IrBr_6]^{2-}$, $[IrBr_5(H_2O)]^{2-}$, $[IrBr_5(H_2O)]^-$, $[IrBr_4(H_2O)_2]$, $[IrBr_4(H_2O)_2]^0$, $[IrBr_3(H_2O)_3]^0$ and $[IrBr_3(H_2O)_3]^+$. These iridium complexes are preferably added in an amount of $1\times10^{-10}$ to $1\times10^{-3}$ mol, most preferably $1\times10^{-8}$ to $1\times10^{-5}$ mol, per mol of silver during the grain formation. When ruthenium and osmium are used as the central metals, it is preferred to jointly use nitrosyl ions, thionitrosyl ions, or water molecules and chloride ions as the ligands. Forming a pentachloronitrosyl complex, a pentachlorothionitrosyl complex or a pentachloroaqua complex is more preferred. Forming a hexachloro complex is also preferred. These complexes are preferably added in an amount of $1\times10^{-10}$ to $1\times10^{-6}$ mol, more preferably $1\times10^{-9}$ to $1\times10^{-6}$ mol, per mol of silver during the grain formation.

In the present invention, the above complexes are preferably incorporated in silver halide grains by directly adding them to a reaction solution during the formation of silver halide grains, or by first adding them to an aqueous solution of halide for forming silver halide grains or other solutions and then adding the mixture to a grain forming reaction solution. It is also preferred to combine these means so as to accomplish the incorporation into silver halide grains.

In the incorporation of these complexes into silver halide grains, although it is appropriate to cause them to be homogeneously present in the interior of grains, it is preferred to, as disclosed in JP-A's-4-208936, 2-125245 and 3-188437, cause the complexes to be present only in grain surface layers, or cause the complexes to be present only in the interior of grains with the attaching of layers not containing any complex to grain surfaces. Further, it is also preferred to carry out physical ripening with the use of fine grains having complexes incorporated therein to thereby modify grain surface phases as disclosed in U.S. Pat. Nos. 5,252,451 and 5,256,530. Still further, these means can be used in combination. Different types of complexes may be incorporated in each silver halide grain. There is no particular limitation with respect to the halogen composition at the position where the above complexes are incorporated. The complexes can preferably be incorporated in any of a silver chloride layer, a silver chlorobromide layer, a silver bromide layer, a silver iodochloride layer and a silver iodobromide layer.

The average equivalent circle diameter of tabular silver halide grains contained in the emulsion of the present invention is preferably in the range of 0.1 to 10.0 $\mu$m, more preferably 0.1 to 5.0 $\mu$m. The equivalent circle diameter refers to the diameter of a circle having an area equal to the projected area of parallel main planes of grains. The projected area of grains can be determined by measuring an area on an electron micrograph and effecting a correction of photographing magnification. In the use of nontabular grains, the average equivalent sphere diameter thereof is preferably in the range of 0.1 to 5.0 $\mu$m, more preferably 0.6 to 2.0 $\mu$m. These ranges ensure the most excellent speed/graininess ratio relationship for the photographic emulsion. With respect to tabular grains, the average thickness thereof is preferably in the range of 0.05 to 1.0 $\mu$m. Herein, the average equivalent circle diameter refers to the average of equivalent circle diameter values of 1000 or more grains arbitrarily harvested from a homogeneous emulsion. This applies to the average thickness as well. With respect to the silver halide grains contained in the emulsion of the present invention, although the distribution of grain size thereof may be monodisperse or polydisperse, monodispersity is preferred. With respect to the grain size distribution, grains whose variation coefficient (quotient of standard deviation of grain size distribution divided by average grain size) is 20% or less, preferably 15% or less, and more preferably 10% or less, known as monodisperse grains are preferred. For the purpose of obtaining wide latitude, it is preferably performed to use a blend of monodisperse emulsions in a single layer, or to carry out a multilayer coating thereof.

In the emulsions used in the present invention, it is preferable to introduce positive hole-capturing silver nuclei by intentional reduction sensitization. "Intentional reduction sensitization" means reduction sensitization performed by adding a reduction sensitizer. A positive hole-capturing silver nucleus is a small silver nucleus having a little development activity. This silver nucleus can prevent recombination loss in the exposure step and increase the sensitivity. Positive hole-capturing silver nuclei can be introduced by performing intentional reduction sensitization during the formation of silver halide emulsion grains.

As the reduction sensitizer, stannous chloride, ascorbic acid and its derivatives, amines and polyamines, hydrazine derivatives, thiourea dioxide, silane compounds, borane compounds, dihydroxybenzenes and their derivatives, and hydroxyamines and their derivatives are effective. In reduction sensitization performed for the emulsion of the present invention, it is possible to selectively use these reduction sensitizers or to use two or more types of compounds together. Preferred reduction sensitizers in the present invention are thiourea dioxide, hydroxyamines and their derivatives, and dihydroxybenzenes and their derivatives. The dihydroxybenzenes and their derivatives that are preferable as a reduction sensitizer are compounds represented by general formula (V-1) and/or compounds represented by general formula (V-2) below:

(V-1)

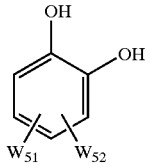

(V-2)

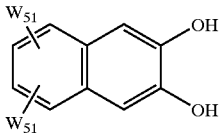

In formulas (V-1) and (V-2), each of $W_{51}$ and $W_{52}$ independently represents a sulfo group or hydrogen atom. However, at least one of $W_{51}$ and $W_{52}$ represents a sulfo group. A sulfo group is generally an alkali metal salt such as sodium or potassium or a water-soluble salt such as ammonium salt. Specifically, preferable examples are disodium 4,5-dihydroxybenzene-1,3-disulfonate, 4-sulfocatechol ammonium salt, 2,3-dihydroxy-7-sulfonaphthalene sodium salt, and 2,3-dihydroxy-6,7-disulfonaphthalene potassium salt. Most preferable compound is disodium 4,5-dihydroxybenzene-1,3-disulfonate. A preferred addition amount can vary in accordance with, e.g., the temperature, pBr, and pH of the system to which the compound is added, the type and concentration of a protective colloid agent such as gelatin, and the presence/absence, type, and concentration of a silver halide solvent. Generally, the addition amount is preferably 0.0005 to 0.5 mol, and more preferably, 0.003 to 0.05 mol per mol of a silver halide.

The hydroxyamines and their derivatives that are preferable for a reduction sensitizer is represented by general formula (A) below:

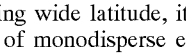

(A)

In the formula (A), Ra represents an alkyl group, alkenyl group, aryl group, acyl group, carbamoyl group, sulfamoyl group, alkoxycarbonyl group, aryloxycarbonyl group, alkylsulfonyl group, arylsulfonyl group or hetero cyclic group; and Rb represents a hydrogen atom or one of the groups represented by Ra.

Ra may be further substituted by at least one substituent. Examples of the substituent are an alkyl group, alkenyl group, aryl group, hetero cyclic group, hydroxy group, alkoxy group, aryloxy group, alkylthio group, arylthio group, amino group, acylamino group, sulfonamide group, alkylamino group, arylamino group, carbamoyl group, sulfamoyl group, sulfo group, carboxyl group, halogen atom, cyano group, nitro group, sulfonyl group, acyl group, alkoxycarbonyl group, aryloxy carbonyl group, acyloxy group, hydroxylamine group. Ra is preferably a hetero cyclic group, for example, 1,3,5-triazine-2-yl, 1,2,4-triazine-3-yl, pyridine-2-yl, pyrazinyl, pyrimidinyl, purinyl, quinolyl, imidazolyl, thiazolyl, oxazoly, 1,2,4-triazol-3-yl, benzimidazol-2-yl, benzothiazolyl, benzoxazoly, thienyl, furyl, imidazolydinyl, pyrrolinyl, tetrahydrofuril, morpholinyl, and phosphinophosphorus-2-yl.

Rb is preferably a hydrogen atom or an alkyl group, more preferably a hydrogen atom or a methyl group.

Practical examples of the compounds represented by general formula (A) are those of RS—I to RS—X set forth below:

RS-I

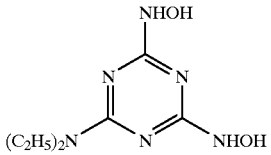

RS-II

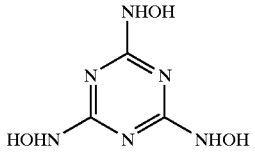

RS-III

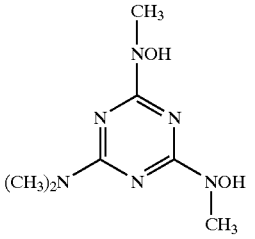

RS-IV

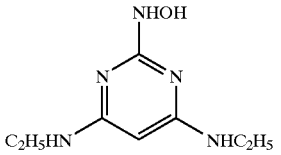

RS-V

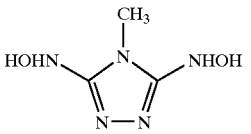

-continued

RS-VI

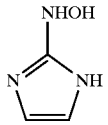

RS-VII

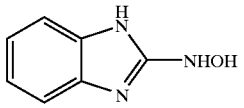

RS-VIII

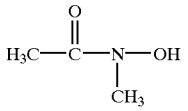

RS-IX

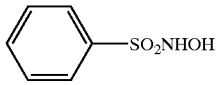

RS-X

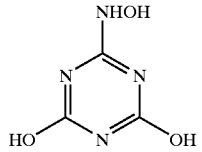

Although the addition amount of reduction sensitizers must be so selected as to meet the emulsion preparing conditions, a proper amount is $10^{-7}$ to $10^{-3}$ mol per mol of a silver halide. Reduction sensitizers are dissolved in water or a solvent, such as alcohols, glycols, ketones, esters, or amides, and the resultant solution is added during grain growth.

In the present invention, positive hole capturing silver nuclei are preferably formed by adding reduction sensitizers after 50% of the total silver amount required for grain formation are added. More preferably, positive hole capturing silver nuclei are formed by adding reduction sensitizers after 70% of the total silver amount required for grain formation are added. In the present invention, positive hole-capturing silver nuclei can also be formed at the surface of the grain by adding reduction sensitizers after grain formation is completed. When reduction sensitizers are added during grain formation, some silver nuclei formed can stay inside a grain, but some ooze out to form silver nuclei on the grain surface. In the present invention, these oozing silver nuclei are preferably used as positive hole capturing silver nuclei.

In the present invention, for enhancing the storability of silver halide emulsion, there can preferably be used hydroxamic acid derivatives as described in JP-A-11-109576; cyclic ketones having double bonds and having both terminals, neighboring to carbonyl groups, substituted with amino or hydroxyl groups (especially those represented by the general formula (S1), the description at paragraph numbers 0036 to 0071 are incorporated herewith by reference), as described in JP-A-11-327094; sulfo-substituted catechols and hydroquinones (for example, 4,5-dihydroxy-1,3-benzenedisulfonic acid, 2,5-dihydroxy-1,4-benzenedisulfonic acid, 3,4-dihydroxybenzenesulfonic acid, 2,3-dihydroxybenzenesulfonic acid, 2,5-dihydroxybenzenesulfonic acid, 3,4,5-trihydroxybenzenesulfonic acid and salts thereof.) as described in JP-A-11-143011; and water-soluble reducing agents represented by the general formulae (I) to (III) of JP-A-11-102045.

A spectral sensitization is performed in order to provide the emulsion of each layer of the lightsensitive material of the present invention with a spectral sensitivity exhibited in the desired light wavelength range. As spectral sensitizing dyes for use in the spectral sensitization in blue, green and red regions in the lightsensitive material of the present invention, there can be mentioned, for example, those described in "Heterocyclic Compounds—Cyanine Dyes and Related Compounds" written by F. M. Harmer and published by John Wiley & Sons, New York, London in 1964. Examples of specific compounds and spectral sensitization methods are preferably as described in page 22, right upper column to page 38 of the specification of the above-mentioned JP-A-62-215272. Moreover, particularly as a red-sensitive spectral sensitizing dye for silver halide emulsion grains of high silver chloride content, it is highly preferred to use spectral sensitizing dyes described in JP-A-3-123340 from the viewpoint of stability, adsorption strength and exposure dependence on temperature. On the other hand, silver halide emulsion grains of high silver bromide content are preferably spectrally sensitized by known cyanine dyes, more preferably by monomethine cyanine dyes.

The addition of sensitizing dye to the emulsion may be performed at any stage of emulsion preparation which is known as being useful. Although the addition of spectral sensitizing dye is most usually conducted at a stage after the completion of the chemical sensitization but prior to the coating, the spectral sensitizing dye can be added simultaneously with the chemical sensitizer to thereby simultaneously effect the spectral sensitization and the chemical sensitization as described in U.S. Pat. Nos. 3,628,969 and 4,225,666. Alternatively, as described in JP-A-58-113928, the spectral sensitization can be conducted prior to the chemical sensitization and, also, the spectral sensitizing dye can be added prior to the completion of silver halide grain precipitation formation to thereby initiate the spectral sensitization. Further, the above sensitizing dye compound can be divided prior to addition, that is, part of the sensitizing dye compound can be added prior to the chemical sensitization with the rest of the sensitizing dye compound added after the chemical sensitization as taught in U.S. Pat. No. 4,225,666. The addition of spectral sensitizing dye can be effected at any stage during the formation of silver halide grains according to the method disclosed in U.S. Pat. No. 4,183,756 and other methods.

These sensitizing dyes may be used singly, and also may be used in combination. The combination of sensitizing dyes are often used especially for supersensitization. Representative examples of combinations are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patent Nos. 1,344,281 and 1,507,803, Jpn. Pat. Appln. KOKOKU Publication No. (hereinafter also referred to as JP-B-) 43-4936 and JP-B-53-12375, and JP-A's-52-110618 and 52-109925.

The addition amount of spectral sensitizing dye is widely varied according to circumstances. However, preferably, the spectral sensitizing dye is used in an amount of $0.5\times10^{-6}$ to $1.0\times10^{-2}$ mol per mol of silver halides. With respect to silver halide grains of high silver chloride content, the amount is preferably in the range of $1.0\times10^{-6}$ to $5.0\times10^{-3}$ mol. With respect to silver halide grains of high silver bromide content, the amount is preferably $5.0\times10^{-4}$ mol or more. When the average diameter of silver halide grains is in the range of 1.0 to 3.0 $\mu$m, the effective amount is in the range of about $2.0\times10^{-4}$ to $5.0\times10^{-3}$ mol.

The silver halide grains of the present invention can be subjected to at least one of the chalcogenide sensitization such as sulfur sensitization or selenium sensitization, the noble metal sensitization such as gold sensitization or palladium sensitization and the reduction sensitization in the process of producing the silver halide emulsion. Sensitization is preferably performed by a combination of these. Various types of emulsions can be prepared depending on at which stage the chemical sensitization is carried out. These include the type in which chemical sensitization nuclei are implanted in the interior of grains, the type in which the implantation is performed in a site shallow from the grain surface, and the type in which the chemical sensitization nuclei are created at the grain surface. Although in the emulsion of the present invention the position of chemical sensitization nuclei can be chosen according to the object, it is preferred that at least one type of chemical sensitization nucleus be produced in the vicinity of grain surface. In particular, with respect to grains of high silver chloride content, the gold sensitization is preferably performed. The reason is that the gold sensitization enables significantly reducing the variation of photographic performance at the scanning exposure by laser beams, etc.

A preferable chemical sensitization which can be carried out in the present invention is each or a combination of the chalcogenide sensitization and the noble metal sensitization. Such a chemical sensitization can be performed by the use of active gelatin as described in T. H. James, The Theory of the Photographic Process, 4th ed., Macmillan, 1977, p.p. 67–76. Also, the chemical sensitization can be performed by the use of a sensitizer selected from among sulfur, selenium, tellurium, gold, platinum, palladium, iridium and combinations thereof at a pAg of 5 to 10, a pH of 5 to 8 and a temperature of 30 to 80° C. as described in Research Disclosure, vol. 120, April 1974, 12008; Research Disclosure, vol. 34, June 1975, 13452; U.S. Pat. Nos. 2,642,361, 3,297,446, 3,772,031, 3,857,711, 3,901,714, 4,266,018 and 3,904,415; GB 1,315,755; and JP-A-62-215272, page 18 right lower column to page 22 right upper column. In the noble metal sensitization, use can be made of salts of noble metals such as gold, platinum, palladium and iridium. In particular, the gold sensitization, palladium sensitization and combination thereof are preferred.

In the gold sensitization, use can be made of various inorganic gold compounds, gold (I) complexes having inorganic ligands and gold (I) compounds having organic ligands. For example, chloroauric acid and salts thereof can be used as the inorganic gold compounds. For example, gold dithiocyanate compounds such as gold (I) potassium dithiocyanate, and gold dithiosulfate compounds such as gold (I) trisodium dithiosulfate can be used as the gold (I) complexes having inorganic ligands. As the gold (I) compounds having organic ligands, use can be made of bisgold (I) mesoion heterocyclic compounds, for example, gold (I) tetrafluoroborate bis(1,4,5-trimethyl-1,2,4-triazolium-3-thiolate) as described in JP-A-4-267249; organic mercaptogold (I) complexes, for example, potassium bis{1-[3-(2-sulfonatobenzamido)phenyl]-5-mercaptotetrazole potassium salt} aurate (I) pentahydrate as described in JP-A-11-218870; and gold (I) compounds having a nitrogenous compound anion as a ligand, for example, gold (I) sodium bis(1-methylhydantoinate) tetrahydrate as described in JP-A-4-268550. Further, use can be made of gold (I) thiolate compounds as described in U.S. Pat. No. 3,503,749; gold compounds as described in JP-A's-8-69074, 8-69075 and 9-269554; and compounds as described in U.S. Pat. Nos. 5,620,841, 5,912,112, 5,620,841, 5,939,245 and 5,912,111.

Moreover, use can be made of colloidal gold sulfide. The process for producing the same is described in, for example, Research Disclosure 37154; Solid State Ionics, vol. 79, pp. 60 to 66, 1995; and Compt. Rend. Hebt. Seances Acad. Sci. Sect. B, vol. 263, p 1328, 1966. Colloidal gold sulfides of varied sizes can be used, which include those of 50 nm or less grain size. The addition amount thereof, although can be widely varied according to circumstances, is generally in the range of $5\times10^{-7}$ to $5\times10^{-3}$ mol, preferably $5\times10^{-6}$ to $5\times10^{-4}$ mol, in terms of gold atom per mol of silver halides.

A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, e.g., a chlorine, bromine, or iodine atom. More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

The emulsion used in the invention is preferably also gold sensitized. A preferable amount of a gold sensitizer used in the invention is $1\times10^{-7}$ to $5\times10^{-3}$ mol, and more preferably, $5\times10^{-7}$ to $5\times10^{-4}$ mol per mol of a silver halide. A preferable amount of a palladium compound is $1\times10^{-3}$ to $5\times10^{-7}$ mol per mol of a silver halide. A preferable amount of a thiocyan compound or a selenocyan compound is $5\times10^{-2}$ to $1\times10^{-6}$ mol per mol of a silver halide.

Examples of a sulfur sensitizer are hype, a thiourea-based compound, a rhodanine-based compound, and sulfur-containing compounds described in U.S. Pat. Nos. 3,857,711, 4,266,018, and 4,054,457. The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and G. F. Duffin, Photographic Emulsion Chemistry, pages 138 to 143.

A preferable amount of a sulfur sensitizer used in the invention is $1\times10^{-4}$ to $1\times10^{-7}$ mol, and more preferably, $1\times10^{-5}$ to $5\times10^{-7}$ mol per mol of a silver halide.

As a preferable sensitizing method for the emulsion use in the invention, selenium sensitization can be mentioned. In the selenium sensitization, known labile selenium compounds may be used, which specifically include, selenium compounds such as colloidal metalselenium, selenoureas (e.g., N,N-dimethylselenourea, N,N-diethylselenoureas), selenokenones, selenoamides and the like. The selenium sensitization sometimes is preferably used in combination with sulfur sensitization or noble metal sensitization or with both of sulfur and noble metal sensitizations.

In the present invention, preferably, a thiocyanic acid salt is added prior to the above addition of spectral sensitizing dye and chemical sensitizer. The thiocyanic acid salt is preferably added after the grain formation, more preferably after the completion of desalting. The thiocyanic acid salt is also preferably added at the chemical sensitization, so that the addition of thiocyanic acid salt is performed twice or more. For example, potassium thiocyanate, sodium thiocyanate or ammonium thiocyanate is used as the thiocyanic acid salt. Generally, the thiocyanic acid salt is dissolved in an aqueous solution or a water-soluble solvent before the addition thereof. The addition amount of thiocyanic acid salt is in the range of $1\times10^{-5}$ to $1\times10^{-2}$ mol, preferably $5\times10^{-5}$ to $5\times10^{-3}$ mol, per mol of silver halides.

There are occasions when it is advantageous to employ the method of adding chalcogenide compounds as described in U.S. Pat. No. 3,772,031 during the emulsion preparation. Not only S, Se and Te but also a cyanic salt, a thiocyanic salt, selenocyanic acid, a carbonic acid salt, a phosphoric acid salt and an acetic acid salt may be present.

The emulsion of the present invention is preferably prepared in the presence of a water-soluble radical scavenger. A radical scavenger that can be used in the present invention is a compound which, when a 0.05 $mmoldm^{-3}$ ethanol solution of garvinoxyl and a 2.5 $mmoldm^{-3}$ ethanol solution of a test compound are mixed at 25° C. by a stopped flow method and changes in the absorbance with time at 430 nm are measured, substantially decolors the garvinoxyl (reduces the absorbance at 430 nm). The radical scavenge rate of a radical scavenger usable in the present invention is the decoloration rate constant of garvinoxyl obtained by the above method. A radical scavenger preferably has a radical scavenge rate of 0.01 $mmols^{-1}$ $dm^3$ or more, and more preferably, 0.1 to 10 $mmols^{-1}$ $dm^3$. This method of obtaining the radical scavenge rate is described in Microchemical Journal 31, pp. 18–21 (1985), BUNKOKENKYU vol. 19, No. 6, p.321 (1970), and the like.

The solubility to water of the radical scavenger is represented by the distribution coefficient of an n-octanol/water system defined by:

$$\log P = \log[(Rs)_{octanol}/(Rs)_{water}]$$

where (Rs) is the radical scavenger concentration, and $(Rs)_{octanol}$ and $(Rs)_{water}$ are the concentrations in n-octanol and water, respectively. "Being water-soluble" means that the above logP value is smaller than 1. The distribution coefficient can be calculated by a method described in Journal of Medicinal Chemistry, Vol. 18, No. 9, pp. 865–868 (1975).

Examples of the radical scavenger used in the present invention are water-soluble ones of phenol-based compounds described in JP-A-7-72599 and hydroxyamine-based compounds represented by formulas (A-I) to (A-III) described in U.S. Pat. No. 5,719,007, formula (S2) described in JP-A-10-10668, formula (S1) described in JP-A-11-15102, and formula (S1) described in JP-A-10-90819.

Practical examples of the water-soluble radical scavenger are presented below, but the present invention is not restricted to these examples.

RS-1

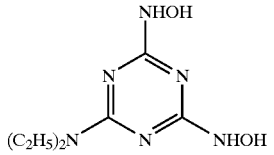

RS-2

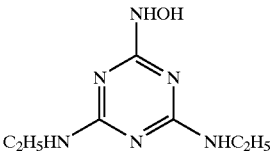

-continued

RS-3

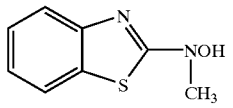

RS-4

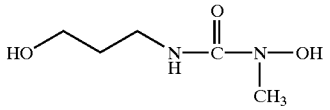

RS-5

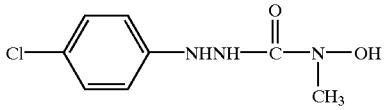

The above water-soluble radical scavenger is preferably added during emulsion preparation and can be added in any step of the process. For example, the radical scavenger can be added in a silver halide grain formation step, before the initiation of a desilvering step, in the desilvering step, before the start of chemical ripening, in the chemical ripening step, and before preparation of completed emulsion. The radical scavenger can also be separately added a plurality of times in these steps. Preferably, the radical scavenger is added before, during, or after chemical sensitization.

A preferred addition amount of the water-soluble radical scavenger largely depends upon the addition method described above and the type of compound to be added. Generally, the addition amount is preferably $5\times10^{-6}$ to 0.5 mol, and more preferably, $1\times10^{-5}$ to 0.005 mol per mol of a photosensitive silver halide. Two or more types of radical scavengers can be used together. The radical scavenger can be added by dissolving it in water or a water-soluble solvent, such as methanol or ethanol, or in a solvent mixture of these, or can be added by emulsified dispersion. When the radical scavenger is dissolved in water, the pH can be raised or lowered if the solubility rises when the pH is raised or lowered, and the resultant solution can be added. A surfactant can also be present at the same time.

In the present invention, the tabular grains preferably have dislocation lines. The dislocation lines of the tabular grains can be observed by the direct method using a transmission electron microscope at low temperatures as described in, for example, J. F. Hamilton, Phot. Sci. Eng., 11, 57 (1967) and T. Shiozawa, J. Soc. Phot. Sci. Japan, 35, 213 (1972). The number of dislocation lines of the tabular grains according to the present invention is preferably at least 10 per grain on the average and more preferably at least 20 per grain on the average. When dislocation lines are densely present or when dislocation lines are observed in the state of crossing each other, it happens that the number of dislocation lines per grain cannot accurately be counted. However, in this instance as well, rough counting on the order of, for example, 10, 20 or 30 dislocation lines can be effected, so that a clear distinction can be made from the presence of only a few dislocation lines. The average number of dislocation lines per grain is determined by counting the number of dislocation lines of each of at least 100 grains and calculating a number average thereof.

Dislocation lines can be introduced in, for example, the vicinity of the periphery of tabular grains. In this instance, the dislocation is nearly perpendicular to the periphery, and each dislocation line extends from a position corresponding to x% of the distance from the center of tabular grains to the side (periphery) to the periphery. The value of x preferably ranges from 10 to less than 100, more preferably from 30 to less than 99, and most preferably from 50 to less than 98. Dislocation lines may be positioned either nearly uniformly over the entire zone of the periphery of the tabular grains or local points of the periphery. That is, referring to, for example, hexagonal tabular silver halide grains, dislocation lines may be localized either only in the vicinity of six apexes or only in the vicinity of one of the apexes. Contrarily, dislocation lines can be localized only in the sides excluding the vicinity of six apexes.

Furthermore, dislocation lines may be formed over regions including the centers of two mutually parallel main planes of tabular grains. In the case where dislocation lines are formed over the entire regions of the main planes, the dislocation lines may crystallographically be oriented approximately in the {211} direction when viewed in the direction perpendicular to the main planes, and the formation of the dislocation lines may be effected either in the {110} direction or randomly. Further, the length of each dislocation line may be random, and the dislocation lines may be observed as short lines on the main planes or as long lines extending to the side (periphery). The dislocation lines may be straight or often meander. The position of dislocation lines may be localized on the periphery, main planes or local points as mentioned above, or the formation of dislocation lines may be effected on a combination thereof.

In the present invention, dislocation lines are preferably introduced by abruptly adding a silver iodide fine grain emulsion to the tabular grain emulsion, and then growing silver bromide or silver iodobromide. Although the growth of silver bromide or silver iodobromide may be initiated before or at the same time with the addition of the silver iodide fine grain emulsion, the growth of silver bromide or silver iodobromide is preferably initiated after the addition of the silver iodide fine grain emulsion. The period from the addition of the silver iodide fine grain emulsion to the initiation of the growth of silver bromide or silver iodobromide is preferably within 10 min, but 1 sec or more. More preferably, the period is within 5 min, but 3 sec or more. Much more preferably, the period is within 1 min. The shorter this time interval is, the better, but before the initiation of growth of silver bromide or silver iodobromide is preferable.

Silver bromide is preferably grown after the addition of a silver iodide fine grain emulsion. When silver iodobromide is used, the silver iodide content is 3 mol % or less with respect to the corresponding layer. Assume that the total silver amount of a completed tabular grain emulsion is 100, the silver amount of a layer grown after the addition of this silver iodide fine grain emulsion is preferably 5 to 50, and most preferably, 10 to 30. The temperature, pH, and pBr during the formation of this layer are not particularly restricted. However, the temperature is usually 40° C. to 90° C. and the pH is usually 2 to 9. More preferably, the temperature is 50° C. to 80° C. and the pH is 3 to 7. In the present invention, the pBr at the end of the formation of the layer is preferably higher than that in the initial stages of the layer formation. Preferably, the pBr in the initial stages of the layer formation is 2.9 or less, and the pBr at the end of the layer formation is 1.7 or more. More preferably, the pBr in the initial stages of the layer formation is 2.5 or less, and the pBr at the end of the layer formation is 1.9 or more. Most preferably, the pBr in the initial stages of the layer formation is 1 to 2.3. Most preferably, pBr at the end of the layer formation is 2.1 to 4.5. Dislocation lines are preferably introduced in the present invention by the above method.

Conventionally known photographic materials and additives may be used in the silver halide photo-sensitive material of the present invention. For example, as a photographic support, a transparent type support or a reflection type support may be use. As the transparent type support, transparent film such as cellulose nitrate film and polyethylene phthalate, and in addition, polyester between 2,6-naphthalenedicarboxylic acid (NDCA) and ethylene glycol (EG), or polyester among NDCA, terephthalic acid and EG, on which an information-recording layer such as a magnetic layer is provided, are preferably used. As the reflection type support, especially a reflection type support laminated with a plurality of polyethylene layers or polyester layers, with at least one layer of such water-resistant resin layer (laminate layer) containing white pigment such as titan oxide and the like, is preferable.

In the present invention, a reflection type support comprising a paper base on the silver halide emulsion side of which is provided with a polyolefin layer having fine vacant apertures, can be mentioned as a more preferable reflection type support. The polyolefin layer may comprise a plurality of sub-layers. In such a case, the plurality of sub-layers are preferably formed by a polyolefin sub-layer that is adjacent to a gelatin layer on the silver halide emulsion side and that has no fine vacant apertures (e.g., polypropylene and polyethylene), and another polyolefin sub-layer that is nearer to a paper base and that has the fine vacant apertures (e.g., polypropylene and polyethylene). The density of the single layer or multi-layers positioned between the paper base and photographic constituting layers is preferably 0.40–1.0 g/mL, and more preferably 0.50–0.70 g/mL. The thickness of the single layer or multi-layers positioned between the paper base and photographic constituting layers is preferably 10–100 $\mu$m, and more preferably 15–70 $\mu$m. Further, a ratio of the polyolefin layer and the paper base is preferably 0.05–0.2, more preferably 0.1–0.5.

It is also preferable, in view of enhancing the rigidity of the reflection type support, that a polyolefin layer is provided on the reverse side (back face) of the photographic constituting layers against the above paper base. In this case, the polyolefin layer on the back side is preferably polyethylene or polypropylene having mat surfaces, polypropylene being more preferable. The polyolefin layer on the back face is preferably 5–50 $\mu$m, more preferably 10–30 $\mu$m, and the density thereof is preferably 0.7–1.1 g/mL. In the reflection type support of the invention, preferable embodiments of the polyolefin layer provided on a paper base are the examples described in JP-A's-10-333277, 10-333278, 11-52513 and 11-65024 and EP's 0880065 and 0880066.

Further, the water-resistant resin layer preferably contain fluorescent whitening agent. The fluorescent whitening agent may also be dispersed in a hydrophilic colloidal layer of the photosensitive material. As the fluorescent whitening agent, preferably those of benzoxazole series, coumarin series and pyrazolone series may be used, and more preferably fluorescent whitening agent of benzoxazolylnaphthalene series and benzoxazolylstilbene series. The use amount thereof is not particularly limited, but preferably 1–100 mg/m$^2$. When the fluorescent whitening pigment is mixed with water-resistant resin, the mixing ratio thereof is preferably 0.001–0.5 wt. %, more preferably 0.001–0.5 wt. % with respect to the resin. As a reflection type support, a transparent support or a reflection type support described above, on which a hydrophilic colloidal layer containing white pigment is coated may be used. A reflection type support may be a support having a metallic surface of mirror face reflectivity or a class 2 diffusion reflectivity.

The support for use in the lightsensitive material of the present invention may be, for display, a white polyester support or a support having a layer loaded with a white pigment provided on the support on its side having a silver halide emulsion layer. Further, for enhancing sharpness, it is preferred to provide an antihalation layer on the silver halide emulsion layer coating side or back of the support by coating. In particular, for enabling appreciation of display irrespective of reflected light or transmitted light, it is preferred that the transmission density of the support be set so as to fall within the range of 0.35 to 0.8.

In the lightsensitive material of the present invention, for the purpose of enhancing, for example, image sharpness, it is preferred to add a dye (especially, oxonol dye) capable of discoloration by processing as described in EP 0,337,490A2 pages 27 to 76 to hydrophilic colloid layers so that the optical reflection density at 680 nm of the lightsensitive material becomes 0.70 or more. It is also preferred to load the water-resistant resin layer of the support with 12% by weight or more (more preferably 14% by weight or more) of titanium oxide whose surface has been treated with, for example, di- to tetrahydric alcohols (for example, trimethylolpropane).

In the lightsensitive material of the present invention, for the purpose of preventing irradiation and halation and of enhancing, for example, safelight safety, it is preferred to add a dye (especially, oxonol dye or cyanine dye) capable of discoloration by processing as described in EP 0337490A2 pages 27 to 76 to hydrophilic colloid layers. Further, addition of dyes as described in EP 0819977 is preferred in the present invention.

Among these water-soluble dyes, there are some which, when the usage is increased, deteriorate color separation or safelight safety. As preferred dyes which can be used without detriment to color separation, there can be mentioned water-soluble dyes as described in JP-A's-5-127324, 5-127325 and 5-216185.

In the present invention, use is made of a dyed layer capable of discoloration by a processing in place of a water-soluble dye or in combination with a water-soluble dye. The dyed layer capable of discoloration by employed processing may be disposed in direct contact with an emulsion layer, or may be disposed so as to be in contact with an emulsion layer through an interlayer containing gelatin and a processing anti-color mixing agent such as hydroquinone. This dyed layer is preferably disposed at the underlayer (support side) of emulsion layers which undergo a color formation into primary colors of the same type as that of dyed color. It is practicable to individually dispose all the respective dyed layers corresponding to primary colors, or to dispose only some arbitrarily selected from thereamong. Also, it is practicable to dispose dyed layers having undergone dyeing corresponding to a plurality of primary color regions. With respect to the optical reflection density of dyed layers, the optical density value at a wavelength of highest optical density in a wavelength region used in exposure (at ordinary printer exposure, 400 to 700 nm visible light region, and, at scanning exposure, wavelength of employed scanning exposure light source) is preferably in the range of 0.2 to 3.0, more preferably 0.5 to 2.5, and most preferably 0.8 to 2.0.

Known methods can be employed for forming the dyed layers. For example, one method comprises mixing dyes, such as those described in JP-A-2-282244 page 3 right upper column to page 8 and in JP-A-3-7931 page 3 right upper column to page 11 left lower column, into hydrophilic colloid layers in the form of a solid fine particulate dispersion. Another method comprises mordanting a cationic polymer with an anionic dye. A further other method comprises causing fine grains of, for example, silver halides to adsorb dyes to thereby attain fixing of the dyes in layers. Still a further other method comprises using colloidal silver as described in JP-A-1-239544. With respect to the method of dispersing fine powder of dyes in solid form, for example, the method in which a finely powdered dye that is substantially insoluble in water at least at a pH value of 6 or below but substantially soluble in water at least at a pH value of 8 or above is added is described in JP-A-2-308244 pages 4 to 13. Furthermore, for example, the method of mordanting a cationic polymer with an anionic dye is described in JP-A-2-84637 pages 18 to 26. The method of preparing colloidal silver as a light absorber is described in U.S. Pat. Nos. 2,688,601 and 3,459,563. Of these methods, the method of mixing a finely powdered dye and the method of using colloidal silver are preferred.

The silver halide photosensitive material of the present invention can be used in a black-and-white printing paper, a black-and-white negative film, an X-ray film, a color negative film, a color positive film, a color reversal film, a color reversal printing paper, a color printing paper, etc. Among these, the uses as a color negative film and color printing paper are preferred.

The color printing paper preferably has at least one yellow color-forming silver halide emulsion layer, at least one magenta color-forming silver halide emulsion layer and at least one cyan color-forming silver halide emulsion layer. Generally, with respect to the arrangement of silver halide emulsion layers, the yellow color-forming silver halide emulsion layer, the magenta color-forming silver halide emulsion layer and the cyan color-forming silver halide emulsion layer are disposed in this sequence from the nearer side of the support. However, other layer arrangements may be employed.

Although the silver halide emulsion layer containing a yellow coupler may be disposed at any position on the support, when the yellow-coupler-containing layer contains silver halide tabular grains, it is preferred that this layer be provided by coating at a position remoter from the support than the position of at least one of magenta-coupler-containing silver halide emulsion layer and cyan-coupler-containing silver halide emulsion layer. From the viewpoint of color development acceleration, desilvering acceleration and reduction of residual color by sensitizing dye, it is preferred that the yellow-coupler-containing silver halide emulsion layer be provided by coating at a position remoter from the support than any of other silver halide emulsion layers. Further, from the viewpoint of reduction of Blix fading, it is preferred that the cyan-coupler-containing silver halide emulsion layer lie in the center of other silver halide emulsion layers. From the viewpoint of reduction of light fading, it is preferred that the cyan-coupler-containing silver halide emulsion layer be the bottom layer thereof. Each of the yellow, magenta and cyan color forming layers may consist of two or three sublayers. For example, as described in JP-A's-4-75055, 9-114035 and 10-246940 and U.S. Pat. No. 5,576,159, it is also preferred to arrange a coupler layer containing no silver halide emulsion adjacent to a silver halide emulsion layer, thereby providing a color-forming layer.

With respect to the silver halide emulsions and other materials (additives, etc.), photographic constituent layers (layer arrangement, etc.) and processing methods and processing additives employed for processing the lightsensitive material, for use in the present invention, those described in JP-A's-62-215272 and 2-33144 and EP 0,355,660A2, especially those described in EP 0,355,660A2, can be preferably used. Further, also, the silver halide color photosensitive materials and processing methods thereof described in, for example, JP-A's-5-34889, 4-359249, 4-313753, 4-270344, 5-66527, 4-34548, 4-145433, 2-854, 1-158431, 2-90145, 3-194539 and 2-93641 and EP 0520457A2 can be preferably used.

In particular, in the present invention, with respect to the above-mentioned reflection type support, silver halide emulsion, as well as different types of metal ion species for doping silver halide grains, storage stabilizer and antifoggant for silver halide emulsion, chemical sensitizing method (sensitizer), spectral sensitizing method (spectral sensitizer), cyan, magenta and yellow couplers, emulsification dispersion method for such couplers, color image storability improver (anti-staining agent or anti-fading agent), dyes (dyed layer), types of gelatins, layer arrangement of light-sensitive material and film pH of lightsensitive material, etc., those described in the patents of Tables 1 and 2 can especially preferably employed.

TABLE 1

| Element | JP-A-7-104448 | JP-A-7-77775 | JP-A-7-301895 |
|---|---|---|---|
| Reflection-type support | Clmn 7, ln 12–Clmn 12, ln 19 | Clmn 35, ln 43–Clmn 44, ln 1 | Clmn 5, ln 40–Clmn 9, ln 26 |
| Silver halide emulsion | Clmn 72, ln 29–Clmn 74, ln 18 | Clmn 44, ln 36–Clmn 46, ln 29 | Clmn 77, ln 48–Clmn 80, ln 28 |
| Kind of hetero metal ion | Clmn 74, ln 19–44 | Clmn 46, ln 30–Clmn 47, ln 5 | Clmn 80, ln 29–Clmn 81, ln 6 |
| Storage stabilizing agent or antifoggant | Clmn 75, ln 9–18 | Clmn 47, ln 20–29 | Clmn 18, ln 11–Clmn 31, ln 37 (Especially, mercapto-heterocyclic compounds) |
| Chemical sensitizing method (Chemical sensitizer) | Clmn 74, ln 45–Clmn 75, ln 6 | Clmn 47, ln 7–17 | Clmn 81, ln 9–17 |
| Spectral sensitizing method (Spectral sensitizer) | Clmn 75, ln 19–Clmn 76, ln 45 | Clmn 47, ln 30–Clmn 49, ln 6 | Clmn 81, ln 21–Clmn 82, ln 48 |
| Cyan coupler | Clmn 12, ln 20–Clmn 39, ln 49 | Clmn 62, ln 50–Clmn 63, ln 16 | Clmn 88, ln 49–Clmn 89, ln 16 |
| Yellow coupler | Clmn 87, ln 40–Clmn 88, ln 3 | Clmn 63, ln 17–30 | Clmn 89, ln 17–30 |
| Magenta coupler | Clmn 88, ln 4–18 | Clmn 63, ln 3–Clmn 64, ln 11 | Clmn 31, ln 34–Clmn 77, ln 44 and Clmn 88, ln 32–46 |

clmn = column;
ln = line

TABLE 2

| Element | JP-A-7-104448 | JP-A-7-77775 | JP-A-7-301895 |
|---|---|---|---|
| Emulsification dispersing method of coupler | Clmn 71, ln 3–Clmn 72, ln 11 | Clmn 61, ln 36–49 | Clmn 87, ln 35–48 |
| Color image stability-improving agent (Ant-stain agent) | Clmn 39, ln 50–Clmn 70, ln 9 | Clmn 61, ln 50–Clmn 62, ln 49 | Clmn 87, ln 49–Clmn 88, ln 48 |
| Anti-fading agent | Clmn 70, ln 10–Clmn 71, ln 2 | | |

TABLE 2-continued

| Element | JP-A-7-104448 | JP-A-7-77775 | JP-A-7-301895 |
|---|---|---|---|
| Dye (Coloring agent) | Clmn 77, ln 42–Clmn 78, ln 41 | Clmn 7, ln 14–Clmn 19, ln 42 and Clmn 50, ln 3–Clmn 51, ln 14 | Clmn 9, ln 27–Clmn 18, ln 10 |
| Kind of gelatin | Clmn 78, ln 42–48 | Clmn 51, ln 15–20 | Clmn 83, ln 13–19 |
| Layer structure of light-sensitive material | Clmn 39, ln 11–26 | Clmn 44, ln 2–35 | Clmn 31, ln 38–Clmn 32, ln 33 |
| Film pH of light-sensitive material | Clmn 72, ln 12–28 | | |
| Scanning exposure | Clmn 76, ln 6–Clmn 77, ln 41 | Clmn 49, ln 7–Clmn 50, ln 2 | Clmn 82, ln 49–Clmn 83, ln 12 |
| Preservative in developing solution | Clmn 88, ln 19–Clmn 89, ln 22 | | |

clmn = column;
ln = line

As cyan, magenta and yellow couplers other than the above, those described in the followings are also useful: JP-A-62-215272, page 91, right upper column, line 4 to page 121, left upper column, line 6; JP-A-2-33144, page 3, right upper column, line 14 to page 18, left upper column, the last line, and page 30, right upper column, line 6 to page 35, right lower column, line 11; and EP 0355,660A2, page 4, line 15 to line 27, page 5, line 30 to page 28, the last line, page 45, line 29 to line 31 and page 47, line 23 to page 63, line 50. Also, in the present invention, compounds of general formulas (II) and (II) of WO 98/33760 and those of general formula (D) of JP-A-10-221825 may be added, and preferable.

The couplers and compounds will be described more specifically below.

Pyrrolotriazole couplers are preferably used as the cyan coupler in the present invention. The couplers represented by the general formula (I) or (II) of JP-A-5-313324, the couplers represented by the general formula (I) of JP-A-6-347960 and coupler examples listed in these patent specifications are especially preferred. Also, phenol and naphthol cyan couplers are preferred. For example, cyan couplers represented by the general formula (ADF) of JP-A-10-333297 are preferred.

As other cyan couplers, preferred use can be made of pyrroloazole cyan couplers as described in EP's 0488248 and 0491197A1; 2,5-diacylaminophenol couplers as described in U.S. Pat. No. 5,888,716; and pyrazoloazole cyan couplers having an electron withdrawing group or a hydrogen bond group at their 6-position as described in U.S. Pat. Nos. 4,873,183 and 4,916,051, in particular, pyrazoloazole cyan couplers having a carbamoyl group at their 6-position as described in JP-A's-8-171185, 8-311360 and 8-339060.

Further, use can be made of not only diphenylimidazole cyan couplers as described in JP-A-2-33144 but also 3-hydroxypyridine cyan couplers (in particular, coupler obtained by providing 4-equivalent coupler of coupler (42) listed as specific example with a chloride elimination group so as to effect conversion to 2-equivalent, and couplers (6) and (9) are especially preferred) as described in EP 0333185A2; cyclic active methylene cyan couplers (in particular, listed coupler examples 3, 8 and 34 are especially preferred) as described in JP-A-64-32260; pyrrolopyrazole cyan couplers as described in EP 0456226A1; and pyrroloimidazole cyan couplers as described in EP 0484909.

As the magenta coupler for use in the present invention, there can be mentioned 5-pyrazolone magenta couplers and pyrazoloazole magenta couplers as described in the literature of the above Tables. Among them, it is preferred from the viewpoint of hue, image stability, color forming characteristics, etc. to use pyrazolotriazole couplers comprising a pyrazolotriazole ring having a secondary or tertiary alkyl group directly bonded to the 2-, 3- or 6-position thereof as described in JP-A-61-65245; pyrazoloazole couplers having an intramolecular sulfonamido group as described in JP-A-61-65246; pyrazoloazole couplers having an alkoxyphenylsulfonamido ballast group as described in JP-A-61-147254; and pyrazoloazole couplers having an alkoxy group or an aryloxy group at the 6-position thereof as described in EP's 226,849A and 294,785A.

In particular, pyrazoloazole couplers represented by the general formula (M–1) of JP-A-8-122984 are preferred as the magenta coupler. The description at numbered paragraphs 0009 to 0026 of this patent specification is directly applicable to the present invention, and thus incorporated by reference as part of the specification of the present application. Furthermore, pyrazoloazole couplers having steric hindrance groups at both the 3- and 6-positions thereof as described in EP's 854384 and 884640 are preferably used.

As the yellow coupler, preferred use is made of not only the compounds listed in the above Tables but also acylacetamide yellow couplers having a 3- to 5-membered cyclic structure at the acyl group as described in EP 0447969A1; malondianilide yellow couplers of cyclic structure as described in EP 0482552A1; and acylacetamide yellow couplers with a dioxane structure as described in U.S. Pat. No. 5,118,599. Among them, acylacetamide yellow couplers wherein the acyl group is 1-alkylcyclopropane-1-carbonyl and malondianilide yellow couplers wherein one of the anilides forms an indoline ring are especially preferably used. These couplers can be used individually or in combination.

It is preferred that the couplers for use in the present invention be, in the presence (or absence) of high-boiling-point organic solvent listed in the above Tables, infiltrated in loadable latex polymers (for example, U.S. Pat. No. 4,203,716), or dissolved together with polymers which are insoluble in water but soluble in organic solvents, before emulsification dispersion in hydrophilic colloid aqueous solutions.

As preferably usable polymers which are insoluble in water but soluble in organic solvents, there can be mentioned homopolymers and copolymers as described in U.S. Pat. No. 4,857,449 columns 7 to 15 and WO 88/00723 pages 12 to 30. Methacrylate and acrylamide polymers are more preferred, and acrylamide polymers are most preferably used from the viewpoint of color image stability.

Known anti-color mixing agents can be used in the present invention. Among them, those described in the following patents are preferred. For example, preferred use can be made of redox compounds of high molecular weight as described in JP-A-5-333501; phenidone and hydrazine compounds as described in WO 98/33760 and U.S. Pat. No. 4,923,787; and white couplers as described in JP-A's-5-249637 and 10-282615 and DE 19629142A1. When it is intended to increase the speed of development by raising the pH of developer, redox compounds as described in DE 19618786A1, EP's 839623A1 and 842975A1, DE 19806846A1 and FR 2760460A1 are preferably used.

In the present invention, compounds having a triazine skeleton of high molar extinction coefficient are preferably used as an ultraviolet absorber. For example, use can be made of the compounds described in the following patent specifications.

That is, use can be made of compounds as described in, for example, JP-A's-46-3335, 55-152776, 5-197074, 5-232630, 5-307232, 6-211813, 8-53427, 8-234364, 8-239368, 9-31067, 10-115898, 10-147577 and 10-182621, DE 19739797A, EP 711804A and PCT National Publication 8-501291.

As the binder or protective colloid which can be incorporated in the lightsensitive material of the present invention, although using of gelatin is advantageous, other hydrophilic colloids can be used alone or in combination with gelatin. For example, use can be made of a wide variety of synthetic hydrophilic polymeric substances, including gelatin derivatives, graft polymers from gelatin and other polymers, and proteins such as albumin and casein; cellulose derivatives such as hydroxyethylcellulose, carboxymethylcellulose and cellulose sulfates, and sugar derivatives such as sodium alginate and starch derivatives; and homopolymers and copolymers such as polyvinyl alcohol, partially acetalized polyvinyl alcohol, poly-N-vinylpyrrolidone, polyacrylic acid, polymethacrylic acid, polyacrylamide, polyvinylimidazole and polyvinylpyrazole.

As the gelatin, use may be made of not only a lime-processed gelatin but also an acid-processed gelatin or an enzyme-processed gelatin as described in Bull. Soc. Sci. Photo. Japan, No. 16, p30 (1966). Further, use can be made of a gelatin hydrolyzate or enzymolyzate. Preferred gelatin is one wherein the content of heavy metals such as iron, copper, zinc and manganese contained as impurities is preferably 5 ppm or less, more preferably 3 ppm or less. The amount of calcium contained in the lightsensitive material is preferably 20 $mg/m^2$ or less, more preferably 10 $mg/m^2$ or less, and most preferably 5 $mg/m^2$ or less.

In the present invention, an antiseptic and an antifungal agent as described in JP-A-63-271247 is preferably added in order to check various fungi and bacteria that breed in hydrophilic colloid layers to thereby deteriorate images.

The film pH of lightsensitive material is preferably in the range of 4.0 to 7.0, more preferably 4.0 to 6.5.

The emulsion of the present invention is preferably washed for desalting and dispersed in a newly provided protective colloid. Although the water temperature can be selected in conformity with the object, it is preferably selected within the range of 5 to 50° C. Although the pH at which the washing is conducted can also be selected in conformity with the object, it is preferably selected within the range of 2 to 10, more preferably within the range of 3 to 8. Although the pAg at which the washing is conducted can also be selected in conformity with the object, it is preferably selected within the range of 5 to 10. The method of washing can be selected from among the noodle washing technique, the dialysis with the use of a semipermeable membrane, the centrifugation method, the coagulation precipitation method and the ion exchange method. The coagulation precipitation can be conducted according to a method selected from among the method in which a sulfate is used, the method in which an organic solvent is used, the method in which a water soluble polymer is used and the method in which a gelatin derivative is used.

In the emulsion of the present invention, it is preferred to use an oxidizer acting on silver other than halogen oxo acid salts during the production process thereof. However, hole trapping silver nuclei having been obtained by the reduction sensitization at grain surfaces must remain so as to optimize the film speed/fog ratio in photographic performance. In particular, a compound capable of converting minute silver nuclei, which are formed as by-product during the silver halide grain formation step and chemical sensitization step and which do not contribute to speed increase but cause fog increase, into silver ions is effective. The thus formed silver ions may form a silver salt which is sparingly soluble in water, such as a silver halide, silver sulfide or silver selenide. Alternatively, the silver ions may form a silver salt which is easily soluble in water, such as silver nitrate. Preferred oxidizers include inorganic oxidizers of thiosulfonates and organic oxidizers of quinones.

In the present invention, for attaining, for example, the coating stability enhancement, static electricity prevention and electrification regulation for the lightsensitive material, a surfactant can be added to the lightsensitive material. As the surfactant, there can be mentioned an anionic surfactant, a cationic surfactant, a betaine surfactant or a nonionic surfactant. For example, there can be mentioned those described in JP-A-5-333492. A surfactant containing a fluorine atom is preferably used as the surfactant in the present invention. The addition amount of such a surfactant to the lightsensitive material, although not particularly limited, is generally in the range of $1\times10^{-5}$ to 1 $g/m^2$, preferably $1\times10^{-4}$ to $1\times10^{-1}$ $g/m^2$, and more preferably $1\times10^{-3}$ to $1\times10^{-2}$ $g/m^2$.

Although the above surfactant containing a fluorine atom may be used alone or in combination with other known surfactants, it is preferred to use the same in combination with other known surfactants.

The lightsensitive material of the present invention is not only used in common print systems including a negative printer but also suitable to the scanning exposure system including a cathode ray tube (CRT). Cathode ray tube exposure equipments are simple and compact and ensure low cost as compared with laser equipments. Further, the former facilitate control of optical axis and color.

In the cathode ray tube for use in image exposure, according to necessity, use is made of various light emitters which emit light in spectral regions. For example, use is made of any one of a red light emitter, a green light emitter and a blue light emitter, or any of mixtures thereof. The spectral regions are not limited to the above red, green and blue, and also use is made of phosphors which emit light in yellow, orange color, purple and infrared regions. In particular, a cathode ray tube wherein these light emitters are mixed together to thereby enable white light emission is often used.

When the lightsensitive material has a plurality of lightsensitive layers with different spectral sensitivity distributions and when the cathode ray tube has phosphors capable of exhibiting light emission in a plurality of spectral regions, it is practicable to carry out simultaneous exposure of a plurality of colors, namely, to input image signals for a plurality of colors in the cathode ray tube, thereby realizing light emission from the tube surface. It is also practicable to employ the method wherein respective image signals for individual colors are sequentially inputted to thereby carry out sequential emissions of individual colors and wherein exposure is performed through a film capable of cutting other colors (surface sequential exposure). Generally, the surface sequential exposure is preferred for realization of high image quality because a cathode ray tube of high resolution can be employed.

For the lightsensitive material of the present invention, preferred use is made of a digital scanning exposure system utilizing monochromatic high-density beams from, for example, a gas laser, a light emitting diode, a semiconductor laser, or a second harmonic generating light source (SHG) consisting of a combination of a nonlinear optical crystal and a semiconductor laser or solid laser which uses a semiconductor laser as an exciting light source. From the viewpoint of rendering the system compact and inexpensive, it is more preferred to use a semiconductor laser or a second harmonic generating light source (SHG) consisting of a combination of a nonlinear optical crystal and a semiconductor laser or solid laser. Further, from the viewpoint of designing an especially compact, cheap, long-life and highly stable equipment, it is most preferred to use a semiconductor laser. At least one of exposure light sources preferably consists of a semiconductor laser.

When the above scanning exposure light source is employed, the spectral sensitivity maximum wavelength of the lightsensitive material of the present invention can be arbitrarily set depending on the wavelength of employed scanning exposure light source. With the use of the SHG light source obtained by a combination of a nonlinear optical crystal and a semiconductor laser or solid laser which uses a semiconductor laser as an exciting light source, the oscillation wavelength of laser can be halved, so that blue and green lights can be obtained. Therefore, the spectral sensitivity maximum of lightsensitive material can be had in ordinary three, namely, blue, green and red wavelength regions.

With respect to the exposure time in the above scanning exposure, when defined as the time of exposure over a pixel size of 400 dpi pixel density, it is preferably $10^{-4}$ sec or less, more preferably $10^{-6}$ sec or less.

Preferable scanning exposure systems which can be employed in the present invention are described in detail in the patent specifications listed in the above Tables.

In the processing of the lightsensitive material of the present invention, preferred use can be made of processing materials and processing methods as described in JP-A-2-207250 page 26, right lower column, line 1 to page 34, right upper column, line 9 and JP-A-4-97355 page 5, left upper column, line 17 to page 18, right lower column, line 20. As the preservative added to the developer, preferred use can be made of compounds described in the patent specifications listed in the above Tables.

The present invention can also preferably be applied to lightsensitive materials exhibiting a rapid processability.

The color development time refers to a period of time from the entry of lightsensitive material into a color developer to before the entry of lightsensitive material into a bleach-fix bath as the subsequent processing step. For example, in the processing by an automatic processor, the color development time refers to the sum of time wherein the lightsensitive material is immersed in a color developer (known as submerged time) and time wherein the lightsensitive material having departed the color developer is conveyed in air toward a bleach-fix bath for the subsequent processing step (known as aerial time). Likewise, the bleach-fix time refers to a period of time from the entry of lightsensitive material in a bleach-fix bath to before the entry into the subsequent washing or stabilizing bath. Further, the washing or stabilization time refers to a period of time from the entry of lightsensitive material in a washing or stabilizing bath to before drying, that is, time in the bath (known as submerged time).

In the rapid processing of color paper according to the present invention, the color development time is preferably 60 sec or less, more preferably in the range of 50 to 6 sec, and most preferably 30 to 6 sec. Likewise, the bleach-fix time is preferably 60 sec or less, more preferably in the range of 50 to 6 sec, and most preferably 30 to 6 sec. Further, the washing or stabilization time is preferably 150 sec or less, more preferably in the range of 130 to 6 sec.

In the development of lightsensitive material of the present invention after exposure, use can be made of, for example, not only wet methods such as the conventional method of developing with a developer containing an alkali agent and a developing agent and the method of developing a lightsensitive material wherein a developing agent is incorporated with an activator solution, for example, an alkali solution wherein no developing agent is contained but also the heat development method wherein no processing solution is employed. In particular, the activator method is preferred from the viewpoint that any developing agent is not contained in the processing solution, so that control and handling of the processing solution are easy and so that burden imposed by disposal of waste solution is reduced to thereby facilitate environmental protection. In the activator method, hydrazine compounds as described in, for example, JP-A's-8-234388, 9-152686, 9-152693, 9-211814 and 9-160193 are preferably used as the developing agent or precursor thereof incorporated in the lightsensitive material.

Moreover, the developing method wherein an image amplification processing (intensification processing) using hydrogen peroxide is carried out with the reduction of silver coating amount of the lightsensitive material is also preferably employed. In particular, it is preferred to employ this method in the activator processing. For example, the method of forming images with an activator solution containing hydrogen peroxide as described in JP-A's-8-297354 and 9-152695 is preferably employed.

Although, in the activator method, the processing with an activator solution is generally followed by desilvering, a simple procedure wherein a washing or stabilization processing is performed with the omission of desilvering processing can be performed in the image amplification processing using a lightsensitive material of low silver content. Further, in the system wherein image information is read from a lightsensitive material by a scanner or the like, a processing form capable of rendering any desilvering unnecessary can be employed even when use is made of a lightsensitive material of high silver content, such as that for photographing.

With respect to the activator bath, desilvering bath (bleaching/fixing bath) and washing and stabilizing baths for use in the present invention, known processing materials and processing techniques can be employed. Those described in Research Disclosure Item 36544 (September 1994) pages 536 to 541 and JP-A-8-234388 can preferably be employed.

In the printer exposure of lightsensitive material according to the present invention, it is preferred to use a band stop filter as described in U.S. Pat. No. 4,880,726. This would eliminate light color mixing, thereby enabling striking enhancement of color reproduction.

In the present invention, as described in EP's 0789270A1 and 0789480A1, imparting of image information may be preceded by preexposure through a yellow microdot pattern to thereby effect a copy regulation.

Photographic emulsions used in the present invention can contain various compounds in order to prevent fog during the manufacturing process, storage, or to stabilize photographic properties. Usable compounds are those known as an antifoggant or a stabilizer, for example, thiazoles, such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxadolinethione;

azaindenes, such as triazaindenes, tetrazaindenes (particularly hydroxy-substituted(1,3,3a,7)tetrazaindenes), and pentazaindenes. For example, compounds described in U.S. Pat. Nos. 3,954,474 and 3,982,947 and JP-B-52-28660 can be used. One preferable compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and the stabilizers can be added during preparation of an emulsion to achieve their original fog preventing effect and stabilizing effect. In addition, the antifoggants and the stabilizers can be used for various purposes of, e.g., controlling crystal habit of grains, decreasing a grain size, decreasing the solubility of grains, controlling chemical sensitization, and controlling an arrangement of dyes.

With respect to the layer arrangement and related techniques, silver halide emulsions, dye forming couplers, DIR couplers and other functional couplers, various additives and development processing which can be used in the photographic lightsensitive material to which the present invention is applicable, reference can be made to EP 0565096A1 (published on Oct. 13, 1993), and patents cited therein. Individual particulars and the locations where they are described will be listed below.

1. Layer arrangement: page 61, lines 23 to 35, page 61, line 41 to page 62, line 14,
2. Interlayers: page 61, lines 36 to 40,
3. Interlayer effect-donating layers: page 62, lines 15 to 18,
4. Silver halide halogen compositions: page 62, lines 21 to 25,
5. Silver halide grain crystal habits: page 62, lines 26 to 30,
6. Silver halide grain sizes: page 62, lines 31 to 34,
7. Emulsion production methods: page 62, lines 35 to 40,
8. Silver halide grain size distributions: page 62, lines 41 to 42,
9. Tabular grains: page 62, lines 43 to 46,
10. Internal structures of grains: page 62, lines 47 to 53,
11. Latent image forming types of emulsions: page 62, line 54 to page 63, line 5,
12. Physical ripening and chemical sensitization of emulsion: page 63, lines 6 to 9, 13. Emulsion mixing: page 63, lines 10 to 13,
14. Fogged emulsions: page 63, lines 14 to 31,
15. Nonlightsensitive emulsions: page 63, lines 32 to 43,
16. Silver coating amounts: page 63, lines 49 to 50,
17. Photographic additives: The additives are described in Research Disclosure (RD) Item 17643 (December 1978), Item 18716 (November 1979) and Item 308119 (December 1989). A summary of the locations where they are described will be listed in the following table.

| | Types of additives | RD17643 | RD18716 | RD307105 |
|---|---|---|---|---|
| (1) | Chemical sensitizers | page 23 | page 648 right column | page 866 |
| (2) | Sensitivity-increasing agents | | page 648 right column | |
| (3) | Spectral sensitizers, super-sensitizers | pages 23–24 | page 648, right column to page 649, right column | pages 866–868 |
| (4) | Brighteners | page 24 | page 647 right column | pages 868 |

-continued

| | Types of additives | RD17643 | RD18716 | RD307105 |
|---|---|---|---|---|
| (5) | Anti-foggants and stabilizers | pages 24–25 | page 649, right column | pages 868–870 |
| (6) | Light absorbents, filter dyes, ultraviolet absorbents | pages 25–26 | page 649, right column to page 650, left column | page 873 |
| (7) | Stain-preventing agents | page 25, right column | page 650, left to right columns | page 872 |
| (8) | Dye image stabilizers | page 25 | page 650, left column | page 872 |
| (9) | Film hardeners | page 26 | page 651, left column | pages 874–875 |
| (10) | Binders | page 26 | page 651, left column | pages 873–874 |
| (11) | Plasticizers, lubricant | page 27 | page 650, right column | page 876 |
| (12) | Coating aids, surfactants | pages 26–27 | page 650, right column | pages 875–876 |
| (13) | Antistatic agents | page 27 | page 650, right column | pages 876–877 |
| (14) | Matting agent | | | pages 878–879 |

18. Formaldehyde scavengers: page 64, lines 54 to 57,
19. Mercapto antifoggants: page 65, lines 1 to 2,
20. Fogging agent and etc.-releasing agents: page 65, lines 3 to 7,
21. Dyes: page 65, lines 7 to 10,
22. Color coupler summary: page 65, lines 11 to 13,
23. Yellow, magenta and cyan couplers: page 65, lines 14 to 25,
24. Polymer couplers: page 65, lines 26 to 28,
25. Diffusive dye-forming couplers: page 65, lines 29 to 31,
26. Colored couplers: page 65, lines 32 to 38,
27. Functional coupler summary: page 65, lines 39 to 44,
28. Bleaching accelerator-releasing couplers: page 65, lines 45 to 48,
29. Development accelerator-releasing couplers: page 65 lines 49 to 53,
30. Other DIR couplers: page 65, line 54 to page 66, line 4,
31. Method of dispersing couplers: page 66, lines 5 to 28,
32. Antiseptic and mildewproofing agents: page 66, lines 29 to 33,
33. Types of sensitive materials: page 66, lines 34 to 36,
34. Thickness of photosensitive layer and swell speed: page 66, line 40 to page 67 line 1,
35. Back layers: page 67, lines 3 to 8,
36. Development processing summary: page 67, lines 9 to 11,
37. Developers and developing agents: page 67, lines 12 to 30,
38. Developer additives: page 67, lines 31 to 44, 39. Reversal processing: page 67, lines 45 to 56,
40. Processing solution open ratio: page 67, line 57 to page 68, line 12,
41. Development time: page 68, lines 13 to 15,
42. Bleach-fix, bleaching and fixing: page 68, line 16 to page 69 line 31,
43. Automatic processor: page 69, lines 32 to 40, 44. Washing, rinse and stabilization: page 69, line 41 to page 70 line 18,
45. Processing solution replenishment and recycling: page 70, lines 19 to 23, 46. Developing agent built-in sensitive material: page 70, lines 24 to 33,
47. Development processing temperature: page 70, lines 34 to 38, and
48. Application to lens-fitted camera: page 70, lines 39 to 41

Also, preferred use can be made of a bleaching bath containing 2-pyridinecarboxylic acid or 2,6-pyridinedicarboxylic acid, a ferric salt such as ferric nitrate, and a persulfate as described in EP 602600. When this bleaching bath is used, stop and washing steps are preferably carried out between the color development step and the bleaching step. An organic acid such as acetic acid, succinic acid or maleic acid is preferably used in the stop bath. Further, for the purpose of pH adjustment and bleach fog, an organic acid such as acetic acid, succinic acid, maleic acid, glutaric acid or adipic acid is preferably added to the bleaching bath in an amount of 0.1 to 2 mol/liter (hereinafter, liter is also referred to as "L").

EXAMPLE

The present invention will be described in greater detail below with reference to the following Examples, which, however, in no way limit the scope of the present invention.

Example 1

(Preparation of Emulsion A-1)

A 1:1 (silver molar ratio) mixture of cubic large size emulsion A1 of 0.70 $\mu$m average grain size and small size emulsion A2 of 0.50 $\mu$m average grain size was prepared, and designated emulsion A-1.

The variation coefficients of the grain size distribution of emulsions A1 and A2 were 0.09 and 0.11, respectively. In both the large size and small size emulsions, 0.5 mol % of silver bromide was localized in part of the surface of grains of silver chloride base. Potassium hexachloroiridate (IV) was incorporated in silver bromide localized phases. At portion of the grains which, extending from the outermost surface layer, corresponds to 10% volume, iodide ions were caused to be present in an amount of 0.1 mol % based on the total halogen. This portion was doped with $K_4Ru(CN)_6$, yellow prussiate and $K_2IrCl_5(H_2O)$ in amounts of $1\times10^{-5}$ mol, $1\times10^{-6}$ mol and $1\times10^{-6}$ mol, respectively, based on the total molar amount of silver.

For the thus obtained emulsion, a spectral sensitization was carried out by adding each of the following blue-sensitive sensitizing dyes A and B in an amount of $3.2\times10^{-4}$ mol per mole of silver with respect to the emulsion A1 and $4.4\times10^{-4}$ mol per mole of silver with respect to the emulsion A2. Further, the optimum chemical sensitization thereof was carried out with the use of sodium thiosulfate pentahydrate and chloroauric acid.

Sensitizing dye A

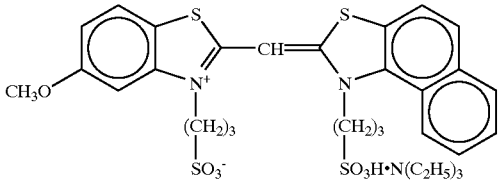

-continued

Sensitizing dye B

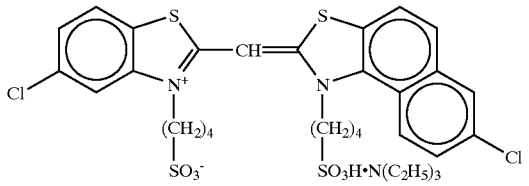

(Preparation of Emulsion B)

A 1:3 (silver molar ratio) mixture of cubic large size emulsion B1 of 0.45 $\mu$m average grain size and small size emulsion B2 of 0.35 $\mu$m average grain size was prepared. The variation coefficients of the grain size distribution of emulsions B1 and B2 were 0.10 and 0.08, respectively. In both the large size and small size emulsions, 0.01 mol % of silver iodide was contained in the vicinity of grain surfaces, and 0.4 mol % of silver bromide was localized in grain surfaces (localized in corner portions of cube, hereinafter also referred to as "Epi. localized phase"). Potassium hexachloroiridate (IV) was incorporated in silver bromide localized phases. Doping with $K_4Ru(CN)_6$, yellow prussiate and $K_2IrCl_5(H_2O)$ was carried out in the same manner as in the preparation of emulsion A-1.

(Preparation of Emulsion C)

A 1:1 (silver molar ratio) mixture of cubic large size emulsion C1 of 0.40 $\mu$m average grain size and small size emulsion C2 of 0.30 $\mu$m average grain size was prepared. The variation coefficients of the grain size distribution of emulsions C1 and C2 were 0.09 and 0.11, respectively. In both the large size and small size emulsions, 0.01 mol % of silver iodide was contained in the vicinity of grain surfaces, and 0.8 mol % of silver bromide was localized in grain surfaces. Potassium hexachloroiridate (IV) was incorporated in silver bromide localized phases. Doping with $K_4Ru(CN)_6$, yellow prussiate and $K_2IrCl_5(H_2O)$ was carried out in the same manner as in the preparation of emulsion A-1.

Corona discharge was performed on the surfaces of a support formed by coating the two surfaces of a paper sheet with polyethylene resin. After that, a gelatin undercoating layer containing sodium dodecylbenzenesulfonate was formed. In addition, first to seventh photographic constituting layers were sequentially formed by coating, thereby manufacturing a sample (101) of a silver halide color light-sensitive material having the following layer arrangement. Coating solutions of the individual photographic constituting layers were prepared as follows.

Preparation of the First Layer Coating Solution 57 g of a yellow coupler (ExY), 7 g of a color image stabilizer (Cpd-1), 4 g of a color image stabilizer (Cpd-2), 7 g of a color image stabilizer (Cpd-3), 2 g of a color image stabilizer (Cpd-8) were dissolved in 21 g of a solvent (Solv-1) and 80 mL of ethyl acetate. The resultant solution was emulsion-dispersed in 220 g of an aqueous 23.5 wt. % gelatin solution containing 4 g of sodium dodecylbenzenesulfonate with a high-speed dissolver, and water was added to prepare 900 g of Emulsified dispersion A.

Separately, the emulsified dispersion A and Emulsion A-1 were mixed to dissolve, thereby prepared 1st layer coating solution so that the composition thereof becomes as set forth below. The emulsion coating amount indicates the coating amount in terms of silver.

Coating solutions of the second to seventh layers were also prepared following the same procedures as for the first layer coating solution. As gelatin hardeners in the individual layers, 1-oxy-3,5-dichloro-s-triazine sodium salt, compounds (H-1), (H-2) and (H-3) were used. Also, Ab-1, Ab-2, Ab-3 and Ab-4 were added in total amounts of 15.0, 60.0, 5.0 and 10.0 mg/m$^2$, respectively, to each layer.

(H-1) Hardener

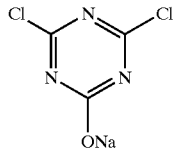

Used in an amount of 1.4 wt. % per gelatin (H-2) Hardener

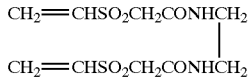

(H-3) Hardener

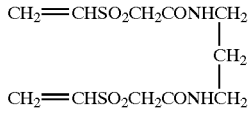

(Ab-1) Antiseptic

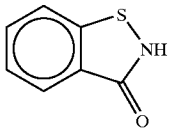

(Ab-2) Antiseptic

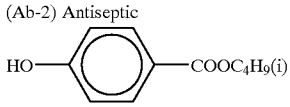

-continued (Ab-3) Antiseptic

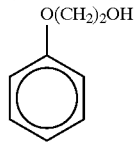

(Ab-4) Antiseptic

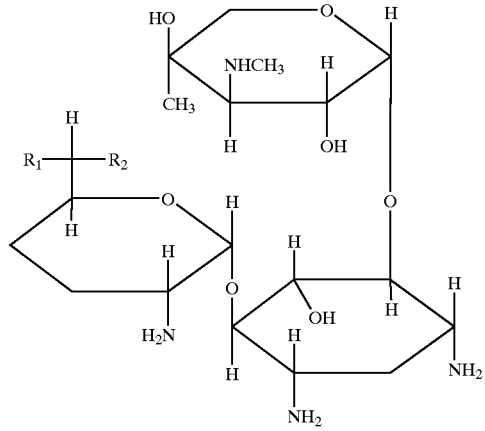

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

A mixture of a, b, c, and d in a molar ratio of 1:1:1:1.

The following sensitizing dyes were used for the silver chlorobromide emulsions in the green- and red-sensitive emulsion layers.

<Green-Sensitive Emulsion Layer>

(Spectral sensitizer D)

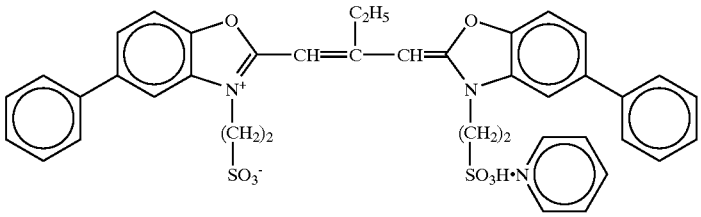

(Spectral sensitizer E)

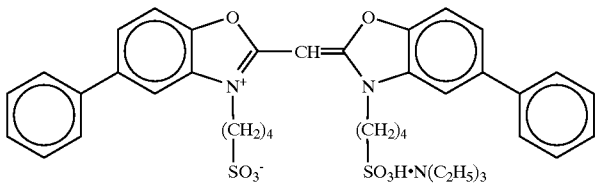

-continued (Spectral sensitizer F)

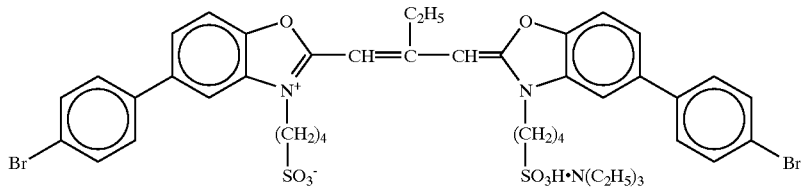

(A sensitizing dye D was added in amounts of $3.0\times10^{-4}$ mol and $3.6\times10^{-4}$ mol, per mol of a silver halide, to the large-size emulsion and the small-size emulsion, respectively. A sensitizing dye E was added in amounts of $4.0\times10^{-5}$ mol and $7.0\times10^{-5}$ mol, per mol of a silver halide, to the large-size emulsion and the small-size emulsion, respectively. A sensitizing dye F was added in amounts of $2.0\times10^{-4}$ mol and $2.8\times10^{-4}$ mol, per mol of a silver halide, to the large-size emulsion and the small-size emulsion, respectively.)

<Red-Sensitive Emulsion Layer>

(Spectral sensitizer G)

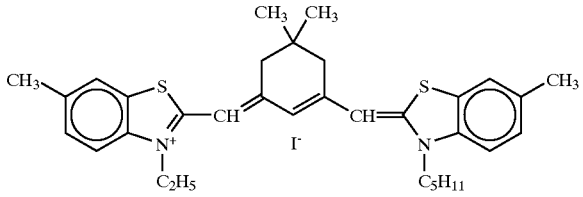

(Spectral sensitizer H)

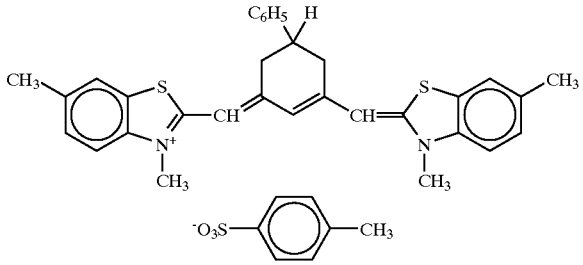

(Each of sensitizing dyes G and H was added in amounts of $8.0\times10^{-5}$ mol and $10.7\times10^{-5}$ mol, per mol of a silver halide, to the large-size emulsion and the small-size emulsion, respectively.)

In addition, a compound I presented below was added in an amount of $3.0\times10^{-3}$ mol, per mol of a silver halide, to the red-sensitive layer.

(Compound I)

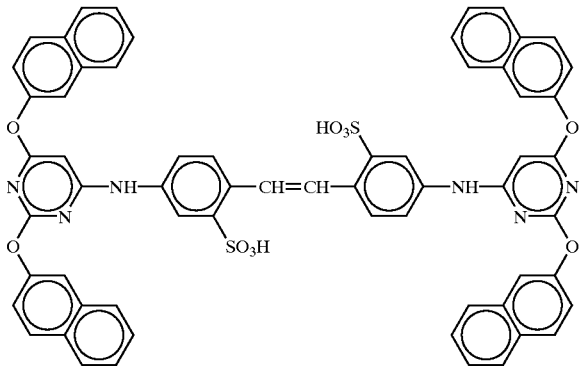

Also, to each of the green- and red-sensitive emulsion layers, 1-(3-methylureidophenyl)-5-mercaptotetrazole was added in amounts of $1.0\times10^{-3}$ mol and $5.9\times10^{-4}$ mol, respectively, per mol of a silver halide.

Furthermore, 0.2, 0.2, 0.6 and 0.1 mg/m$^2$ of the same compound were added to the second, fourth, sixth, and seventh layers, respectively.

To the blue- and green-sensitive emulsion layers, $1\times10^{-4}$ mol and $2\times10^{-4}$ mol, respectively, of 4-hydroxy-6-methyl-1,3,3a,7-tetrazaindene were added per mol of a silver halide.

0.05 g/m$^2$ of a copolymer latex (weight ratio 1:1, average molecular weight 200,000 to 400,000) of methacrylic acid and butyl acrylate was added to the red-sensitive emulsion layer.

Disodium catechol-3,5-disulfonate was added in amounts of 6, 6 and 18 mg/m$^2$ to the second, fourth, and sixth layers, respectively.

To prevent irradiation, the following dyes were added (the numbers in parentheses indicate the coating amounts).

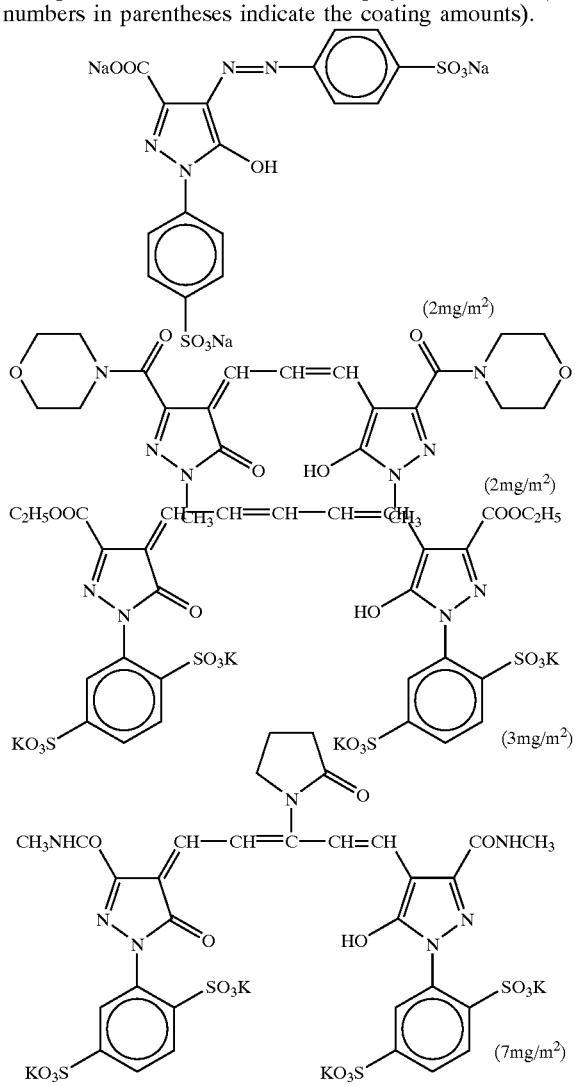

(Layer Arrangement)

The composition of each layer will be described below. The numbers represent coating amounts (g/m$^2$). The coating amount of each silver halide emulsion is represented by the coating amount in terms of silver. The effects of the additives listed below are not limited to the indicated purposes.

Support

Polyethylene Resin Laminate Paper

{Polyethylene resin on the first layer side contained a white pigment ($TiO_2$; content 16 wt %, ZnO; content 4 wt %), a fluorescent brightening agent (4,4'-bis-(5-methylbenzoxazolyl)stilbene; content 0.03 wt %), and a blue dye (ultramarine)}.

| | |
|---|---|
| 1st layer (Blue-sensitive emulsion layer) | |
| Emulsion A-1 | 0.24 |
| Gelatin | 1.25 |
| Yellow coupler (ExY) | 0.57 |
| Color image stabilizer (Cpd-1) | 0.07 |
| Color image stabilizer (Cpd-2) | 0.04 |
| Color image stabilizer (Cpd-3) | 0.07 |
| Color image stabilizer (Cpd-8) | 0.02 |
| Solvent (Solv-1) | 0.21 |
| 2nd layer (Anti-color mixing layer) | |
| Gelatin | 0.99 |
| Anti-color mixing agent (Cpd-4) | 0.09 |
| Color image stabilizer (Cpd-5) | 0.018 |
| Color image stabilizer (Cpd-6) | 0.13 |
| Color image stabilizer (Cpd-7) | 0.01 |
| Solvent (Solv-1) | 0.06 |
| Solvent (Solv-2) | 0.22 |
| 3rd layer (Green-sensitive emulsion layer) | |
| Silver chlorobromide emulsion B (gold-sulfur-sensitized cubic, a 1:3 mixture (silver molar ratio) of a large-size emulsion having an average grain size of 0.45 μm and a small-size emulsion having that of 0.35 μm; variation coefficients of grain size distributions of the two emulsions were 0.10 and 0.08; in both of the emulsions, 0.01 mol % of silver iodide was contained in the vicinity of grain surfaces, and 0.4 mol % of silver bromide was localized on the grain surfaces) | 0.14 |
| Gelatin | 1.36 |
| Magenta coupler (ExM) | 0.15 |
| Ultraviolet absorber (UV-A) | 0.14 |
| Color image stabilizer (Cpd-2) | 0.02 |
| Color image stabilizer (Cpd-4) | 0.002 |
| Color image stabilizer (Cpd-6) | 0.09 |
| Color image stabilizer (Cpd-8) | 0.02 |
| Color image stabilizer (Cpd-9) | 0.03 |
| Color image stabilizer (Cpd-10) | 0.01 |

-continued

| | |
|---|---|
| Color image stabilizer (Cpd-11) | 0.0001 |
| Solvent (Solv-3) | 0.11 |
| Solvent (Solv-4) | 0.22 |
| Solvent (Solv-5) | 0.20 |
| 4th layer (Anti-color mixing layer) | |
| Gelatin | 0.71 |
| Anti-color mixing agent (Cpd-4) | 0.06 |
| Color image stabilizer (Cpd-5) | 0.013 |
| Color image stabilizer (Cpd-6) | 0.10 |
| Color image stabilizer (Cpd-7) | 0.007 |
| Solvent (Solv-1) | 0.04 |
| Solvent (Solv-2) | 0.16 |
| 5th layer (Red-sensitive emulsion layer) | |
| Silver chlorobromide emulsion C (gold-sulfur-sensitized cubic, a 5:5 mixture (silver molar ratio) of a large-size emulsion having an average grain size of 0.40 μm and a small-size emulsion having that of 0.30 μm; variation coefficients of grain size distributions of the two emulsions were 0.09 and 0.11, respectively; in both of the emulsions, 0.01 mol % of silver iodide was contained in the vicinity of the grain surfaces and 0.8 mol % of silver bromide was localized on the grain surfaces) | 0.12 |
| Gelatin | 1.11 |
| Cyan coupler (ExC-2) | 0.13 |
| Cyan coupler (ExC-3) | 0.03 |
| Color image stabilizer (Cpd-1) | 0.05 |
| Color image stabilizer (Cpd-6) | 0.06 |
| Color image stabilizer (Cpd-7) | 0.02 |
| Color image stabilizer (Cpd-9) | 0.04 |
| Color image stabilizer (Cpd-10) | 0.01 |
| Color image stabilizer (Cpd-14) | 0.01 |
| Color image stabilizer (Cpd-15) | 0.12 |
| Color image stabilizer (Cpd-16) | 0.03 |
| Color image stabilizer (Cpd-17) | 0.09 |
| Color image stabilizer (Cpd-18) | 0.07 |
| Solvent (Solv-5) | 0.15 |
| Solvent (Solv-8) | 0.05 |
| 6th layer (Ultraviolet-absorbing layer) | |
| Gelatin | 0.46 |
| Ultraviolet absorber (UV-B) | 0.45 |
| Compound (S1-4) | 0.0015 |
| Solvent (Solv-7) | 0.25 |
| 7th layer (Protective layer) | |
| Gelatin | 1.00 |
| Acryl-modified copolymer of polyvinyl alcohol (modification degree 17%) | 0.04 |
| Liquid paraffin | 0.02 |
| Surfactant (Cpd-13) | 0.01 |

(ExY) Yellow Couplers: a Mixture of

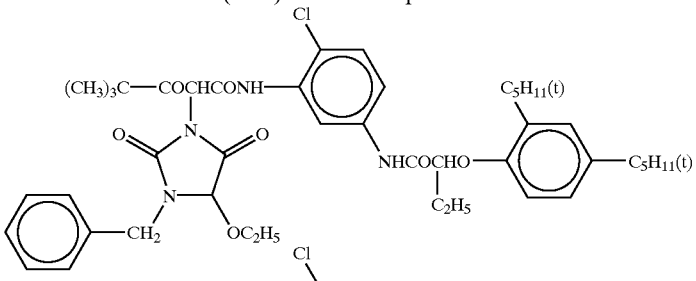

and

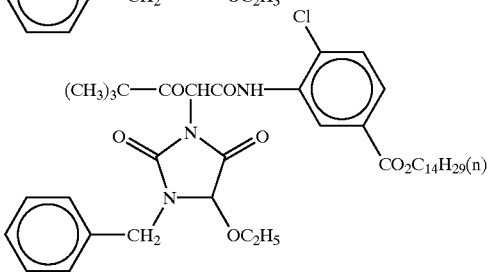

in a molar ratio of 70:30
(ExM) Magenta Couplers: a Mixture of
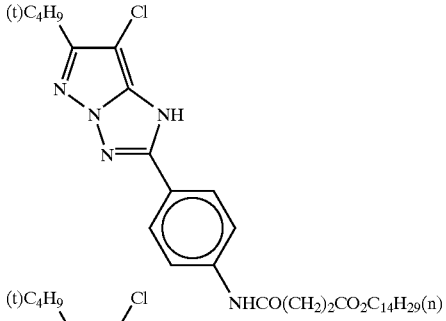
and
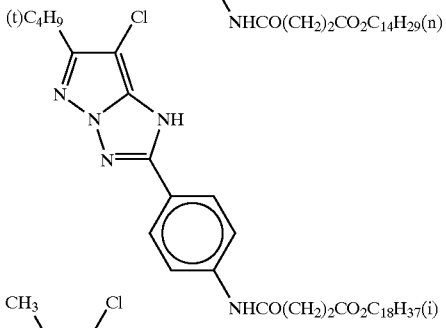
and
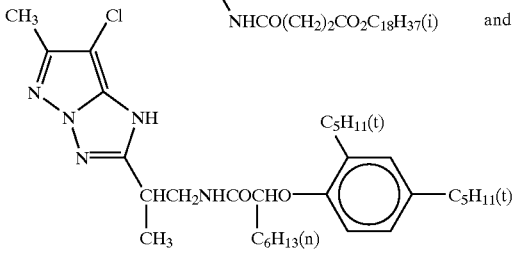
in a molar ratio of 40:40:20
(ExC-2) Cyan Coupler
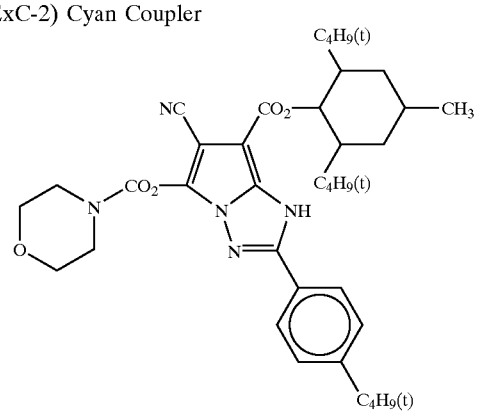
(ExC-3) Cyan Couplers: a Mixture of
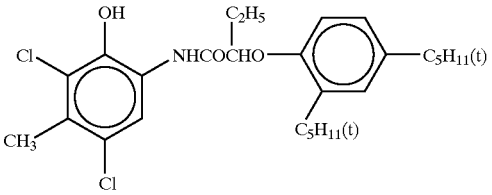
and
-continued
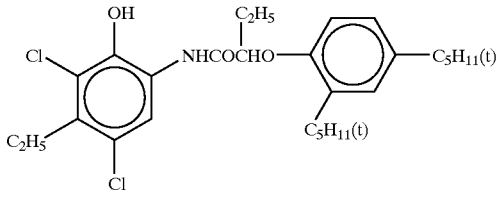
and
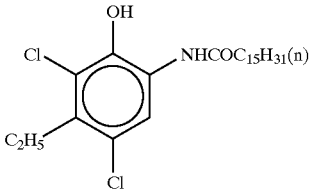
in a molar ratio of 50:25:25
(Cpd-1) Color Image Stabilizer
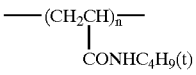
Number average molecular weight: 60,000
(Cpd-2) Color Image Stabilizer
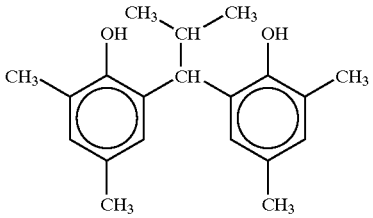
(Cpd-3) Color Image Stabilizer
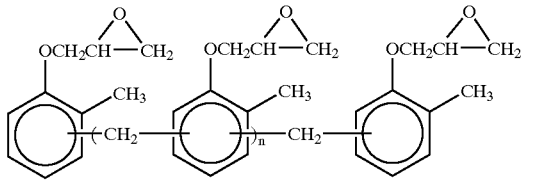
$n$ = 7–8 (Average)
(Cpd-4) Anti-Color Mixing Agent
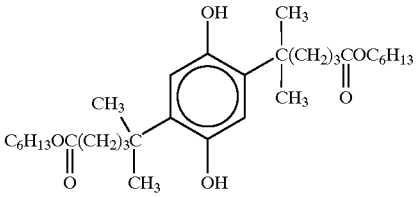
(Cpd-5) Color Image Stabilizer
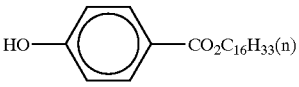

(Cpd-6) Color Image Stabilizer
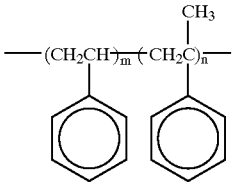
Number average molecular weight:600 m/n=10/90
(Cpd-7) (Cpd-8)
Color Image Stabilizer Color Image Stabilizer
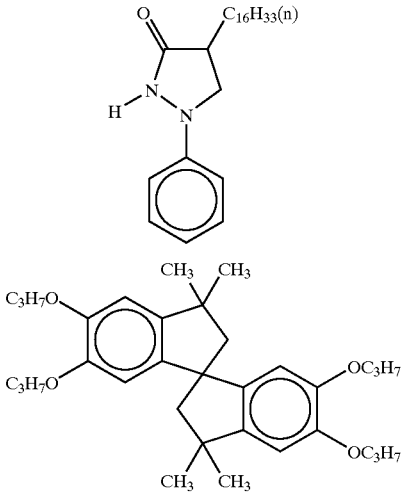
(Cpd-9) (Cpd-10)
Color Image Stabilizer Color Image Stabilizer
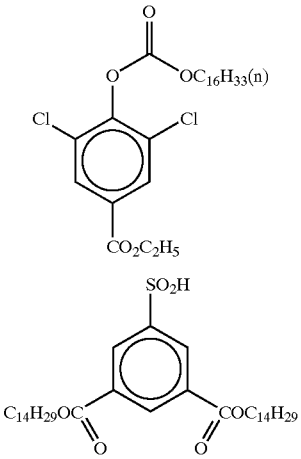
-continued
(Cpd-11)
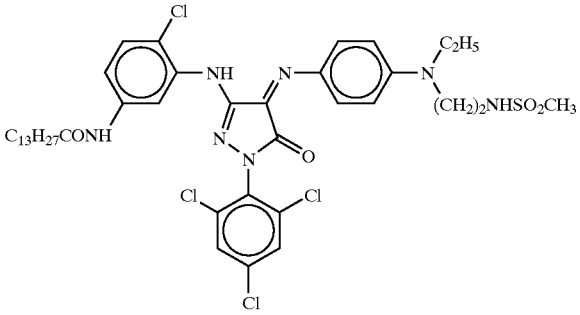
(Cpd-13) Surfactants: a Mixture of
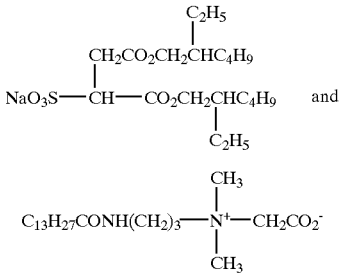
and
in a molar ratio of 7:3
(Cpd-14)
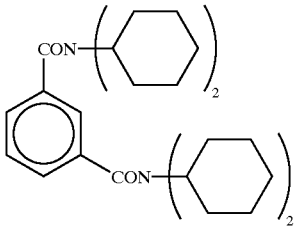
(Cpd-15)
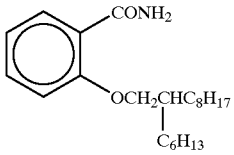
(Cpd-16)
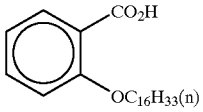
(Cpd-17)
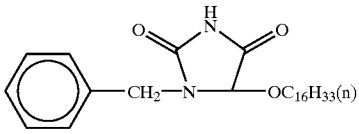

-continued (Cpd-18)

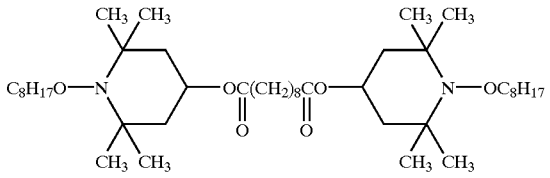

(Cpd-19) Anti-Color Mixing Agent

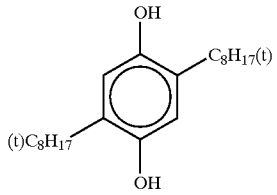

(UV-1)

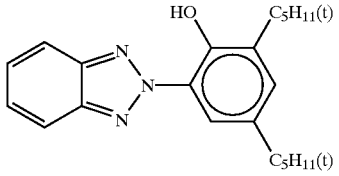

Ultraviolet absorber (UV-2)

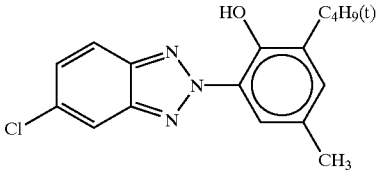

Ultraviolet absorber (UV-3)

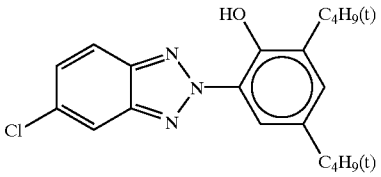

Ultraviolet absorber (UV-4)

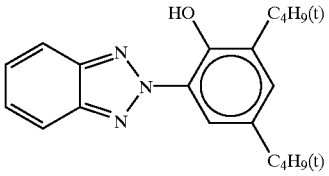

Ultraviolet absorber (UV-5)

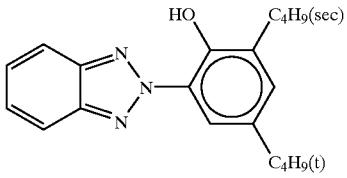

Ultraviolet absorber

-continued (UV-6)

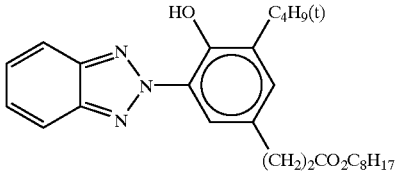

Ultraviolet absorber (UV-7)

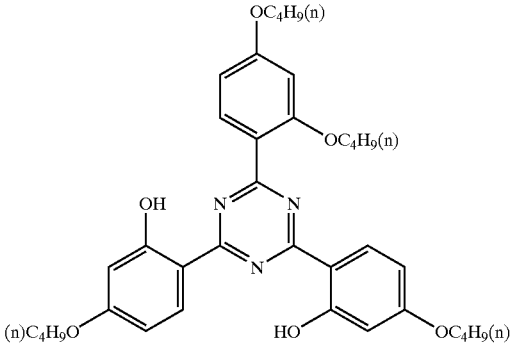

Ultraviolet absorber

UV-A: a mixture of UV-1/UV-2/UV-3/UV-4 = 4/2/2/3 (wt. ratio)
UV-B: a mixture of UV-1/UV-2/UV-3/UV-4/UV-5/UV-6 = 9/3/3/4/5/3 (wt. ra tio)
UV-C: a mixture of UV-2/UV-3/UV-6/UV-7 = 1/1/1/2 (wt. ratio)

(Solv-1)

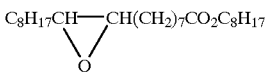

(Solv-2)

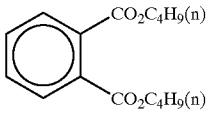

(Solv-3)

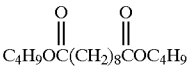

(Solv-4)

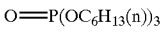

(Solv-5)

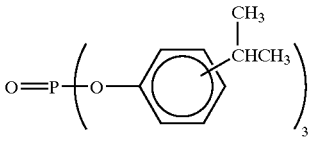

(Solv-7)

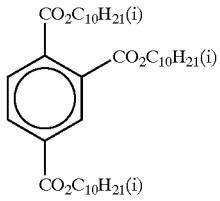

(Solv-8)

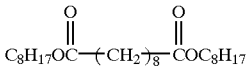

-continued (S1-4)

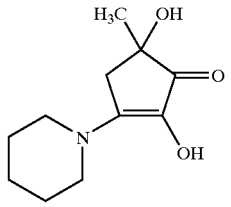

Samples (102) to (120) were prepared in the same manner as in the preparation of sample (101) except that the iodide content, bromide content, position where bromide is present and addition of compound of the general formula (I) at the completion of chemical sensitization with respect to the emulsion of the first layer of sample (101) were changed as specified in Table 3.

TABLE 3

| Sample No. | Remarks | Emulsion in the 1st layer | Iodide content mol % | Bromide content mol % | Bromide presence position | Compound | Addition amount |
|---|---|---|---|---|---|---|---|
| (101) | Comp. | A-1 | 0.1 | 0.5 | Epi. localized phase | none | none |
| (102) | Inv. | A-2 | 0.1 | 0.5 | Epi. localized phase | 1 | $1.25 \times 10^{-4}$ |
| (103) | Inv. | A-3 | 0.1 | 0.5 | Epi. localized phase | 1 | $5.00 \times 10^{-4}$ |
| (104) | Inv. | A-3 | 0.1 | 0.5 | Epi. localized phase | 6 | $5.00 \times 10^{-4}$ |
| (105) | Inv. | A-3 | 0.1 | 0.5 | Epi. localized phase | 8 | $5.00 \times 10^{-4}$ |
| (106) | Inv. | A-3 | 0.1 | 0.5 | Epi. localized phase | 13 | $5.00 \times 10^{-4}$ |
| (107) | Inv. | A-3 | 0.1 | 0.5 | Epi. localized phase | 22 | $5.00 \times 10^{-4}$ |
| (108) | Inv. | A-3 | 0.1 | 0.5 | Epi. localized phase | 23 | $5.00 \times 10^{-4}$ |
| (109) | Inv. | A-3 | 0.1 | 0.5 | Epi. localized phase | 35 | $5.00 \times 10^{-4}$ |
| (110) | Inv. | A-3 | 0.1 | 0.5 | Epi. localized phase | 73 | $5.00 \times 10^{-4}$ |
| (111) | Comp. | A-4 | 0.1 | 0.5 | 80–90% homogeneous region | none | none |
| (112) | Inv. | A-5 | 0.1 | 0.5 | 80–90% homogeneous region | 1 | $1.25 \times 10^{-4}$ |
| (113) | Inv. | A-6 | 0.1 | 0.5 | 80–90% homogeneous region | 1 | $5.00 \times 10^{-4}$ |
| (114) | Inv. | A-6 | 0.1 | 0.5 | 80–90% homogeneous region | 6 | $5.00 \times 10^{-4}$ |
| (115) | Inv. | A-6 | 0.1 | 0.5 | 80–90% homogeneous region | 8 | $5.00 \times 10^{-4}$ |
| (116) | Inv. | A-6 | 0.1 | 0.5 | 80–90% homogeneous region | 13 | $5.00 \times 10^{-4}$ |
| (117) | Inv. | A-6 | 0.1 | 0.5 | 80–90% homogeneous region | 22 | $5.00 \times 10^{-4}$ |
| (118) | Inv. | A-6 | 0.1 | 0.5 | 80–90% homogeneous region | 23 | $5.00 \times 10^{-4}$ |
| (119) | Inv. | A-6 | 0.1 | 0.5 | 80–90% homogeneous region | 35 | $5.00 \times 10^{-4}$ |
| (120) | Inv. | A-6 | 0.1 | 0.5 | 80–90% homogeneous region | 73 | $5.00 \times 10^{-4}$ |

In Table 3, "80–90% homogeneous region" described in the column heading with "Bromide presence position" means that bromide is present uniformly in a region corresponding to 80–90% of silver during the course of grain formation, provided that the amount of silver of completed grains is 100%. "Epi. localized phase" described in the column heading with "Bromide presence position" means that bromide is localized in the corner portions of the grain surface.

The position where potassium hexachloroiridate (IV) is present was in silver bromide localized phases, i.e., Epi. Localized phase, with respect to the emulsions A-1 to A-3, and in 80 to 90% homogeneous region with respect to the emulsions A-4 to A-6.

The following experiments were performed in order to investigate the photographic performance of these samples.

Experiment 1 Sensitometry

Each coated sample was subjected to gradation exposure for sensitometry using sensitometer (model FWH manufactured by Fuji Photo Film Co., Ltd.). The sensitometer was fitted with filter SP-1, and exposure of low illumination intensity was performed for 10 sec.

After the exposure, the following color development processing A was performed.

The processing operations were as follows.

<Processing A>

The above lightsensitive material (101) was processed into 127 mm wide rolls. With the use of an experimental processor being a modification of Minilabo Printer Processor PP350 manufactured by Fuji Photo Film Co., Ltd., lightsensitive material samples were imagewise exposed through a negative film of average density and subjected to continuous processing (running test) through the following steps until reaching 0.5-fold of the color development tank capacity. The processing using the running baths was designated processing A.

| Processing Step | Temperature | Time ment | Replenish-rate* |
|---|---|---|---|
| Color development | 45.0° C. | 15 sec | 45 mL |
| Bleach-fixing | 40.0° C. | 15 sec | 35 mL |
| Rinsing (1) | 40.0° C. | 8 sec | — |
| Rinsing (2) | 40.0° C. | 8 sec | — |
| Rinsing (3) | **40.0° C. | 8 sec | — |
| Rinsing (4) | **38.0° C. | 8 sec | 121 mL |
| Drying | 80.0° C. | 15 sec | |

*The replenishment rate per $m^2$ of a light-sensitive material.

**The RC50D rinse cleaning system manufactured by Fuji Photo Film Co., Ltd. was installed in rinsing (3) to extract a rinsing solution from rinsing (3), and the solution was supplied to a reverse osmotic membrane module (RC50D) by a pump. Transmitted water obtained in this tank was supplied to rinsing (4), and concentrated water was returned to rinsing (3). The pump pressure was so adjusted that the transmitted water amount to the reverse osmotic module was kept at 50 to 300 mL/min. The water was circulated at controlled temperature ten hours a day (rinsing was performed by a tank counterflow system from (1) to (4)).

The compositions of the individual processing solutions were as follows.

| | <tank solution> | <replenisher> |
|---|---|---|
| <Color developer> | | |
| Water | 800 mL | 800 mL |
| Fluorescent brightening agent (FL-1) | 5.0 g | 8.5 g |
| Tri (isopropanol) amine | 8.8 g | 8.8 g |
| Sodium p-toluenesulfonate | 20.0 g | 20.0 g |
| Sodium sulfite | 0.10 g | 0.50 g |
| Ethylen diamine tetra-acetic acid | 4.0 g | 4.0 g |
| Potassium chloride | 10.0 g | — |
| Sodium 4,5-dihydroxybenzene-1,3-disulfonate | 0.50 g | 0.50 g |
| Disodium-N,N-bis(sulfonatoethyl)hydroxylamine | 8.5 g | 14.5 g |
| N-ethyl-N-(β-methanesufonamidoethyl)-3-methyl-4-amino-4-aminoaniline.3/2sulfuric acid.monohydrate | 10.0 g | 22.0 g |
| Potassium carbonate | 26.3 g | 26.3 g |
| Water to make | 1,000 mL | 1,000 mL |
| pH (25° C./adjusted by potassium hydroxide and sulfuric acid) | 10.35 | 12.60 |
| <Bleach-fixing solution> | | |
| Water | 800 mL | 800 mL |
| Ammonium thiosulphate (750 g/L) | 107.0 mL | 214.0 mL |
| Succinic acid | 29.5 g | 59.0 g |
| Ethylenediaminetetra-acetate Iron (III) ammonium | 47.0 g | 94.0 g |
| Ethylenediaminetetra-acetic acid | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Ammonium bisulfite | 23.1 g | 46.2 g |
| Water to make | 1,000 mL | 1,000 mL |
| pH (25° C./adjusted by nitric acid and ammonia) | 6.0 | 6.0 |
| <Rinsing solution> | | |
| Chlorinated sodium isocyanurate | 0.02 g | 0.02 g |
| Deionized water (conductivity 5 μs/cm or less) | 1,000 mL | 1,000 mL |
| pH | 6.5 | 6.5 |

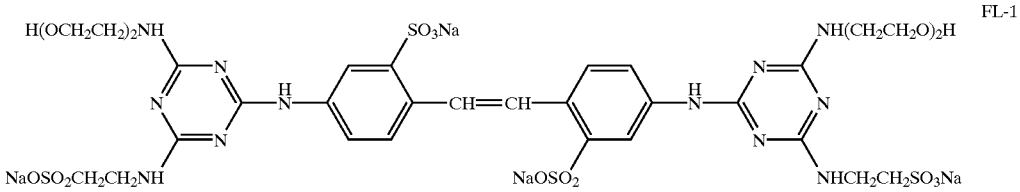

FL-1

The yellow color formation density of each of the samples after processing was measured, and the 10 sec exposure low illumination intensity speed, fog density, raw stock storability and exposure humidity dependence were determined. The results are listed in Table 4. The film speed was defined as the logarithm of exposure quantity realizing a color density which was 1.0 higher than the minimum color density, and expressed in terms of the relative value to the speed of the sample (101) after development processing regarded as reference 0. The mark, +, represents a higher speed, and the mark, –, represents a lower speed. The fog was expressed in terms of the minimum density of each of the samples. The raw stock storability was estimated by a speed difference (AS storage) between sample having been stored in a 50° C.–55% RH atmosphere for 3 days and sample having been stored in a 25° C.–55% RH atmosphere. The exposure humidity dependence was estimated by a speed difference (ΔS humidity) by the above exposure after holding lightsensitive material samples in a 25° C.–55% RH atmosphere and a 25° C.–80% RH atmosphere.

TABLE 4

| Sample No. | Remarks | Speed | Fog | ΔS storage | ΔS humidity |
|---|---|---|---|---|---|
| (101) | Comp. | Control: 0 | 0.11 | +0.12 | −0.10 |
| (102) | Inv. | −0.02 | 0.10 | +0.04 | −0.03 |
| (103) | Inv. | −0.04 | 0.10 | +0.02 | −0.02 |
| (104) | Inv. | −0.04 | 0.10 | +0.03 | −0.03 |
| (105) | Inv. | −0.04 | 0.10 | +0.02 | −0.03 |
| (106) | Inv. | −0.04 | 0.10 | +0.03 | −0.03 |
| (107) | Inv. | −0.04 | 0.10 | +0.04 | −0.04 |
| (108) | Inv. | −0.05 | 0.10 | +0.02 | −0.03 |
| (109) | Inv. | −0.05 | 0.11 | +0.04 | −0.04 |
| (110) | Inv. | −0.05 | 0.10 | +0.03 | −0.03 |
| (111) | Comp. | +0.05 | 0.10 | +0.11 | −0.10 |
| (112) | Inv. | +0.04 | 0.10 | +0.02 | −0.02 |
| (113) | Inv. | +0.04 | 0.10 | +0.02 | −0.02 |
| (114) | Inv. | +0.04 | 0.10 | +0.04 | −0.03 |
| (115) | Inv. | +0.04 | 0.10 | +0.02 | −0.02 |
| (116) | Inv. | +0.04 | 0.10 | +0.02 | −0.02 |
| (117) | Inv. | +0.04 | 0.10 | +0.04 | −0.02 |
| (118) | Inv. | +0.04 | 0.10 | +0.04 | −0.04 |
| (119) | Inv. | +0.04 | 0.10 | +0.04 | −0.04 |
| (120) | Inv. | +0.04 | 0.10 | +0.04 | −0.04 |

It is apparent from the results that the samples of the invention show lower fog, and are excellent in raw stock storability and exposure humidity dependence, compared with the comparative samples. The similar advantages as above were confirmed with Emulsion B in the 3rd layer and Emulsion C in the 5th layer.

Example 2

Samples having the following layer structure to be thin-layered were prepared and Experiment 1 of Example 1 was conducted.

The layer structure is that as in Sample (201) set forth below. Samples (202) to (220) were prepared by changing the iodide content, the bromide content and position where bromide is present, and the addition of the adsorptive reducing compound, i.e., the compound of general formula (I), at the completion of chemical sensitization with respect to the emulsion of the first layer of sample (201) were changed as specified in Table 3.

It is apparent from the results that, similar to the results in Example 1, the advantages of the present invention were confirmed with also thin-layered samples to which a super rapid processing was performed.

Preparation of Sample (201)

| | |
|---|---|
| 1st layer (Blue-sensitive emulsion layer) | |
| Emulsion A-1 | 0.24 |
| Gelatin | 1.25 |
| Yellow coupler (ExY) | 0.57 |
| Color image stabilizer (Cpd-1) | 0.07 |
| Color image stabilizer (Cpd-2) | 0.04 |
| Color image stabilizer (Cpd-3) | 0.07 |
| Color image stabilizer (Cpd-8) | 0.02 |
| Solvent (Solv-1) | 0.21 |
| 2nd layer (Anti-color mixing layer) | |
| Gelatin | 0.60 |
| Anti-color mixing agent (Cpd-19) | 0.09 |
| Color image stabilizer (Cpd-5) | 0.007 |
| Color image stabilizer (Cpd-7) | 0.007 |
| Ultraviolet absorber (UV-C) | 0.05 |
| Solvent (Solv-5) | 0.11 |
| 3rd layer (Green-sensitive emulsion layer) | |
| Silver chlorobromide emulsion B (the same emulsion as in Sample (101)) | 0.14 |
| Gelatin | 0.73 |
| Magenta coupler (ExM) | 0.15 |
| Ultraviolet absorber (UV-A) | 0.05 |
| Color image stabilizer (Cpd-2) | 0.02 |
| Color image stabilizer (Cpd-7) | 0.008 |
| Color image stabilizer (Cpd-8) | 0.07 |
| Color image stabilizer (Cpd-9) | 0.03 |
| Color image stabilizer (Cpd-10) | 0.009 |
| Color image stabilizer (Cpd-11) | 0.0001 |
| Solvent (Solv-3) | 0.06 |
| Solvent (Solv-4) | 0.11 |
| Solvent (Solv-5) | 0.06 |
| 4th layer (Anti-color mixing layer) | |
| Gelatin | 0.48 |
| Anti-color mixing agent (Cpd-4) | 0.07 |
| Color image stabilizer (Cpd-5) | 0.006 |
| Color image stabilizer (Cpd-7) | 0.006 |
| Ultraviolet absorber (UV-C) | 0.04 |
| Solvent (Solv-5) | 0.09 |
| 5th layer (Red-sensitive emulsion layer) | |
| Silver chlorobromide emulsion C (the same emulsion as in Sample (101)) | 0.12 |
| Gelatin | 0.59 |

-continued

| | |
|---|---|
| Cyan coupler (ExC-2) | 0.13 |
| Cyan coupler (ExC-3) | 0.03 |
| Color image stabilizer (Cpd-7) | 0.01 |
| Color image stabilizer (Cpd-9) | 0.04 |
| Color image stabilizer (Cpd-15) | 0.19 |
| Color image stabilizer (Cpd-18) | 0.04 |
| Ultraviolet absorber (UV-7) | 0.02 |
| Solvent (Solv-5) | 0.09 |
| 6th layer (Ultraviolet-absorbing layer) | |
| Gelatin | 0.32 |
| Ultraviolet absorber (UV-C) | 0.42 |
| Solvent (Solv-7) | 0.08 |
| 7th layer (Protective layer) | |
| Gelatin | 0.70 |
| Acryl-modified copolymer of polyvinyl alcohol (modification degree 17%) | 0.04 |
| Liquid paraffin | 0.01 |
| Surfactant (Cpd-13) | 0.01 |
| Polydimethylsiloxane | 0.01 |
| Silicon dioxide | 0.0003 |

The thus prepared samples were exposed to light in the same manner as in Experiment 1 of Example 1, and the color development processing was conducted in super rapid processing in accordance with the Development processing B set forth below.

<Processing B>

The above lightsensitive material (201) was processed into 127 mm wide rolls. After the samples were imagewise exposed, they were subjected to continuous processing (running test) through the following steps until reaching 2-fold of the color development tank capacity. The processing using the running baths was designated processing B. Remodeled minilabprinter processor PP1258AR manufactured by Fuji Photo Film Co., Ltd. so that the conveying speed is enhanced in order to shorten the processing step time.

| Processing Step | Temperature | Time ment | Replenish-rate* |
|---|---|---|---|
| Color development | 45.0° C. | 12 sec | 45 mL |
| Bleach-fixing | 40.0° C. | 12 sec | 35 mL |
| Rinsing (1) | 40.0° C. | 4 sec | — |
| Rinsing (2) | 40.0° C. | 4 sec | — |
| Rinsing (3) | **40.0° C. | 4 sec | — |
| Rinsing (4) | **40.0° C. | 4 sec | 121 mL |

*The replenishment rate per $m^2$ of a light-sensitive material.
**The RC50D rinse cleaning system manufactured by Fuji Photo Film Co., Ltd. was installed in rinsing (3) to extract a rinsing solution from rinsing (3), and the solution was supplied to a reverse osmotic membrane module (RC50D) by a pump. Transmitted water obtained in this tank was supplied to rinsing (4), and concentrated water was returned to rinsing (3). The pump pressure was so adjusted that the transmitted water amount to the reverse osmotic module was kept at 50 to 300 mL/min. The water was circulated at controlled temperature ten hours a day (rinsing was performed by a tank counterflow system from (1) to (4)).

The compositions of the individual processing solutions were as follows.

| <Color developer> | <tank solution> | <replenisher> |
|---|---|---|
| Water | 800 mL | 800 mL |
| Dimethylpolysiloxane-based surfactant (SILICONE KF351A/Shin-Etsu Chemical Co., Ltd.) | 0.1 g | 0.1 g |
| Tri (isopropanol) amine | 8.8 g | 8.8 g |
| Ethylenediaminetetraacetic acid | 4.0 g | 4.0 g |
| Polyethyleneglycol (molecular weight 300) | 10.0 g | 10.0 g |
| Sodium 4,5-dihydroxybenzene-1,3-disulfonate | 0.5 g | 0.5 g |
| Potassium chloride | 10.0 g | — |
| Potassium bromide | 0.040 g | 0.010 g |
| Triazinylaminostilbene-based fluorescent brightening agent (HAKKOL FWA-SF/Showa Chemical Industry Co., Ltd.) | 2.5 g | 5.0 g |
| Sodium sulfite | 0.1 g | 0.1 g |
| Disodium-N,N-bis(sulfonatoester)hydroxylamine | 8.5 g | 11.1 g |
| N-ethyl-N-(β-methanesufoneamidoethyl)-3-methyl-4-amino-4-aminoaniline.3/2sulfuric acid.monohydrate | 10.0 g | 22.0 g |
| Potassium carbonate | 26.3 g | 26.3 g |
| Water to make | 1,000 mL | 1,000 mL |
| pH (25° C./adjusted by potassium hydroxide and sulfuric acid) | 10.15 | 12.50 |

| <Bleach-fixing solution> | <tank solution> | <replenisher> |
|---|---|---|
| Water | 700 mL | 600 mL |
| Ethylenediaminetetraacetate Iron (III) ammonium | 75.0 g | 150.0 g |
| Ethylenediaminetetraacetic acid | 1.4 g | 2.8 g |
| m-Carboxybenzenesulfinic acid | 8.3 g | 16.5 g |
| Nitric acid (67%) | 16.5 g | 33.0 g |
| Imidazole | 14.6 g | 29.2 g |
| Ammonium thiosulfate (750 g/L) | 107.0 mL | 214.0 mL |
| Ammonium sulfite | 16.0 g | 32.0 g |
| Ammonium bisulfite | 23.1 g | 46.2 g |
| Water to make | 1,000 mL | 1,000 mL |
| pH (25° C./adjusted by acetic acid and ammonia) | 5.5 | 5.2 |

| <Rinsing solution> | <tank solution> | <replenisher> |
|---|---|---|
| Chlorinated sodium isocyanurate | 0.02 g | 0.02 g |
| Deionized water (conductivity 5 μs/cm or less) | 1,000 mL | 1,000 mL |
| pH | 6.0 | 6.0 |

Example 3

Using samples (201) to (220), image formation by laser scanning exposure was carried out.

As the laser beam source, use was made of 473 nm taken out by wavelength conversion of YAG solid laser (oscillation wavelength 946 nm) having semiconductor laser GaAlAs (oscillation wavelength 808.5 nm) as exciting beam source by means of SHG crystal of $LiNbO_3$ having a reversal domain structure; 532 nm taken out by wavelength conversion of $YVO_4$ solid laser (oscillation wavelength 1064 nm) having semiconductor laser GaAlAs (oscillation wavelength 808.7 nm) as exciting beam source by means of SHG crystal of $LiNbO_3$ having a reversal domain structure; and AlGaInP (oscillation wavelength about 680 nm; type No. LN9R20 manufactured by Matsushita Electric Industrial Co., Ltd.). Each of triple color laser beams was moved perpendicularly to scanning direction by a polygon mirror so as to enable sequential scanning exposure over samples. The variation of semiconductor laser beam quantity by temperature was restrained by holding the temperature constant with the use of Peltier element. The effective beam diameter was 80 μm, the scanning pitch 42.3 μm (600 dpi), and the average exposure time per pixel $1.7\times10^{-7}$ sec.

After the exposure, processing was performed in accordance with the color development processing B. Consequently, like the results of the high illumination intensity exposure in Example 2, it was found that the samples (202) to (210) and (212) to (220) according to the present invention were also suitable to the image formation using the laser scanning exposure.

Example 4

The estimation of photographic performance as described in Example 1 of JP-A-5-216152 was carried out with respect to the compounds 1, 6, 8, 13, 22, 23, 35 and 73 of the present invention. As a result, it was found that, like the hydrazine compounds as described in JP-A-5-216152, the compounds of the present invention could reduce fogging and improve desensitization by sensitizing dyes, known as dye desensitization (SB).

Example 5

Sample 101 described in Example 1 of JP-A-11-282117 and samples 102 to 105 respectively loaded with comparative compounds (com-1 to com-4) were prepared in the same manner as described therein, and designated samples 301 to 305, respectively. Further, samples 306 to 310 wherein compounds represented by the general formula (I) of the present invention were used in place of the compounds represented by the general formula (S1) of JP-A-11-282117 were prepared. Specifically, these samples were prepared in exactly the same manner as in the preparation of sample 301 except that the compounds specified in Table 5 were added to the 9th, 10th, 11th, 14th and 15th layers of sample 301 in amounts of $5.0\times10^{-2}$ mmol/m$^2$, $12.5\times10^{-2}$ mmol/m$^2$, $8.0\times10^{-2}$ mmol/m$^2$, $5.0\times10^{-2}$ mmol/m$^2$ and $13.0\times10^{-2}$ mmol/m$^2$, respectively. These samples were processed in the same manner, and the raw stock storability and latent image storability thereof were estimated. The results are listed in Table 5.

TABLE 5

| Sample | Compound added | Raw stock storability | Latent image keeping characteristics | Remarks |
|---|---|---|---|---|
| 301 | none | 0.92 | 0.86 | Comp. |
| 302 | com-1 | 0.62 | 0.64 | Comp. |
| 303 | com-2 | 0.68 | 0.70 | Comp. |
| 304 | com-3 | 0.71 | 0.75 | Comp. |
| 305 | com-4 | 0.72 | 0.74 | Comp. |
| 306 | Compound 1 of the invention | 0.15 | 0.10 | Inv. |
| 307 | Compound 6 of the invention | 0.21 | 0.13 | Inv. |
| 308 | Compound 8 of the invention | 0.17 | 0.10 | Inv. |
| 309 | Compound 23 of the invention | 0.20 | 0.13 | Inv. |
| 310 | Compound 35 of the invention | 0.19 | 0.11 | Inv. |
| 311 | Compound 2 of the invention | 0.15 | 0.10 | Inv. |
| 312 | Compound 3 of the invention | 0.15 | 0.10 | Inv. |
| 313 | Compound 4 of the invention | 0.15 | 0.10 | Inv. |
| 314 | Compound 7 of the invention | 0.16 | 0.11 | Inv. |
| 315 | Compound 10 of the invention | 0.19 | 0.12 | Inv. |
| 316 | Compound 12 of the invention | 0.16 | 0.11 | Inv. |
| 317 | Compound 77 of the invention | 0.16 | 0.10 | Inv. |
| 318 | Compound 82 of the invention | 0.16 | 0.10 | Inv. |
| 319 | Compound 84 of the invention | 0.16 | 0.11 | Inv. |
| 320 | Compound 86 of the invention | 0.18 | 0.12 | Inv. |
| 321 | Compound 87 of the invention | 0.19 | 0.12 | Inv. |

It is apparent from Table 5 that excellent raw stock storability and latent image storability can be realized by the addition of compounds of the general formula (I) of the present invention.

Example 6

Silver halide emulsion Em-A was prepared in the following manner.

(Preparation of Em-A)

1,200 mL of an aqueous solution containing 1.0 g of a low-molecular-weight gelatin whose molecular weight was 15,000 and 11.0 g of KBr was vigorously agitated while maintaining the temperature at 35° C. 30 mL of an aqueous solution containing 1.9 g of $AgNO_3$ and 30 mL of an aqueous solution containing 1.5 g of KBr and 0.7 g of a low-molecular-weight gelatin whose molecular weight was 15,000 were added by the double jet method over a period of 30 sec to thereby effect a nucleation. During the period, KBr excess concentration was held constant. 6 g of KBr was added and heated to 75° C., and the mixture was ripened. After the completion of ripening, 35 g of succinated gelatin was added. The pH was adjusted to 5.5. An aqueous solution of KBr and 150 mL of an aqueous solution containing 30 g of $AgNO_3$ were added by the double jet method over a period of 16 min. During this period, the silver potential was maintained at −25 mV against saturated calomel electrode. Further, an aqueous solution containing 110 g of $AgNO_3$ and an aqueous solution of KBr were added by the double jet method over a period of 15 min while increasing the flow rate so that the final flow rate was 1.2 times the initial flow rate. During this period, a 0.03 μm (grain size) AgI fine grain emulsion was simultaneously added while conducting a flow rate increase so that the silver iodide content was 3.8 mol %, and the silver potential was maintained at −25 mV. Still further, an aqueous solution of KBr and 132 mL of an aqueous solution containing 35 g of $AgNO_3$ were added by the double jet method over a period of 7 min. The addition of the aqueous solution of KBr was regulated so that the potential at the completion of the addition was −20 mV. The temperature was regulated to 40° C., and 5.6 g, in terms of KI, of Compound ExA-1 was added. Further, 64 mL of a 0.8 M aqueous sodium sulfite solution was added. Still further, an aqueous solution of NaOH was added to thereby increase the pH to 9.0, and held undisturbed for 4 min so that iodide ions were rapidly formed. The pH was returned to 5.5 and the temperature to 55° C., and 1 mg of sodium benzenethiosulfonate was added. Further, 13 g of lime-processed gelatin having a calcium concentration of 1 ppm was added. After the completion of the addition, an aqueous solution of KBr and 250 mL of an aqueous solution containing 70 g of $AgNO_3$ were added over a period of 20 min while maintaining the potential at 60 mV. During this period, yellow prussiate of potash was added in an amount of $1.0\times10^{-5}$ mol per mol of silver. The mixture was washed with water, and 80 g of lime-processed gelatin having a calcium concentration of 1 ppm (hereinafter also referred to as Original A) was added. The pH and pAg were adjusted at 40° C. to 5.8 and 8.7, respectively.

ExA-1

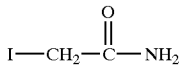

The calcium, magnesium and strontium contents of the thus obtained emulsion were measured by ICP emission spectrochemical analysis. The contents thereof were 15, 2 and 1 ppm, respectively.

The emulsion was heated to 56° C. First, 1 g, in terms of Ag, of an emulsion of 0.05 μm (grain size) pure AgBr fine grains was added to thereby effect shell covering. Subsequently, the following sensitizing dyes 1, 2 and 3 in the form of solid fine dispersion were added in respective amounts of $5.85\times10^{-4}$ mol, $3.06\times10^{-4}$ mol and $9.00\times10^{-6}$ mol per mol of silver. Under the preparative conditions specified in Table 6, inorganic salts were dissolved in ion-exchanged water, and each of the sensitizing dyes was added. Each sensitizing dye was dispersed at 60° C. for 20 min under agitation at 2,000 rpm by means of a dissolver blade. Thus, the solid fine dispersions of sensitizing dyes 1, 2 and 3 were obtained. When, after the addition of the sensitizing dyes, the sensitizing dye adsorption reached 90% of the equilibrium-state adsorption, calcium nitrate was added so that the calcium concentration became 250 ppm. The adsorption amount of the sensitizing dyes was determined by separating the mixture into a solid layer and a liquid layer (supernatant) by centrifugal precipitation and measuring the difference between the amount of initially added sensitizing dyes and the amount of sensitizing dyes present in the supernatant to thereby calculate the amount of adsorbed sensitizing dyes. After the addition of calcium nitrate, potassium thiocyanate, chloroauric acid, sodium thiosulfate, N,N-dimethylselenourea and Compound ExA-2 were added to thereby effect the optimum chemical sensitization. N,N-dimethylselenourea was added in an amount of $3.40\times10^{-6}$ mol per mol of silver. Upon the completion of the chemical sensitization, Compound 1 of the invention was added in an amount of $5.0\times10^{-4}$ mol per mol of silver, then Compounds ExA-3 and ExA-4 were added to thereby obtain emulsion Em-A.

TABLE 6
| Spectral sensitizer | Amount of spectral sensitizer | $NaNO_3$/ $Na_2SO_4$ | Water | Dispersing time | Dispersing temperature |
|---|---|---|---|---|---|
| 1 | 3 ppw | 1.8 ppw/3.2 ppw | 43 ppw | 20 min | 60° C. |
| 2/3 | 3 ppw/0.12 ppw | 0.6 ppw/2.4 ppw | 42.8 ppw | 20 min | 60° C. |
ppw = parts by weight
Spectral sensitizer 1
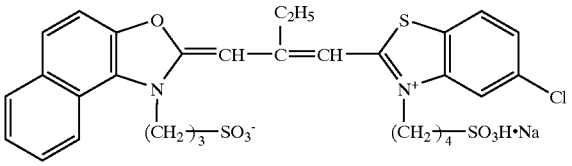
Spectral sensitizer 2
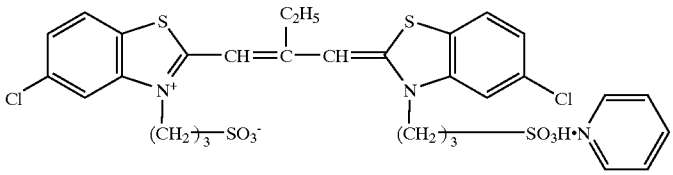
Spectral sensitizer 3
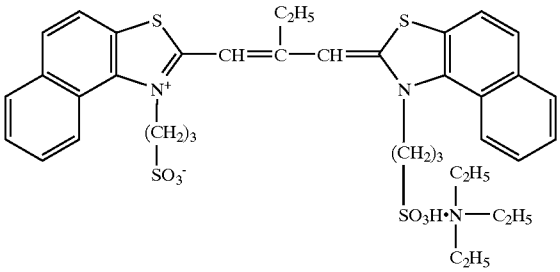
ExA-2
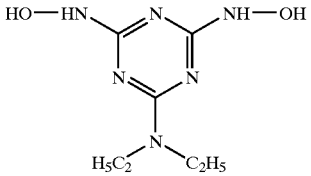
ExA-3
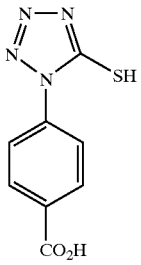
ExA-4

TABLE 6-continued

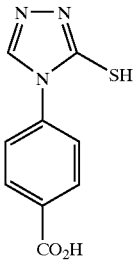

The characteristics of the emulsions used in this Example are set forth in Table 7.

TABLE 7

| Emulsion | Average iodide (mo %) | E.S.D. (μm) | Aspect ratio | E.C.D. (μm) | Grain thickness (μm) | Shape |
|---|---|---|---|---|---|---|
| Em-A | 4 | 0.92 | 14 | 2 | 0.14 | Tabular |
| Em-B | 5 | 0.8 | 12 | 1.6 | 0.13 | Tabular |
| Em-C | 4.7 | 0.51 | 7 | 0.85 | 0.12 | Tabular |
| Em-D | 3.9 | 0.37 | 2.7 | 0.4 | 0.15 | Tabular |
| Em-E | 5 | 0.92 | 14 | 2 | 0.14 | Tabular |
| Em-F | 5.5 | 0.8 | 12 | 1.6 | 0.13 | Tabular |
| Em-G | 4.7 | 0.51 | 7 | 0.85 | 0.12 | Tabular |
| Em-H | 3.7 | 0.49 | 3.2 | 0.58 | 0.18 | Tabular |
| Em-I | 2.8 | 0.29 | 1.2 | 0.27 | 0.23 | Tabular |
| Em-J | 5 | 0.8 | 12 | 1.6 | 0.13 | Tabular |
| Em-K | 3.7 | 0.47 | 3 | 0.53 | 0.18 | Tabular |
| Em-L | 5.5 | 1.4 | 9.8 | 2.6 | 0.27 | Tabular |
| Em-M | 8.8 | 0.64 | 5.2 | 0.85 | 0.16 | Tabular |

TABLE 7-continued

| Emulsion | Average iodide (mo %) | E.S.D. (μm) | Aspect ratio | E.C.D. (μm) | Grain thickness (μm) | Shape |
|---|---|---|---|---|---|---|
| Em-N | 3.7 | 0.37 | 4.6 | 0.55 | 0.12 | Tabular |
| Em-O | 1.8 | 0.19 | — | — | — | Cubic |

E.S.D. = Equivalent Spher Diameter
E.C.D. = Equivalent Circle Diameter

In Table 7, in tabular grains, dislocation lines as described in JP-A-3-237450 were observed by using high-voltage electron microscope.

Kinds and addition amounts of the sensitizing dyes used in this example are set froth in Table 8.

TABLE 8

| Emulsion | Spectral sensitizer | Addition amount (mol/molAg) |
|---|---|---|
| Em-A | Spectral sensitizer 1 | $5.85 \times 10^{-4}$ |
| | Spectral sensitizer 2 | $3.06 \times 10^{-4}$ |
| | Spectral sensitizer 3 | $9.00 \times 10^{-6}$ |
| Em-B | Spectral sensitizer 1 | $6.50 \times 10^{-4}$ |
| | Spectral sensitizer 2 | $3.40 \times 10^{-4}$ |
| | Spectral sensitizer 3 | $1.00 \times 10^{-5}$ |
| Em-C | Spectral sensitizer 1 | $7.80 \times 10^{-4}$ |
| | Spectral sensitizer 2 | $4.08 \times 10^{-4}$ |
| | Spectral sensitizer 3 | $1.20 \times 10^{-5}$ |
| Em-D | Spectral sensitizer 1 | $5.44 \times 10^{-4}$ |
| | Spectral sensitizer 2 | $2.35 \times 10^{-4}$ |
| | Spectral sensitizer 3 | $7.26 \times 10^{-6}$ |
| Em-E | Spectral sensitizer 4 | $7.73 \times 10^{-4}$ |
| | Spectral sensitizer 5 | $1.65 \times 10^{-4}$ |
| | Spectral sensitizer 6 | $6.20 \times 10^{-5}$ |
| Em-F | Spectral sensitizer 4 | $8.50 \times 10^{-4}$ |
| | Spectral sensitizer 5 | $1.82 \times 10^{-4}$ |
| | Spectral sensitizer 6 | $6.82 \times 10^{-5}$ |
| Em-G | Spectral sensitizer 4 | $1.00 \times 10^{-3}$ |
| | Spectral sensitizer 5 | $2.15 \times 10^{-4}$ |
| | Spectral sensitizer 6 | $8.06 \times 10^{-5}$ |
| Em-H | Spectral sensitizer 4 | $6.52 \times 10^{-4}$ |
| | Spectral sensitizer 5 | $1.35 \times 10^{-4}$ |
| | Spectral sensitizer 6 | $2.48 \times 10^{-5}$ |
| Em-I | Spectral sensitizer 8 | $6.09 \times 10^{-4}$ |
| | Spectral sensitizer 13 | $1.26 \times 10^{-4}$ |
| | Spectral sensitizer 6 | $2.32 \times 10^{-5}$ |
| Em-J | Spectral sensitizer 7 | $7.65 \times 10^{-4}$ |
| | Spectral sensitizer 8 | $2.74 \times 10^{-4}$ |
| Em-K | Spectral sensitizer 4 | $6.27 \times 10^{-4}$ |
| | Spectral sensitizer 5 | $2.24 \times 10^{-4}$ |

TABLE 8-continued

| | | |
|---|---|---|
| Em-L | Spectral sensitizer 9 | $1.42 \times 10^{-4}$ |
| | Spectral sensitizer 10 | $1.18 \times 10^{-4}$ |
| | Spectral sensitizer 11 | $1.03 \times 10^{-5}$ |
| Em-M | Spectral sensitizer 9 | $2.43 \times 10^{-4}$ |
| | Spectral sensitizer 10 | $2.43 \times 10^{-4}$ |
| | Spectral sensitizer 11 | $2.43 \times 10^{-4}$ |
| Em-N | Spectral sensitizer 9 | $3.28 \times 10^{-4}$ |
| | Spectral sensitizer 10 | $3.28 \times 10^{-4}$ |
| | Spectral sensitizer 11 | $3.28 \times 10^{-4}$ |
| Em-O | Spectral sensitizer 10 | $3.37 \times 10^{-4}$ |
| | Spectral sensitizer 11 | $3.37 \times 10^{-4}$ |
| | Spectral sensitizer 12 | $3.37 \times 10^{-4}$ |

Spectral sensitizer 4

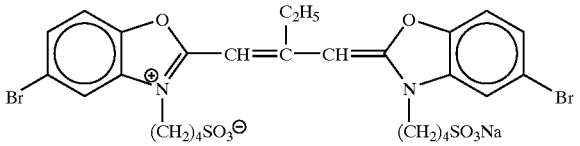

Spectral sensitizer 5

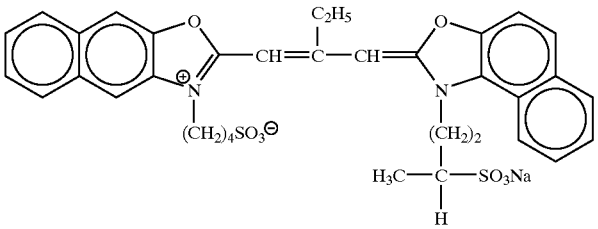

Spectral sensitizer 6

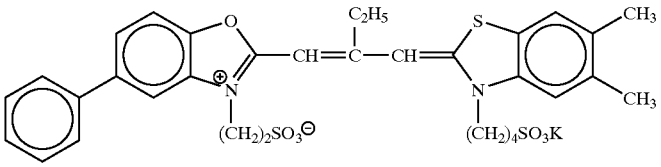

Spectral sensitizer 7

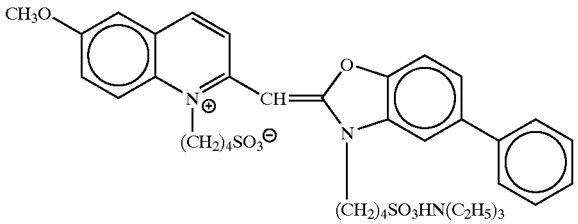

Spectral sensitizer 8

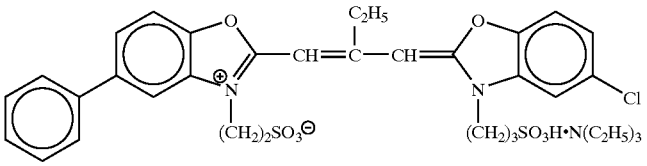

Spectral sensitizer 9

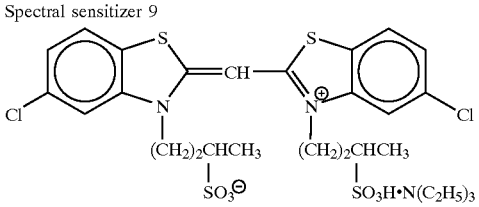

TABLE 8-continued

Spectral sensitizer 10

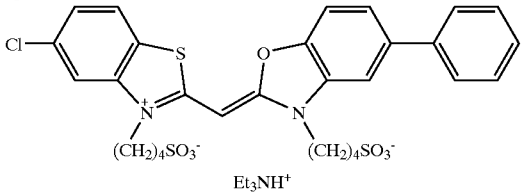

Spectral sensitizer 11

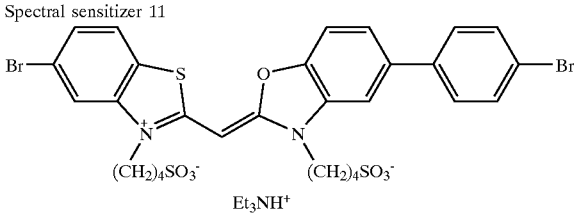

Spectral sensitizer 12

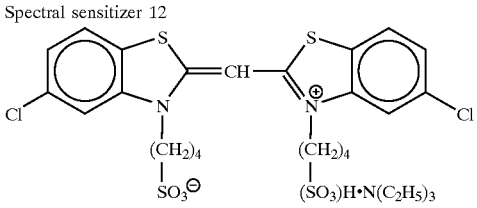

Spectral sensitizer 13

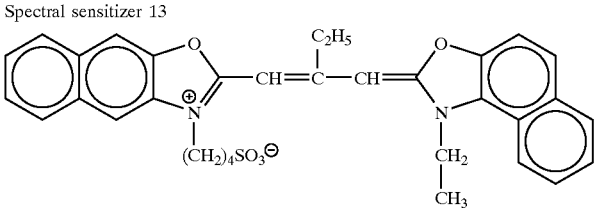

1) Support

The support employed in this Example was prepared by the following procedure.

1) First Layer and Substratum:

Both major surfaces of a 90 μm thick polyethylene naphthalate support were treated with glow discharge under such conditions that the treating ambient pressure was 2.66×10 Pa, the $H_2O$ partial pressure of ambient gas 75%, the discharge frequency 30 kHz, the output 2500 W, and the treating strength 0.5 kV·A·min/m$^2$. This support was coated, in a coating amount of 5 mL/m$^2$, with a coating liquid of the following composition to provide the 1st layer in accordance with the bar coating method described in JP-B-58-4589.

| | |
|---|---|
| Conductive fine grain dispersion ($SnO_2/Sb_2O_5$ grain conc. 10% water dispersion, secondary agglomerate of 0.005 μm diam. primary grains which has an av. grain size of 0.05 μm) | 50 pts. wt. |
| Gelatin | 0.5 pt. wt. |
| Water | 49 pts. wt. |
| Polyglycerol polyglycidyl ether | 0.16 pt. wt. |
| Polyoxyethylene sorbitan monolaurate (polymn. degree 20) | 0.1 pt. wt. |

The support furnished with the first coating layer was wound round a stainless steel core of 20 cm diameter and heated at 110° C. (Tg of PEN support: 119° C.) for 48 hr to thereby effect heat history annealing. The other side of the support opposite to the first layer was coated, in a coating amount of 10 mL/m$^2$, with a coating liquid of the following composition to provide a substratum for emulsion in accordance with the bar coating method.

| | |
|---|---|
| Gelatin | 1.01 pts. wt. |
| Salicylic acid | 0.30 pt. wt. |
| Resorcin | 0.40 pt. wt. |
| Polyoxyethylene nonylphenyl ether (polymn. degree 10) | 0.11 pt. wt. |
| Water | 3.53 pts. wt. |
| Methanol | 84.57 pts. wt. |
| n-Propanol | 10.08 pts. wt. |

Furthermore, the following second layer and third layer were superimposed in this sequence on the first layer by coating. Finally, multilayer coating of a color negative lightsensitive material of the composition indicated below was performed on the opposite side. Thus, a transparent magnetic recording medium with silver halide emulsion layers was obtained.

2) Second Layer (Transparent Magnetic Recording Layer):

(1) Dispersion of Magnetic Substance:

1,100 parts by weight of Co-coated γ-$Fe_2O_3$ magnetic substance (average major axis length: 0.25 μm, $S_{BET}$: 39

$m^2/g$, Hc: $6.56\times10^4$A/m, σs: 77.1 $AM^2/kg$, and σr: 4 $Am^2/kg$), 220 parts by weight of water and 165 parts by weight of silane coupling agent (3-(poly(polymerization degree: 10)oxyethyl)oxypropyltrimethoxysilane) were fed into an open kneader, and blended well for 3 hr. The resultant coarsely dispersed viscous liquid was dried at 70° C. round the clock to thereby remove water, and heated at 110° C. for 1 hr. Thus, surface treated magnetic grains were obtained.

Further, in accordance with the following recipe, a composition was prepared by blending by means of the open kneader once more for 4 hr:

| | |
|---|---|
| Thus obtained surface treated magnetic grains | 855 g |
| Diacetylcellulose | 25.3 g |
| Methyl ethyl ketone | 136.3 g |
| Cyclohexanone | 136.3 g |

Still further, in accordance with the following recipe, a composition was prepared by carrying out fine dispersion by means of a sand mill (¼ G sand mill) at 2000 rpm for 4 hr. Glass beads of 1 mm diameter were used as medium.

| | |
|---|---|
| Thus obtained blend liquid | 45 g |
| Diacetylcellulose | 23.7 g |
| Methyl ethyl ketone | 127.7 g |
| Cyclohexanone | 127.7 g |

Moreover, in accordance with the following recipe, a magnetic substance containing intermediate liquid was prepared.

(2) Preparation of Magnetic Substance Containing Intermediate Liquid:

| | |
|---|---|
| Thus obtained fine dispersion of magnetic substance | 674 g |
| Diacetylcellulose soln. (solid content 4.34%, solvent: methyl ethyl ketone/cyclohexanone = 1/1) | 24,280 g |
| Cyclohexanone | 46 g |

These were mixed together and agitated by means of a disperser to thereby obtain a "magnetic substance containing intermediate liquid".

An α-alumina abrasive dispersion of the present invention was produced in accordance with the following recipe.

(a) Preparation of Sumicorundum AA-1.5 (Average Primary Grain Diameter: 1.5 μm, Specific Surface Area: 1.3 $m^2/g$) Grain Dispersion

| | |
|---|---|
| Sumicorundum AA-1.5 | 152 g |
| Silane coupling agent KBM903 (produced by Shin-Etsu Silicone) | 0.48 g |
| Diacetylcellulose soln. (solid content 4.5%, solvent: methyl ethyl ketone/cyclohexanone = 1/1) | 227.52 g |

In accordance with the above recipe, fine dispersion was carried out by means of a ceramic-coated sand mill (¼ G sand mill) at 800 rpm for 4 hr. Zirconia beads of 1 mm diameter were used as medium.

(b) Colloidal Silica Grain Dispersion (Fine Grains)

Use was made of "MEK-ST" produced by Nissan Chemical Industries, Ltd.

This is a dispersion of colloidal silica of 0.015 μm average primary grain diameter in methyl ethyl ketone as a dispersion medium, wherein the solid content is 30%.

(3) Preparation of a Coating Liquid for Second Layer:

| | |
|---|---|
| Thus obtained magnetic substance containing intermediate liquid | 19,053 g |
| Diacetylcellulose soln. (solid content 4.5%, solvent: methyl ethyl ketone/cyclohexanone = 1/1) | 264 g |
| Colloidal silica dispersion "MEK-ST" (dispersion b, solid content: 30%) | 128 g |
| AA-1.5 dispersion (dispersion a) | 12 g |
| Millionate MR-400 (produced by Nippon Polyurethane) diluent (solid content 20%, dilution solvent: methyl ethyl ketone/cyclohexanone = 1/1) | 203 g |
| Methyl ethyl ketone | 170 g |
| Cyclohexanone | 170 g |

A coating liquid obtained by mixing and agitating these was applied in a coating amount of 29.3 $mL/m^2$ with the use of a wire bar. Drying was performed at 110° C. The thickness of magnetic layer after drying was 1.0 μm.

3) Third Layer (Higher Fatty Acid Ester Sliding Agent Containing Layer)

(1) Preparation of Raw Dispersion of Sliding Agent

The following liquid A was heated at 100° C. to thereby effect dissolution, added to liquid B and dispersed by means of a high-pressure homogenizer, thereby obtaining a raw dispersion of sliding agent.

Liquid A:

| | |
|---|---|
| Liquid A: | |
| Compd. of the formula: $C_6H_{13}CH(OH)(CH_2)_{10}COOC_{50}H_{101}$ | 399 pts. wt. |
| Compd. of the formula: $n\text{-}C_{50}H_{101}O(CH_2CH_2O)_{16}H$ | 171 pts. wt. |
| Cyclohexanone | 830 pts. wt. |
| Liquid B: | |
| Cyclohexanone | 8,600 pts. wt. |

| | |
|---|---|
| Isopropyl alcohol | 93.54 pts. wt. |
| Silane coupling agent KBM903 (produced by Shin-Etsu Silicone) Compd. 1-1: $(CH_3O)_3Si—(CH_2)_3—NH_2$) | 5.53 pts. wt. |
| Compd. 8 | 2.93 pts. wt. |

Compound 8

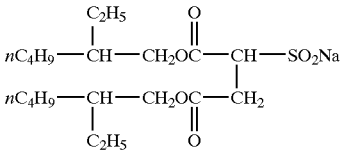

Seahostar KEP50 (amorphous spherical silica, av. grain size 0.5 μm, produced by Nippon Shokubai

| | |
|---|---|
| Kagaku Kogyo | 88.00 pts. wt. |

This composition was agitated for 10 min, and further the following was added.

| | |
|---|---|
| Diacetone alcohol | 252.93 pts. wt. |

The resultant liquid was dispersed by means of ultrasonic homogenizer "Sonifier 450 (manufactured by Branson)" for 3 hr while cooling with ice and stirring, thereby finishing spherical inorganic grain dispersion c1.

(3) Preparation of Spherical Organic Polymer Grain Dispersion

Spherical organic polymer grain dispersion (c2) was prepared in accordance with the following recipe.

| | |
|---|---|
| XC99-A8808 (produced by Toshiba Silicone Co., Ltd., spherical crosslinked polysiloxane grain, av. grain size 0.9 μm) | 60 pts. wt. |
| Methyl ethyl ketone | 120 pts. wt. |
| Cyclohexanone (solid content 20%, solvent: methyl ethyl ketone/cyclohexanone = 1/1) | 120 pts. wt. |

This mixture was dispersed by means of ultrasonic homogenizer "Sonifier 450 (manufactured by Branson)" for 2 hr while cooling with ice and stirring, thereby finishing spherical organic polymer grain dispersion c2.

(4) Preparation of Coating Liquid for 3rd Layer

A coating liquid for 3rd layer was prepared by adding the following components to 542 g of the aforementioned raw dispersion of sliding agent:

| | |
|---|---|
| Diacetone alcohol | 5,950 g |
| Cyclohexanone | 176 g |
| Ethyl acetate | 1,700 g |
| Above Seahostar KEP50 dispersion (c1) | 53.1 g |
| Above spherical organic polymer grain dispersion (c2) | 300 g |
| FC431 (produced by 3M, solid content 50%, solvent: ethyl acetate) | 2.65 g |
| BYK310 (produced by BYK ChemiJapan, solid content 25%) | 5.3 g |

The above 3rd layer coating liquid was applied to the 2nd layer in a coating amount of 10.35 mL/m$^2$, dried at 110° C. and further postdried at 97° C. for 3 min.

4) Application of Lightsensitive Layer by Coating:

The thus obtained back layers on its side opposite to the support were coated with a plurality of layers of the following respective compositions, thereby obtaining a color negative film.

(Composition of Lightsensitive Layer)

Main materials used in each of the layers are classified as follows:

| | |
|---|---|
| ExC: cyan coupler, | UV: ultraviolet absorber, |
| ExM: magenta coupler, | HBS: high b.p. org. solvent, |
| ExY: yellow coupler, | H: gelatin hardener. |

(For each specific compound, in the following description, numeral is assigned after the character, and the formula is shown later).

The numeric value given beside the description of each component is for the coating amount expressed in the unit of g/m$^2$. With respect to the silver halide and colloidal silver, the coating amount is in terms of silver quantity.

| | | |
|---|---|---|
| 1st layer (First antihalation layer) | | |
| Black colloidal silver | silver | 0.122 |
| 0.07 μm silver iodobromide emulsion | silver | 0.01 |
| Gelatin | | 0.919 |
| ExM-1 | | 0.066 |
| ExC-1 | | 0.002 |
| ExC-3 | | 0.002 |
| Cpd-2 | | 0.001 |
| F-8 | | 0.010 |
| HBS-1 | | 0.005 |
| HBS-2 | | 0.002 |
| 2nd layer (Second antihalation layer) | | |
| Black colloidal silver | silver | 0.055 |
| Gelatin | | 0.425 |
| ExF-1 | | 0.002 |
| F-8 | | 0.012 |
| Solid disperse dye ExF-7 | | 0.120 |
| HBS-1 | | 0.074 |
| 3rd layer (Interlayer) | | |
| ExC-2 | | 0.050 |
| Cpd-1 | | 0.090 |
| Polyethyl acrylate latex | | 0.200 |
| HBS-1 | | 0.100 |
| Gelatin | | 0.700 |
| 4th layer (Low-speed red-sensitive emulsion layer) | | |
| Em-D | silver | 0.577 |
| Em-C | silver | 0.347 |
| ExC-1 | | 0.188 |
| ExC-2 | | 0.011 |
| ExC-3 | | 0.075 |
| ExC-4 | | 0.121 |
| ExC-5 | | 0.010 |
| ExC-6 | | 0.007 |
| ExC-8 | | 0.050 |
| ExC-9 | | 0.020 |
| Cpd-2 | | 0.012 |
| Cpd-4 | | 0.012 |
| HBS-1 | | 0.114 |
| HBS-5 | | 0.038 |
| Gelatin | | 1.474 |
| 5th layer (Medium-speed red-sensitive emulsion layer) | | |
| Em-B | silver | 0.431 |
| Em-C | silver | 0.432 |
| ExC-1 | | 0.154 |
| ExC-2 | | 0.068 |
| ExC-3 | | 0.018 |
| ExC-4 | | 0.103 |
| ExC-5 | | 0.023 |
| ExC-6 | | 0.010 |
| ExC-8 | | 0.016 |
| ExC-9 | | 0.005 |
| Cpd-2 | | 0.036 |
| Cpd-4 | | 0.012 |
| HBS-1 | | 0.129 |
| Gelatin | | 1.086 |
| 6th layer (High-speed red-sensitive emulsion layer) | | |
| Em-A | silver | 1.108 |
| ExC-1 | | 0.180 |
| ExC-3 | | 0.035 |
| ExC-6 | | 0.029 |
| ExC-8 | | 0.110 |
| ExC-9 | | 0.020 |
| Cpd-2 | | 0.050 |
| Cpd-4 | | 0.020 |
| HBS-1 | | 0.329 |
| HBS-2 | | 0.120 |
| Gelatin | | 1.245 |

-continued

| | | |
|---|---|---|
| 7th layer (Interlayer) | | |
| Cpd-1 | | 0.094 |
| Cpd-6 | | 0.369 |
| Solid disperse dye ExF-4 | | 0.030 |
| HBS-1 | | 0.049 |
| Polyethyl acrylate latex | | 0.088 |
| Gelatin | | 0.886 |
| 8th layer (Layer capable of imparting interlayer effect on red-sensitive layer) | | |
| Em-J | silver | 0.293 |
| Em-K | silver | 0.293 |
| Cpd-4 | | 0.030 |
| ExM-2 | | 0.120 |
| ExM-3 | | 0.016 |
| ExM-4 | | 0.026 |
| ExY-1 | | 0.016 |
| ExY-4 | | 0.036 |
| ExC-7 | | 0.026 |
| HBS-1 | | 0.090 |
| HBS-3 | | 0.003 |
| HBS-5 | | 0.030 |
| Gelatin | | 0.610 |
| 9th layer (Low-speed green-sensitive emulsion layer) | | |
| Em-H | silver | 0.329 |
| Em-G | silver | 0.333 |
| Em-I | silver | 0.088 |
| ExM-2 | | 0.378 |
| ExM-3 | | 0.047 |
| ExY-1 | | 0.017 |
| ExC-7 | | 0.007 |
| HBS-1 | | 0.098 |
| HBS-3 | | 0.010 |
| HBS-4 | | 0.077 |
| HBS-5 | | 0.548 |
| Cpd-5 | | 0.010 |
| Gelatin | | 1.470 |
| 10th layer (Medium-speed green-sensitive emulsion layer) | | |
| Em-F | silver | 0.457 |
| ExM-2 | | 0.032 |
| ExM-3 | | 0.029 |
| ExM-4 | | 0.029 |
| ExY-3 | | 0.007 |
| ExC-6 | | 0.010 |
| ExC-7 | | 0.012 |
| ExC-8 | | 0.010 |
| HBS-1 | | 0.065 |
| HBS-3 | | 0.002 |
| HBS-5 | | 0.020 |
| Cpd-5 | | 0.004 |
| Gelatin | | 0.446 |
| 11th layer (High-speed green-sensitive emulsion layer) | | |
| Em-E | silver | 0.794 |
| ExC-6 | | 0.002 |
| ExC-8 | | 0.010 |
| ExM-1 | | 0.013 |
| ExM-2 | | 0.011 |
| ExM-3 | | 0.030 |
| ExM-4 | | 0.017 |
| ExY-3 | | 0.003 |
| Cpd-3 | | 0.004 |
| Cpd-4 | | 0.007 |
| Cpd-5 | | 0.010 |
| HBS-1 | | 0.148 |
| HBS-5 | | 0.037 |
| Polyethyl acrylate latex | | 0.099 |
| Gelatin | | 0.939 |
| 12th layer (Yellow filter layer) | | |
| Cpd-1 | | 0.094 |
| Solid disperse dye ExF-2 | | 0.150 |
| Solid disperse dye ExF-5 | | 0.010 |

-continued

| | | |
|---|---|---|
| Oil soluble dye ExF-6 | | 0.010 |
| HBS-1 | | 0.049 |
| Gelatin | | 0.630 |
| 13th layer (Low-speed blue-sensitive emulsion layer) | | |
| Em-O | silver | 0.112 |
| Em-M | silver | 0.320 |
| Em-N | silver | 0.240 |
| ExC-1 | | 0.027 |
| ExC-7 | | 0.013 |
| ExY-1 | | 0.002 |
| ExY-2 | | 0.890 |
| ExY-4 | | 0.058 |
| Cpd-2 | | 0.100 |
| Cpd-3 | | 0.004 |
| HBS-1 | | 0.222 |
| HBS-5 | | 0.074 |
| Gelatin | | 2.058 |
| 14th layer (High-speed blue-sensitive emulsion layer) | | |
| Em-L | silver | 0.714 |
| ExY-2 | | 0.211 |
| ExY-4 | | 0.068 |
| Cpd-2 | | 0.075 |
| Cpd-3 | | 0.001 |
| HBS-1 | | 0.071 |
| Gelatin | | 0.678 |
| 15th layer (1st protective layer) | | |
| 0.07 μm silver iodobromide emulsion | silver | 0.301 |
| UV-1 | | 0.211 |
| UV-2 | | 0.132 |
| UV-3 | | 0.198 |
| UV-4 | | 0.026 |
| F-18 | | 0.009 |
| S-1 | | 0.086 |
| HBS-1 | | 0.175 |
| HBS-4 | | 0.050 |
| Gelatin | | 1.984 |
| 16th layer (2nd protective layer) | | |
| H-1 | | 0.400 |
| B-1 (diameter 1.7 μm) | | 0.050 |
| B-2 (diameter 1.7 μm) | | 0.150 |
| B-3 | | 0.050 |
| S-1 | | 0.200 |
| Gelatin | | 0.750 |

In addition to the above components, W-1 to W-6, B-4 to B-6, F-1 to F-18, a lead salt, a platinum salt, an iridium salt and a rhodium salt were appropriately added to the individual layers in order to improve the storage life, processability, resistance to pressure, antiseptic and mildew-proofing properties, antistatic properties and coating property thereof.

Preparation of Dispersion of Organic Solid Disperse Dye:

The ExF-2 of the 12th layer was dispersed by the following method. Specifically,

| | |
|---|---|
| Wet cake of ExF-2 (containing 17.6 wt. % water) | 2.800 kg |
| Sodium octylphenyldiethoxymethanesulfonate (31 wt. % aq. soln.) | 0.376 kg |
| F-15 (7% aq. soln.) | 0.011 kg |
| Water | 4.020 kg |
| Total | 7.210 kg |
| (adjusted to pH = 7.2 with NaOH). | |

Slurry of the above composition was agitated by means of a dissolver to thereby effect a preliminary dispersion, and further dispersed by means of agitator mill LMK-4 under such conditions that the peripheral speed, delivery rate and packing ratio of 0.3 mm-diameter zirconia beads were 10 m/s, 0.6 kg/min and 80%, respectively, until the absorbance ratio of the dispersion became 0.29. Thus, a solid particulate dispersion was obtained, wherein the average particle diameter of dye particulate was 0.29 μm.

Solid dispersions of ExF-4 and ExF-7 were obtained in the same manner. The average particle diameters of these dye particulates were 0.28 μm and 0.49 μm, respectively. ExF-5 was dispersed by the microprecipitation dispersion method described in Example 1 of EP. No. 549,489A. The average particle diameter thereof was 0.06 μm.

The compounds used in the preparation of each of the layers will be listed below.

ExC-1

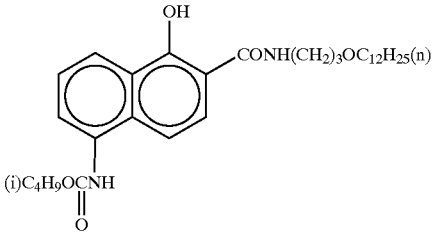

ExC-2

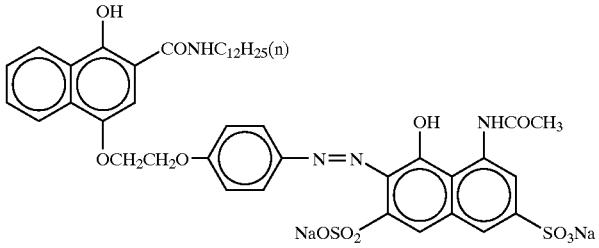

ExC-3

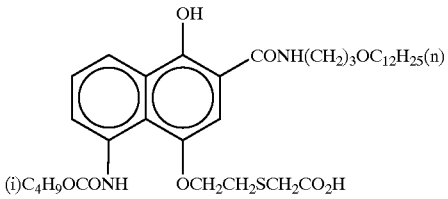

ExC-4

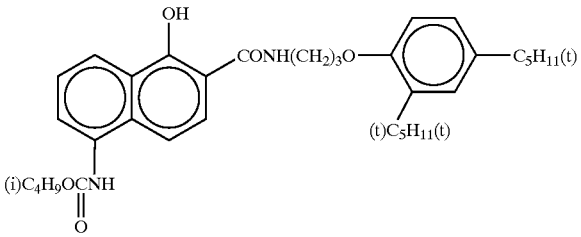

ExC-5

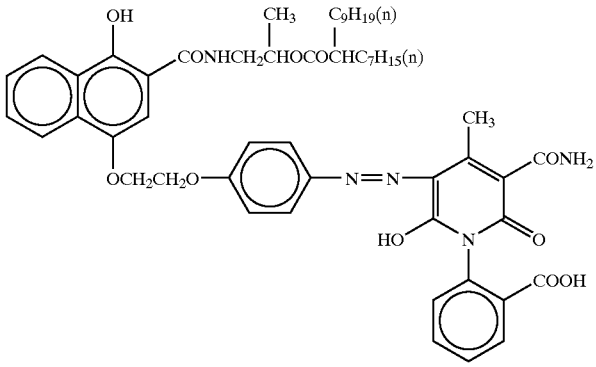

ExC-6

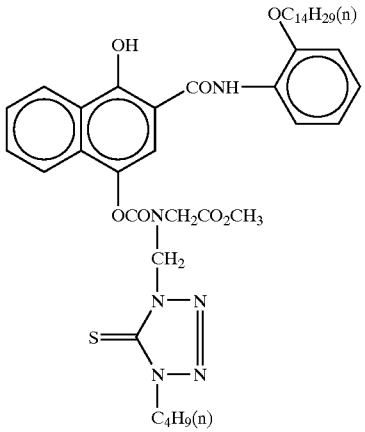

ExC-7

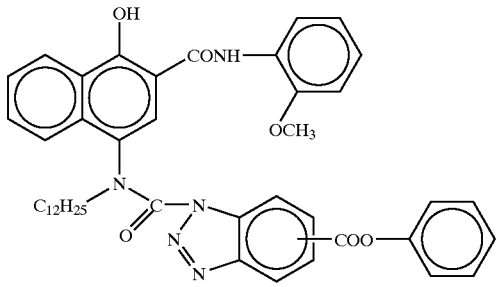

ExC-8

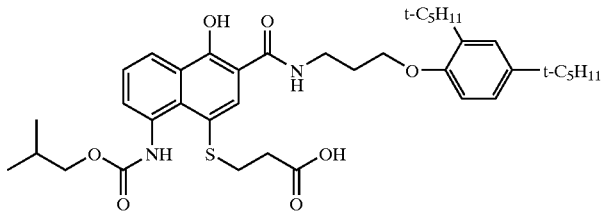

-continued
ExC-9
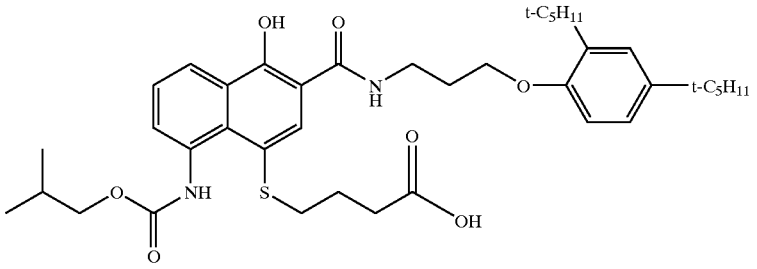
ExM-1
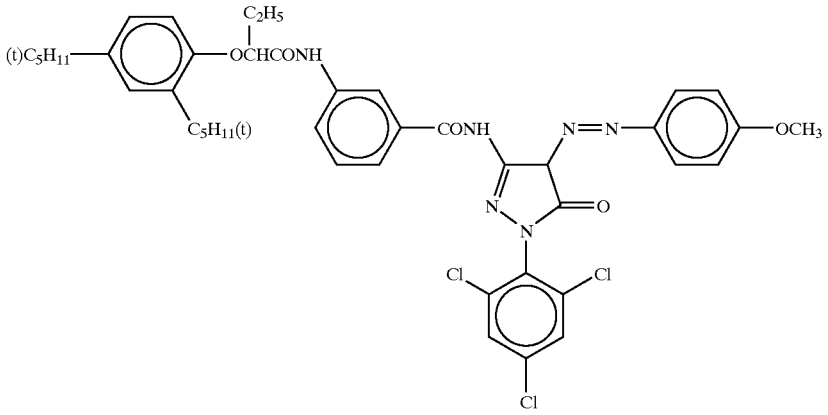
ExM-2
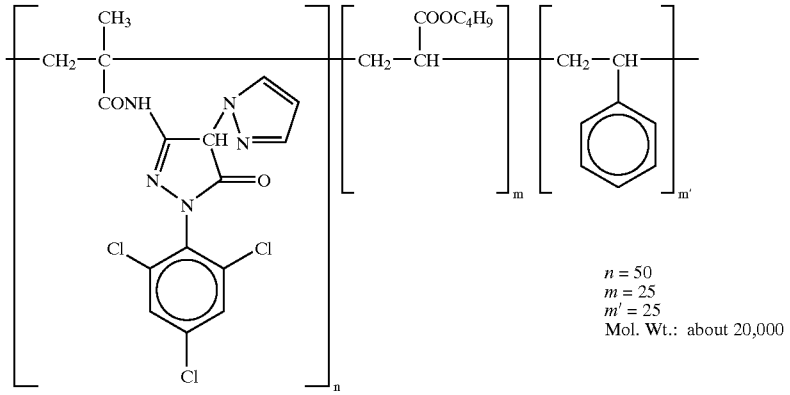
$n = 50$
$m = 25$
$m' = 25$
Mol. Wt.: about 20,000
ExM-3
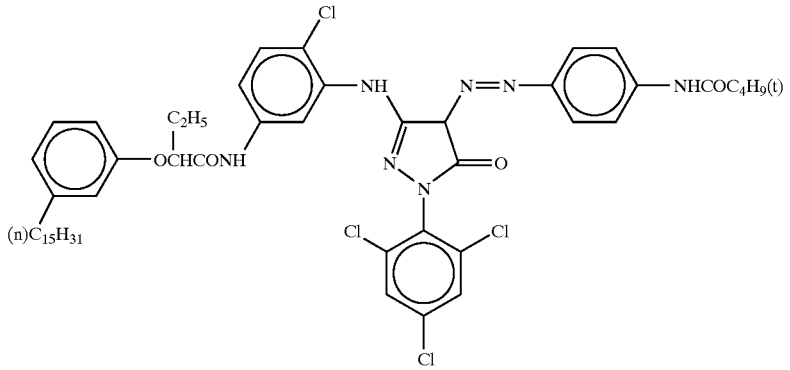

-continued
ExM-4
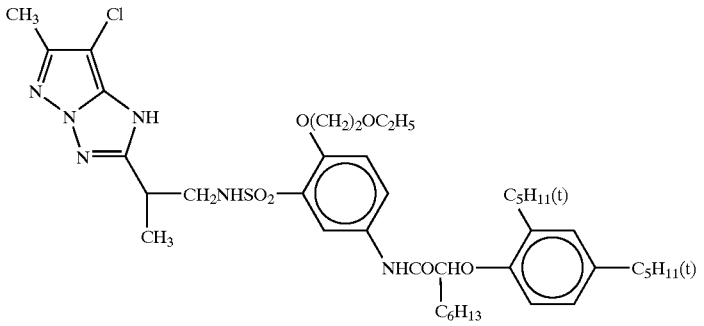
ExY-1
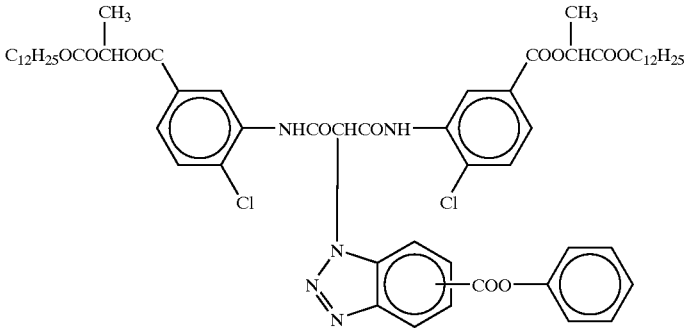
ExY-2
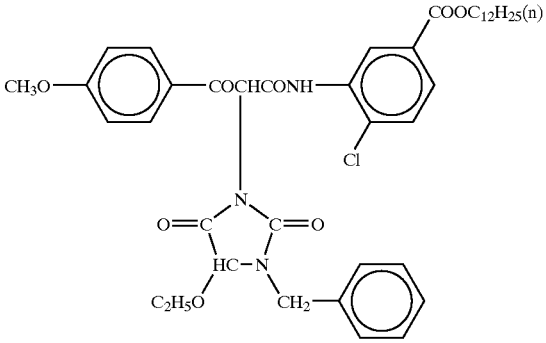
ExY-3
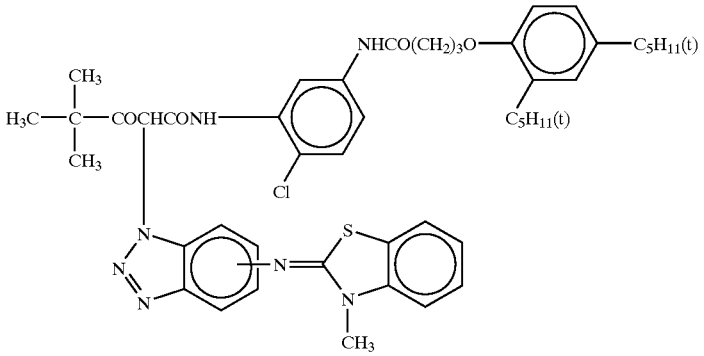

-continued
ExY-4
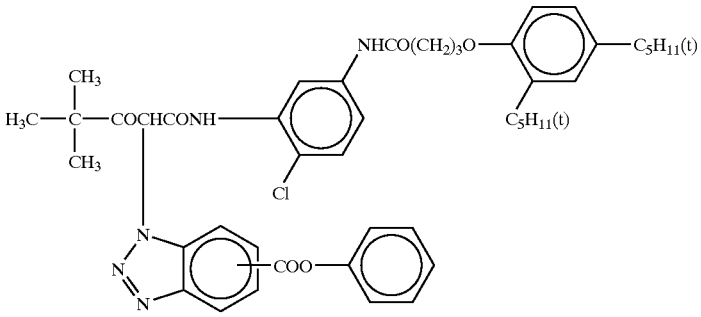
Cpd-1
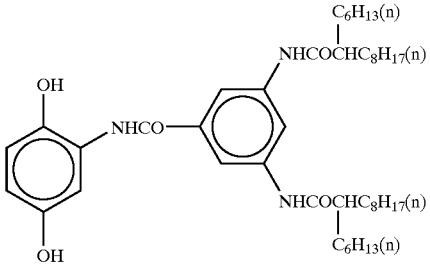
Cpd-2
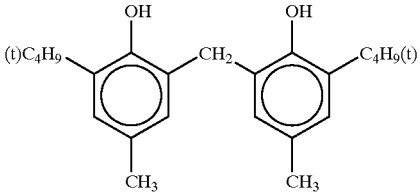
Cpd-3
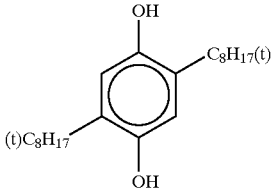
Cpd-4
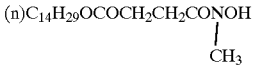
Cpd-5
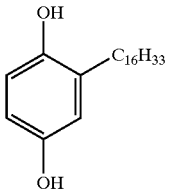
Cpd-6
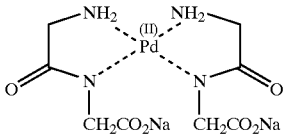
UV-1
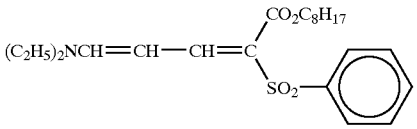
UV-2
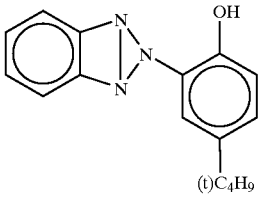
UV-3
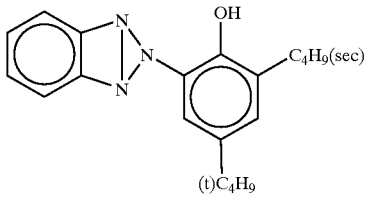
UV-4
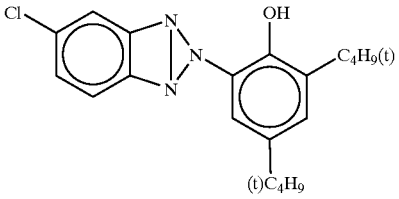
B-1
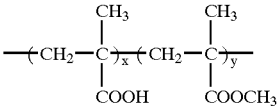
$x/y$ = 10/90 (wt. ratio)
Av. mol. wt.: about 35,000
B-2
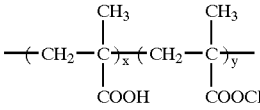
$x/y$ = 40/60 (wt. ratio)
Av. mol. wt.: about 20,000

-continued
B-3
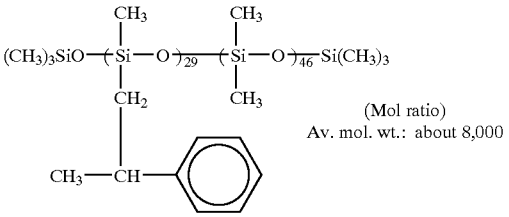
HBS-1
Tricresyl phospate
HBS-2
Di-n-butyl phthalate
HBS-3
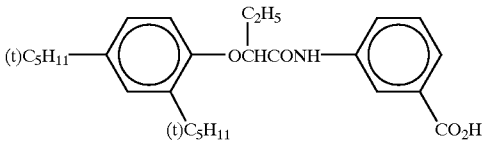
HBS-4
Tri (2-ethylhexyl) phosphate
HBS-5
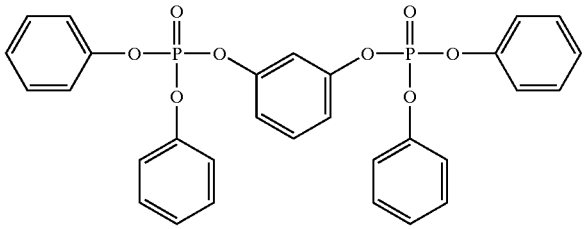
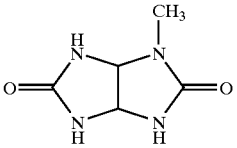
S-1
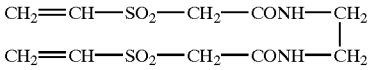
H-1
F-1
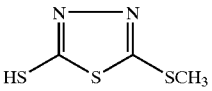
F-2
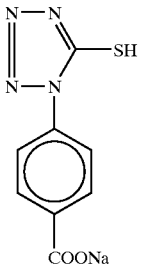
F-3
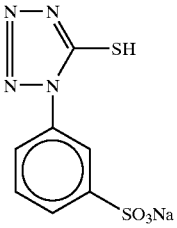
F-4
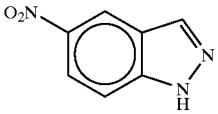
F-5
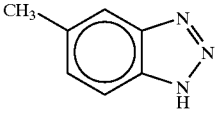
F-6
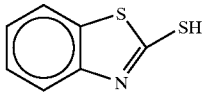

-continued
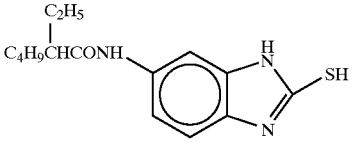
F-7
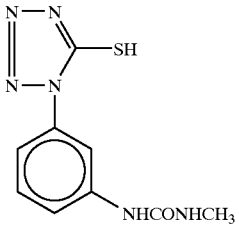
F-8
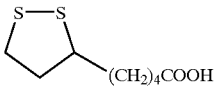
F-9
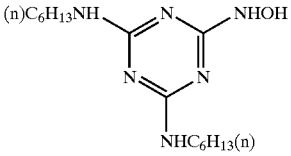
F-10
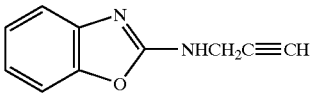
F-11
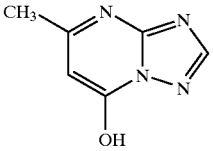
F-12
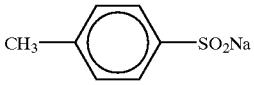
F-13
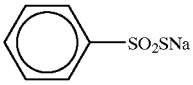
F-14
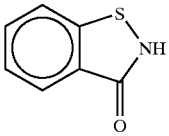
F-15
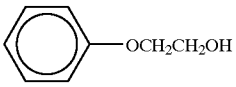
F-16
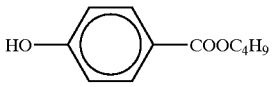
F-17
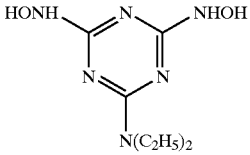
F-18
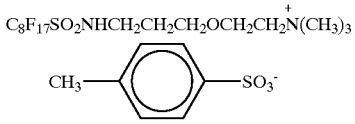
W-1
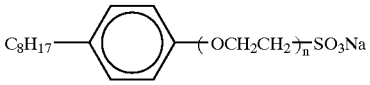
W-2
$n = 2\text{-}4$
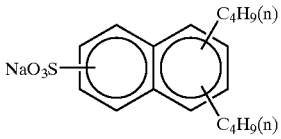
W-3
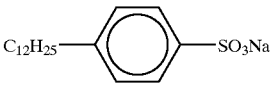
W-4
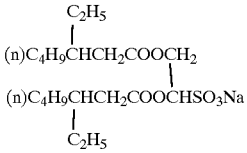
W-5
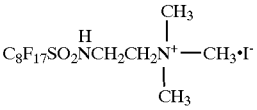
W-6

-continued
B-4
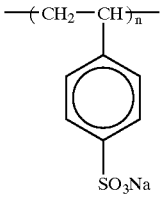
Av. mol. wt.: about 750,000
B-5
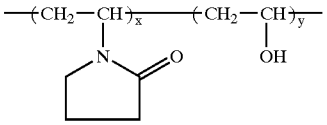
*x/y* = 70/30 (wt. ratio)
Av. mol. wt.: about 17,000
B-6
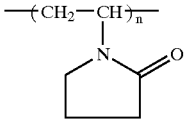
Av. mol. wt.: about 10,000
ExF-1
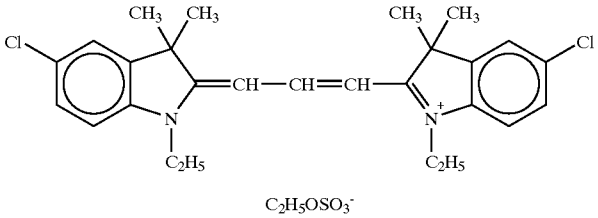
ExF-2
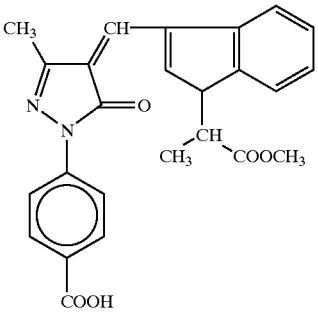
ExF-4
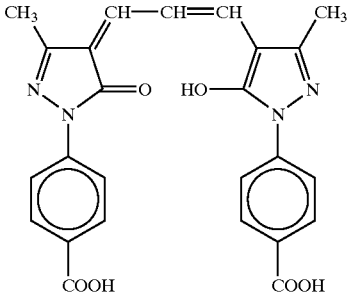
ExF-5
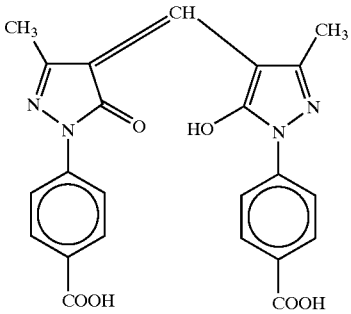
ExF-6
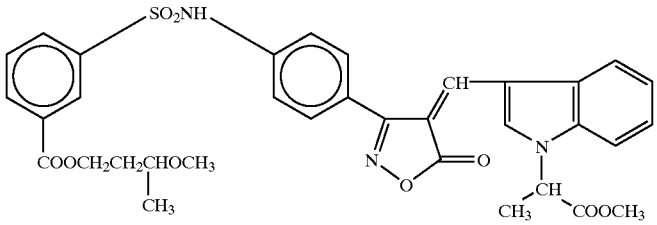
ExF-7
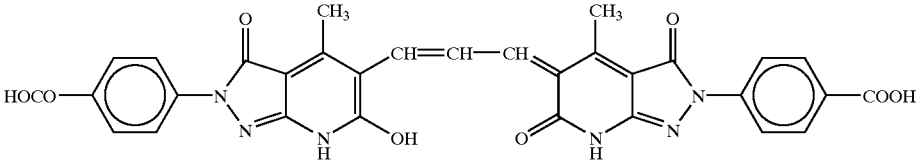

Comparative Compound

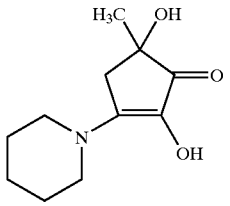

The above silver halide color photosensitive material is designated Sample 401.

(Preparation of Sample 402)

An emulsion was prepared in the same manner as in emulsion Em-A of the 6th layer of Sample 401, except that Compound 1 of the invention was not added. Sample 402 was prepared in the same manner as in Sample 401, except that emulsion Em-A in Sample 401 was replaced with the same silver amount of the thus prepared emulsion.

(Samples 403–420)

Another emulsion was prepared in the same manner as in emulsion Em-A of the 6th layer of Sample 402, except that each of Comparative compound and compounds of the invention listed in Table 9 was added in an amount of $5.0\times10^{-4}$ mol per mol of silver. Samples 403–420 were prepared in the same manner as in Sample 401, except that emulsion Em-A in Sample 401 was replaced with the same silver amount of the thus prepared emulsions, respectively.

TABLE 9

| Sample No. | Additive | Addition amount (mol per mol of silver) | $S_{0.8}$ | $\Delta S_{0.8}$ | Change in storage fog | Remarks |
|---|---|---|---|---|---|---|
| 401 | Compound 1 of the invention | $5.0 \times 10^{-4}$ | 100 | 0 | 0.05 | Inv. |
| 402 | none | 0 | 100 | +0.05 | 0.11 | Comp. |
| 403 | Comparative compound | $5.0 \times 10^{-4}$ | 100 | +0.05 | 0.11 | Comp. |
| 404 | Compound 4 of the invention | $5.0 \times 10^{-4}$ | 100 | 0 | 0.05 | Inv. |
| 405 | Compound 5 of the invention | $5.0 \times 10^{-4}$ | 100 | 0 | 0.06 | Inv. |
| 406 | Compound 6 of the invention | $5.0 \times 10^{-4}$ | 100 | +0.01 | 0.06 | Inv. |
| 407 | Compound 8 of the invention | $5.0 \times 10^{-4}$ | 100 | 0 | 0.05 | Inv. |
| 408 | Compound 13 of the invention | $5.0 \times 10^{-4}$ | 100 | 0 | 0.06 | Inv. |
| 409 | Compound 14 of the invention | $5.0 \times 10^{-4}$ | 100 | 0 | 0.06 | Inv. |
| 410 | Compound 22 of the invention | $5.0 \times 10^{-4}$ | 100 | +0.01 | 0.06 | Inv. |
| 411 | Compound 23 of the invention | $5.0 \times 10^{-4}$ | 100 | 0 | 0.05 | Inv. |
| 412 | Compound 24 of the invention | $5.0 \times 10^{-4}$ | 100 | 0 | 0.05 | Inv. |
| 413 | Compound 29 of the invention | $5.0 \times 10^{-4}$ | 100 | 0 | 0.05 | Inv. |
| 414 | Compound 35 of the invention | $5.0 \times 10^{-4}$ | 100 | +0.02 | 0.06 | Inv. |
| 415 | Compound 36 of the invention | $5.0 \times 10^{-4}$ | 100 | +0.02 | 0.06 | Inv. |
| 416 | Compound 49 of the invention | $5.0 \times 10^{-4}$ | 100 | +0.02 | 0.06 | Inv. |
| 417 | Compound 51 of the invention | $5.0 \times 10^{-4}$ | 100 | +0.02 | 0.06 | Inv. |
| 418 | Compound 71 of the invention | $5.0 \times 10^{-4}$ | 100 | +0.02 | 0.06 | Inv. |
| 419 | Compound 72 of the invention | $5.0 \times 10^{-4}$ | 100 | +0.02 | 0.06 | Inv. |
| 420 | Compound 73 of the invention | $5.0 \times 10^{-4}$ | 100 | 0 | 0.05 | Inv. |

(Estimation of Variation of Photographic Performance by Aging)

With respect to the coating samples, the variation of photographic performance by aging was estimated by the following method.

Samples were allowed to stand still at 40° C. in a relative humidity of 70% for 14 hr. The samples were subjected to 1/100 sec exposure through a continuous wedge at a color temperature of 4800 K, and aged under the following three different conditions. Aging (1) was performed at −20° C. for 14 days. Aging (2) was performed at 40° C. in a relative humidity of 60% for 14 days. Aging (3) was performed at 50° C. in a relative humidity of 60% for 14 days. After the aging, the samples were subjected to the following color development processing, and the density of each of the samples after processing was measured through a red filter, thereby achieving an estimation of photographic performance.

Estimation of the film speed change by the aging from exposure to processing will be described. The film speed was expressed in terms of relative value ($S_{0.8}$) of the logarithm of inverse number of exposure amount, expressed by lux·sec, realizing a cyan density of fog density+0.8 (providing that the film speed of sample 402 was 100). The speed change by aging was estimated by determining the extent of change of $S_{0.8}$ of aging (2) over that of aging (1).

The estimation of fog increase by aging was conducted by determining the extent of increase of fog density of aging (3) over that of aging (1).

A summary of obtained results are listed in Table 9.

The development was carried out by the use of automatic processor FP-360B manufactured by Fuji Photo Film Co., Ltd. under the following conditions. The apparatus was reworked so as to prevent the flow of overflow solution from the bleaching bath toward subsequent baths and to, instead, discharge all the solution into a waste solution tank. This FP-360B is fitted with an evaporation correcting means described in JIII Journal of Technical Disclosure No. 94-4992 issued by Japan Institute of Invention and Innovation.

The processing steps and compositions of processing solutions are as follows.

(Processing Steps)

| Step | Time | Temp. | Qty. of replenisher* | Tank vol. |
|---|---|---|---|---|
| Color Development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |
| Stabilization (2) | 20 sec | 38.0° C. | 15 mL | 3 L |
| Drying | 1 min 30 sec | 60° C. | | |

*The replenishment rate is a value per 1.1 m of a 35-mm wide lightsensitive material (equivalent to one role of 24 Ex. film).

The stabilizer was fed from stabilization (2) to stabilization (1) by counter current. All the overflow of washing water was introduced into fixing bath (2). The amounts of drag-in of developer into the bleaching step, drag-in of bleaching solution into the fixing step and drag-in of fixer into the washing step were 2.5 mL, 2.0 mL and 2.0 mL, respectively, per 1.1 m of a 35-mm wide lightsensitive material. Each crossover time was 6 sec, which was included in the processing time of the previous step.

The open area of the above processor was 100 $cm^2$ for the color developer, 120 $cm^2$ for the bleaching solution and about 100 $cm^2$ for the other processing solutions.

The composition of each of the processing solutions was as follows.

| | Tank solution (g) | Replenisher (g) |
|---|---|---|
| (Color developer) | | |
| Diethylenetriamine-pentaacetic acid | 3.0 | 3.0 |
| Disodium catechol-3,5-disulfonate | 0.3 | 0.3 |
| Sodium sulfite | 3.9 | 5.3 |
| Potassium carbonate | 39.0 | 39.0 |
| Disodium-N,N-bis(2-sulfo-natoethyl)hydroxylamine | 1.5 | 2.0 |
| Potassium bromide | 1.3 | 0.3 |
| Potassium iodide | 1.3 mg | — |
| 4-Hydroxy-6-methyl-1,3,3a,7-tetrazaindene | 0.05 | — |
| Hydroxylamine sulfate | 2.4 | 3.3 |
| 2-Methyl-4-[N-ethyl-N-(β-hydroxyethyl)amino]-aniline sulfate | 4.5 | 6.5 |
| Water to make | 1,000 mL | 1,000 mL |
| pH | 10.05 | 10.18. |
| This pH was adjusted by the use of potassium hydroxide and sulfuric acid. | | |
| (Bleaching solution) | | |
| Fe(III) ammonium 1,3-diamino-propanetetraacetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1,000 mL | 1,000 mL |
| pH | 4.6 | 4.0. |
| This pH was adjusted by the use of aqueous ammonia | | |

5:95 (by volume) mixture of the above bleaching tank soln. and the following fixing tank soln, pH 6.8.

| (Fixing (2)) | Tank solution (g) | Replenisher (g) |
|---|---|---|
| Aq. soln. of ammonium thiosulfate (750 g/L) | 240 mL | 720 mL |
| Imidazole | 7 | 21 |
| Ammonium methanethiosulfonate | 5 | 15 |
| Ammonium methanesulfinate | 10 | 30 |
| Ethylenediaminetetraacetic acid | 13 | 39 |
| Water to make | 1,000 mL | 1,000 mL |
| pH | 7.4 | 7.45. |

This pH was adjusted by the use of aqueous ammonia and acetic acid.

(Washing Water)

Tap water was passed through a mixed-bed column filled with H-type strongly acidic cation exchange resin (Amberlite IR-120B produced by Rohm & Haas Co.) and OH-type strongly basic anion exchange resin (Amberlite IR-400 produced by the same maker) so as to set the concentration of calcium and magnesium ions at 3 mg/L or less. Subsequently, 20 mg/L of sodium dichloroisocyanurate and 150 mg/L of sodium sulfate were added. The pH of the solution ranged from 6.5 to 7.5.

| (Stabilizer): common to tank solution and replenisher | (g) |
|---|---|
| Sodium p-toluenesulfinate | 0.03 |
| Polyoxyethylene p-monononylphenyl ether (average polymerization degree 10) | 0.2 |
| Sodium salt of 1,2-benzoisothiazolin-3-one | 0.10 |
| Disodium ethylenediaminetetraacetate | 0.05 |
| 1,2,4-triazole | 1.3 |
| 1.4-bis(1,2,4-triazol-1-ylmethyl)-piperazine | 0.75 |
| Water | q.s ad 1.0 L |
| ph | 8.5 |

As apparent from Table 9, the samples 401 and 404 to 420 wherein compounds of the present invention were employed enable reducing not only the storage fog but also the speed variation ($\Delta S_{0.8}$) by the aging from exposure to processing, as compared with those of the samples 402 and 403.

The present invention enables providing a silver halide color photosensitive material which is excellent in speed highness, fog lowness, raw stock storability and exposure humidity dependence.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide photosensitive material containing a compound of the following general formula (I):

(I)

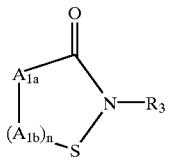

wherein $A_{1a}$ represents a group selected from among $CR_{1a}R_{2a}$, $NR_{1a}$, an oxygen atom and sulfur atom; $A_{1b}$ represents a group selected from among $CR_{1b}R_{2b}$, $NR_{1b}$, an oxygen atom and sulfur atom; and each of $R_{1a}$, $R_{2a}$, $R_{1b}$, $R_{2b}$ and $R_3$ represents a hydrogen atom or a substituent, provided that, in the groups of $CR_{1a}R_{2a}$ and $CR_{1b}R_{2b}$, $R_{1a}R_{2a}$ and $R_{1b}R_{2b}$ may represent a single divalent substituent; n represents an integer of 1 to 4, provided that, when n is 2 or more, a plurality of $A_{1b}$s may be the same or different.

2. The silver halide photosensitive material according to claim 1, wherein n in the general formula (I) is 1.

3. The silver halide photosensitive material according to claim 1, wherein $A_{1a}$ in the general formula (I) is $CR_{1a}R_{2a}$, wherein each of $R_{1a}$ and $R_{2a}$ represents a hydrogen atom or a substituent, provided that, $R_{1a}R_{2a}$ may represent a single divalent substituent.

4. The silver halide photosensitive material according to claim 1, wherein $A_{1b}$ in the general formula (I) is $CR_{1b}R_{2b}$, wherein each of $R_{1b}$ and $R_{2b}$ represents a hydrogen atom or a substituent, provided that, $R_{1b}R_{2b}$ may represent a single divalent substituent.

5. The silver halide photosensitive material according to claim 1, wherein $A_{1a}$ in the general formula (I) is $CH_2$.

6. The silver halide photosensitive material according to claim 1, wherein $A_{1b}$ in the general formula (I) is $CH_2$.

7. The silver halide photosensitive material according to claim 1, wherein $R_3$ in the general formula (I) is a hydrogen atom.

8. The silver halide photosensitive material according to claim 1, wherein the photosensitive material contains an emulsion comprising tabular silver halide grains each having an aspect ratio of 2 or more in an amount of 50% or more of the total projected area.

9. The silver halide photosensitive material according to claim 1, wherein the photosensitive material contains silver halide grains having a silver chloride content of 95 mol % or more.

10. The silver halide photosensitive material according to claim 1, wherein the photosensitive material is a color paper.

11. The silver halide photosensitive material according to claim 1, wherein the photosensitive material is a color negative.

* * * * *